US010962226B2

(12) United States Patent
Luo et al.

(10) Patent No.: US 10,962,226 B2
(45) Date of Patent: Mar. 30, 2021

(54) DUAL-GAS SOURCE GAS CONTROL SYSTEM WITH ANTI-GAS SOURCE MISCONNECTION AND CONTROL CIRCUIT THEREOF

(71) Applicant: ZHEJIANG FUERJ ELECTRIC SCIENCE AND TECHNOLOGY CO. LTD., Zhejiang (CN)

(72) Inventors: Jianfu Luo, Zhejiang (CN); Xueqing Zhao, Zhejiang (CN)

(73) Assignee: ZHEJIANG FUERJ ELECTRIC SCIENCE AND TECHNOLOGY CO. LTD., Zhejiang (CN)

( * ) Notice: Subject to any disclaimer, the term of this patent is extended or adjusted under 35 U.S.C. 154(b) by 0 days.

(21) Appl. No.: 16/813,713

(22) Filed: Mar. 9, 2020

(65) Prior Publication Data

US 2020/0318830 A1 Oct. 8, 2020

(30) Foreign Application Priority Data

Mar. 8, 2019 (CN) ..... 201910175998.1

(51) Int. Cl.
*F23N 5/24* (2006.01)
*F23N 5/10* (2006.01)

(52) U.S. Cl.
CPC ..... *F23N 5/24* (2013.01); *F23N 5/10* (2013.01); *F23N 5/102* (2013.01); *F23N 2223/08* (2020.01); *F23N 2227/28* (2020.01); *F23N 2227/36* (2020.01); *F23N 2237/08* (2020.01)

(58) Field of Classification Search
CPC ... F23N 5/24; F23N 5/10; F23N 5/102; F23N 2223/08; F23N 2237/08; F23N 2227/28; F23N 2227/36
USPC ..... 431/255, 24, 74, 72; 700/274
See application file for complete search history.

(56) References Cited

FOREIGN PATENT DOCUMENTS

| | | |
|---|---|---|
| CN | 105135489 | 12/2015 |
| CN | 206017818 | 3/2017 |
| CN | 107559893 | 1/2018 |
| CN | 108151085 | 6/2018 |
| CN | 208058929 | 11/2018 |
| CN | 208536134 | 2/2019 |
| DE | 102016208357 | 11/2017 |
| EP | 1443635 | 8/2004 |

*Primary Examiner* — Avinash A Savani
(74) *Attorney, Agent, or Firm* — JCIP Global Inc.

(57) ABSTRACT

A dual-gas source gas control system with anti-gas source misconnection and a control circuit thereof belonging to the gas combustion technical field are provided. The disclosure solves unreasonable design and other problems in the related art. The dual-gas source gas control system with anti-gas source misconnection and the control circuit thereof includes a power-on circuit, connected in series with an external power supply and an igniter switch to form a loop, including a self-locking switch triode connected in series with the external power supply and a self-locking amplifying triode connected to a base electrode of the self-locking switch triode; an MCU control circuit, including an MCU control chip, wherein the power-on circuit is connected to a power input pin of the MCU control chip, one pin on the MCU control chip is configured to detect whether the power-on circuit is connected.

18 Claims, 27 Drawing Sheets

DUAL-GAS SOURCE GAS CONTROL SYSTEM WITH ANTI-GAS SOURCE MISCONNECTION AND CONTROL CIRCUIT THEREOF

CROSS-REFERENCE TO RELATED APPLICATION

This application claims the priority benefit of China application serial no. 201910175998.1, filed on Mar. 8, 2019. The entirety of the above-mentioned patent application is hereby incorporated by reference herein and made a part of this specification.

BACKGROUND

Technical Field

The disclosure relates to a gas combustion technical field, and in particular, relates to a dual-gas source gas control system with anti-gas source misconnection and a control circuit thereof.

Description of Related Art

With the diversification of energy in the global market, many countries are using both natural gas and liquefied petroleum gas. According to the difference between the calorific values and the pressure during use of these two types of gas: liquefied petroleum gas is a high calorific value gas, and the pressure during use is high, and natural gas is a low calorific value gas, and the pressure is low during use. Gas appliances that match two different energy sources are thus provided. In order to integrate resources and meet market demand, gas appliances are designed as dual gas control systems that can use natural gas as well as liquefied petroleum gas.

The operating principle of the existing dual gas source gas control system is provided as follows. After high calorific value gas is introduced into a high calorific value gas voltage regulator valve, the gas passes through a high calorific value gas voltage regulator valve for voltage stabilizing and enters a switch control valve. A knob of a switch control valve is pressed, so that the gas is inputted into a gas path conversion device from the switch control valve. At this moment, the gas path in the gas path conversion device is manually set as a high calorific value gas path. After passing through the high calorific value gas path inside the gas path conversion device, the gas is inputted to a high calorific value gas lighter first. The igniter is pressed, the high calorific value gas in the high calorific value gas lighter is ignited by an igniter needle, and the high calorific value gas burns a nearby thermocouple after being burned. The thermocouple continues to supply power to a solenoid valve in the switch control valve. After the solenoid valve in the switch control valve begins to function, the gas path leading to a high calorific value gas nozzle mouth in the switch control valve is opened. The knob of the switch control valve is rotated, and the gas is inputted into the high calorific value gas nozzle mouth in the gas path conversion device and is directly inputted into the main burner after passing though the high calorific value gas nozzle mouth. The high calorific value gas outputted from the burner of the main burner is ignited by pilot flame on the high calorific value gas lighter. The gas appliance begins to work normally at this moment. After low calorific value gas is introduced into a low calorific value gas voltage regulator valve, the gas passes through a low calorific value gas voltage regulator valve for voltage stabilizing and enters a switch control valve. A knob of a switch control valve is pressed, so that the gas is inputted into a gas path conversion device from the switch control valve. At this moment, the gas path in the gas path conversion device is manually set as a low calorific value gas path. After passing through the low calorific value gas path in the gas path conversion device, the gas is inputted to a low calorific value gas lighter first. The igniter is pressed, the low calorific value gas in the low calorific value gas lighter is ignited by an igniter needle, and the low calorific value gas burns a nearby thermocouple after being burned. The thermocouple continues to supply power to a solenoid valve in the switch control valve. After the solenoid valve in the switch control valve begins to function, the gas path leading to a low calorific value gas nozzle mouth in the switch control valve is opened. The knob of the switch control valve is rotated, and the gas is inputted into the low calorific value gas nozzle mouth in the gas path conversion device and is directly inputted into the main burner after passing though the low calorific value nozzle mouth. The low calorific value gas outputted from the burner of the main burner is ignited by pilot flame on the low calorific value gas lighter, and the gas appliance begins to work normally at this moment.

Since manual operation is required by gas connection and gas path configuration of a gas path conversion device, misconnection may happen. Since the calorific values and pressures of the two types of gas are different during use, when high calorific value gas enters the wrong gas operating channel, the risk of presence of a high flame appears, and safety and property of a user may thereby be threatened.

SUMMARY

A purpose of the disclosure is to provide a reasonably-designed control circuit for solving the problems of which high calorific value gas is misconnected to a low calorific value voltage regulator valve and enters a low calorific value gas lighter, and a solenoid valve in a switch control valve cannot be automatically closed instantly when the high calorific value gas simultaneously enters a first main gas nozzle mouth and a second main gas nozzle mouth in terms of the foregoing problems.

Another purpose of the disclosure is to provide a reasonably-designed dual-gas source gas control system with anti-gas source misconnection offering high degree of safety and security in terms of the foregoing problems.

Still another purpose of the disclosure is to provide another reasonably-designed dual-gas source gas control system with anti-gas source misconnection offering safety and security in terms of the foregoing problems.

To accomplish the foregoing purposes, the following technical solutions are adopted by the disclosure. A control circuit provided by the disclosure includes a power-on circuit, connected in series with an external power supply and an igniter switch to form a loop, including a self-locking switch triode connected in series with the external power supply and a self-locking amplifying triode connected to a base electrode of the self-locking switch triode; an MCU control circuit, including an MCU control chip, wherein the power-on circuit is connected to a power input pin of the MCU control chip, one pin on the MCU control chip is configured to detect whether the power-on circuit is connected, another pin on the MCU control chip is connected to a base electrode of the self-locking amplifying triode in the power-on circuit to be configured to send a driving signal to drive the self-locking amplification triode in the power-on circuit to be turned on when the power-on circuit is detected to be connected, so that the self-locking switch triode and the self-locking amplifying triode are turned on to form self-locking and maintain a power-on state; a pulse ignition circuit, including an oscillating loop powered by the power-on circuit, wherein the oscillating loop generates an inducted ignition high voltage and discharges to an outside through an external low calorific value gas ignition needle and a high calorific value gas ignition needle connected thereto, and one pin on the MCU control chip sends a control signal to control magnitude of an oscillating voltage of the oscillating loop; a gas misconnection flame detection circuit, including a comparator powered by the power-on circuit and configured for receiving a flame signal sent from an external flame sensor, wherein a voltage signal generated by the flame sensor is transmitted to one input pin of the comparator, the flame signal is outputted from an output pin of the comparator to a base electrode of a detection amplifying triode connected to the comparator, the flame signal passing through the detection amplifying triode is transmitted onto the MCU control chip through an input pin on the MCU control chip that is connected to the detection amplification triode and that is configured for receiving the flame signal, the flame sensor generates a negative voltage signal to the input pin configured for receiving the flame signal on the comparator when a high calorific value gas is misconnected to a low calorific value gas lighter, the output pin configured for outputting the flame signal on the comparator outputs a high electrical level to the base electrode of the detection amplifying triode, the detection amplifying triode transmits the amplified flame signal to the input pin configured for receiving the flame signal on the MCU control chip, after an output pin on the MCU control chip that is configured for sending a driving signal for driving a gas path to be cut off receives the flame signal indicating misconnection, the output pin sends the driving signal configured for driving the gas path to be cut off to an external corresponding gas path on/off control device, and a cutting off operation of a first solenoid valve in a switch control valve is controlled by the gas path on/off control device. The flame signal transmitted by the external flame sensor connected thereto is detected through the gas misconnection flame detection circuit and the signal is sent to the MCU control circuit. A driving signal configured for driving the gas path to be cut off to an external corresponding gas path on/off control device is sent from the MCU control circuit. In this way, when the high calorific value gas is misconnected to the low calorific value voltage regulator valve, enters the low calorific value gas lighter, and simultaneously enters the first main gas nozzle mouth and the second main gas nozzle mouth, safety and security are provided.

In the control circuit, the output pin on the MCU control chip configured for transmitting the driving signal for driving the gas path to be cut off is disposed on a wire of opposite polarity to the output pin in two wires connected an external thermocouple parallel circuit and the external first solenoid valve. The thermocouple parallel circuit is formed by a connection between an anode of a low calorific value gas thermocouple and an anode of a high calorific value gas thermocouple and a connection between a cathode of the low calorific value gas thermocouple and a cathode of the high calorific value gas thermocouple. When the input pin of the MCU control chip connected to the gas misconnection flame detection circuit detects that the high calorific value gas is misconnected to the low calorific value gas lighter, the output pin on the MCU control chip outputs a voltage of polarity opposite to an output voltage of the thermocouple parallel circuit, so that current balancing is instantly and forcibly performed to a thermoelectric potential generated by the fired low calorific value gas thermocouple or the voltage is set to zero. The thermoelectric potential which keeps the first solenoid valve on the switch control valve to be closed is lost, and the first solenoid valve is not closed to prevent external gas from entering the gas path of the system through the switch control valve. When the high calorific value gas is misconnected to the low calorific value voltage regulator valve, the first solenoid valve on the switch control valve may be set not to be closed to prevent external gas from entering, so that the purpose of safety, prevention, and control is achieved.

In the control circuit, a pair of anode and cathode power output pins configured for transmitting the driving signal for driving the gas path to be cut off on the MCU control chip is electrically connected to the external low calorific value gas lighter and a second solenoid valve in an on/off valve on a low calorific value ignition gas path between output ends corresponding to the low calorific value gas lighter on a gas path conversion valve through a motor control driver chip. When the input pin connected to the gas misconnection flame detection circuit on the MCU control chip detects that the high calorific value gas is misconnected to the low calorific value gas lighter, the pair of anode and cathode power output pins transmits the driving signal for driving the gas path to be cut off, so that the second solenoid valve which is being closed on the on/off valve is detached instantly to close the low calorific value ignition gas path.

A gas flame is reduced until being put out without burning the low calorific value gas thermocouple, such that the low calorific value gas thermocouple cannot continuously supply power to the first solenoid valve in the switch control valve. The first solenoid valve in the switch control valve which does not receive power supply is not closed to prevent external gas from entering the gas path in the system through the switch control valve. When the high calorific value gas is misconnected to the low calorific value voltage regulator valve, a switching off signal is outputted to the second solenoid valve on the on/off valve connected to the MCU control circuit through the MCU control circuit, so that the second solenoid valve in a closed state is instantly opened. The flame of the low calorific value gas lighter may thus be extinguished since no low calorific value gas is continuously supplied. The thermocouple no longer generates a thermoelectric potential since no flame is sensed and thus may not provide electricity energy to the first solenoid valve connected thereto on the switch control valve. In this way, the first solenoid valve is not closed to prevent external gas from entering the gas path.

The control circuit further includes a boost circuit connected to the power-on circuit and including a boost chip and an inductor. A power output pin of the boost chip transmits a boosted voltage to any one or a plurality of the MCU control circuit, the pulse ignition circuit and the gas misconnection flame detection circuit. Arrangement of the booster circuit improves the voltage supply capability to other circuits in the control circuit.

In the control circuit, an alarm circuit including a buzzer and an alarm amplifying triode is also included, and a base electrode of the alarm amplifying triode receives an alarm signal sent from an output pin on the MCU control chip. Arrangement of the alarm circuit enables a user to obtain alarm information immediately, and total gas paths may be closed through a knob on the switch control valve through manual operation.

In the control circuit, an electronically controlled conversion valve control circuit is also provided and includes a first valve driving chip configured for driving a main gas channel switching solenoid valve in an external electronically controlled gas path conversion valve, and a second valve driving chip configured for controlling and driving an ignition gas channel switching solenoid valve in the external electronically controlled gas path conversion valve. The first valve driving chip and the second valve driving chip respectively receive valve control information sent from the MCU control chip. Two pins in the MCU control chip are respectively connected in series with a low calorific value voltage regulator switching switch in an external low calorific value voltage regulator valve and a high calorific value voltage regulator switching switch in a high calorific value voltage regulator valve. When receiving information on the low calorific value voltage regulator switching switch or the high calorific value voltage regulator switching switch being in a closed state, the MCU control chip sends the corresponding valve control information to the first valve driving chip and the second valve driving chip.

A dual-gas source gas control system with anti-gas source misconnection includes a low calorific value voltage regulator valve and a high calorific value voltage regulator valve. An input end and an output end of the low calorific value voltage regulator valve are respectively connected to a low calorific value gas path configured for transmitting a low calorific gas source, and an input end and an output end of the high calorific value voltage regulator valve are respectively connected to a high calorific value gas path configured for transmitting a high calorific gas source. A switch control valve acts as a master switch configured for controlling a gas path to be cut off, is provided with a first solenoid valve configured for controlling the switch control valve to be turned on or turned off, and includes two input ends, wherein one of the input ends is connected to the low calorific value voltage regulator valve through the low calorific value gas path, and the other one of the input ends is connected the high calorific value voltage regulator valve through the high calorific value gas path, and further includes two output ends respectively connected to a main gas path and an ignition gas path one by one. A gas path conversion valve includes two input ends, wherein one of the input ends is connected to the output end of the switch control valve communicating with the main gas path, and the other one of the input ends is connected to the output end of the switch control valve communicating with the ignition gas path, and further includes four output ends, wherein the four output ends are respectively communicated with a low calorific value ignition gas path leading to a low calorific value gas ignition device, a high calorific value ignition gas path leading to a high calorific value gas ignition device, and a first main gas nozzle mouth and a second main gas nozzle mouth leading to a main burner one by one, further including a high calorific value gas internal path, a low calorific value gas internal path, and a knob or a switch configured for switching between the high calorific value gas internal path and the low calorific value gas internal path, wherein the low calorific value gas internal path is respectively communicated with low calorific value ignition gas path, the first main gas nozzle mouth, and a second main gas nozzle mouth, and the high calorific value gas internal path is respectively communicated with the high calorific value ignition gas path and the first main gas nozzle mouth. The main burner, wherein an input end thereof are disposed corresponding to the first main gas nozzle mouth and the second main gas nozzle mouth on the gas path conversion valve, so that gas emitted from the first main gas nozzle mouth and the second main gas nozzle mouth directly enters the input end of the main burner, and a burner opening required by high calorific value gas and low calorific value gas to burn normally is disposed at an outer side of the main burner. The low calorific value gas ignition device includes a low calorific value gas lighter near the burner opening required for burning of the low calorific value gas on the main burner and a low calorific value gas ignition needle and a low calorific value gas thermocouple disposed adjacent to the low calorific value gas lighter, wherein the low calorific value gas lighter is connected to a corresponding output end on the gas path conversion valve through the low calorific value ignition gas path. The high calorific value gas ignition device includes a high calorific value gas lighter near the burner opening required for burning of the high calorific value gas on the main burner and a high calorific value gas ignition needle and a high calorific value gas thermocouple disposed adjacent to the high calorific value gas lighter, wherein the high calorific value gas lighter is connected to a corresponding output end on the gas path conversion valve through the high calorific value ignition gas path; an igniter, electrically connected to the low calorific value gas ignition needle and the high calorific value gas ignition needle respectively. The system further includes a flame sensor disposed at one side near the low calorific value gas thermocouple and away from the low calorific value gas lighter, and configured for detecting a flame signal. The igniter is provided with a power supply and an error-proof control circuit electrically connected thereto, the error-proof control circuit is the control circuit electrically connected to the flame sensor, after an igniter switch on the igniter is pressed, electricity is transmitted to the connected control circuit, and the control circuit begins to function and receive the flame signal sent from the flame sensor; wherein an anode of the low calorific value gas thermocouple is connected to an anode of the high calorific value gas thermocouple, a cathode of the low calorific value gas thermocouple and a cathode of the high calorific value gas thermocouple are connected to form a thermocouple parallel circuit, an anode and a cathode of the thermocouple parallel circuit are electrically connected to an anode and a cathode of the first solenoid valve respectively one by one, one output end of the control circuit is disposed on one wire of opposite polarity to the output end in two wires connecting the thermocouple parallel circuit and the first solenoid valve, when the control circuit detects the flame signal from the flame sensor indicating that the high calorific value gas is misconnected to the low calorific value gas lighter, the output end outputs a voltage of opposite polarity to an output voltage outputted by the thermocouple parallel circuit, so that current balancing is instantly and forcibly performed to a thermoelectric potential generated by the fired low calorific value gas thermocouple or the voltage is set to zero, the first solenoid valve in the switch control valve without receiving power supply is not closed to prevent external gas from entering the gas path in the system through the switch control valve. When the high calorific value gas is misconnected to the low calorific value voltage regulator valve, a voltage of opposite polarity to an output voltage of the thermocouple parallel circuit is outputted through the control circuit, so that current balancing is instantly and forcibly performed to a thermoelectric potential generated by the fired low calorific value gas thermocouple or the voltage is set to zero to prevent external gas from entering.

In the dual-gas source gas control system with anti-gas source misconnection, an over voltage protection device is disposed on the low calorific value ignition gas path between the output ends corresponding to the low calorific value gas lighter on the low calorific value gas lighter and the gas path conversion valve. When the high calorific value gas is mistakenly introduced to the low calorific value gas lighter after passing through the high calorific value voltage regulator valve, or when the low calorific value gas is mistakenly passes through the high calorific value gas voltage regulator valve and is introduced to the low calorific value gas lighter, since the pressure of the gas in the low calorific value ignition gas path exceeds a pressure preset by the over voltage protection device, the over voltage protection device automatically closes the gas path at this moment.

In the dual-gas source gas control system with anti-gas source misconnection, the gas path conversion valve is a manual gas path conversion valve and includes a valve body, wherein an outer periphery of the valve body is provided with an internally-communicated low calorific value gas lighter outlet, a high calorific value gas lighter outlet, a gas lighter gas path inlet, and a main inlet; a spool is provided and is disposed in the valve body, a connection groove is disposed on an outer periphery of the spool, the spool rotates so that the connection groove is communicated with the low calorific value gas lighter outlet and the gas lighter gas path inlet or is communicated with the high calorific value gas lighter outlet and the gas lighter gas path inlet; a valve seat is provided and is disposed on an upper end of the valve body, a valve rod is slidably inserted into the valve seat, an upper end of the valve rod exposes out of the valve seat, a lower end of the valve rod is loosely connected to the other end of a connection rotation shaft with one end disposed on the spool, the connection rotation shaft is sleeved with a reset spring for resetting the valve rod after operation. The gas path conversion valve further includes a double gas nozzle communicated with the main inlet and disposed at an lower end of the valve body, a circle-shaped barrier is protruded at an inner side of the double gas nozzle, at least one in-circle nozzle mouth merely for the low calorific value gas to be emitted is provided in the circle-shaped barrier on the double gas nozzle, at least one outer nozzle mouth for the low calorific value gas or the high calorific value gas to be emitted is disposed between an outer periphery of the double gas nozzle and the circle-shaped barrier, the first main gas nozzle mouth is the outer nozzle mouth, and the second main gas nozzle mouth is the in-circle nozzle mouth, an inner gas transfer chamber for merely the low calorific value gas to enter and an outer gas transfer chamber surrounding an outer periphery of the inner gas transfer chamber for the low calorific value gas or the high calorific value gas to enter are respectively formed when the double gas nozzle and the valve body are connected, the inner gas transfer chamber is communicated with the in-circle nozzle mouth, and the outer gas transfer chamber is communicated with the outer nozzle mouth; a spool through hole assembly is disposed on the spool, two ends of the spool through hole assembly are respectively communicated with the inner gas transfer chamber and a low gas transfer channel communicated with the main inlet and disposed on the valve body in a sealed manner, and the low calorific value gas is introduced in or the high calorific value gas is prevented from entering the inner gas transfer chamber through rotation of the spool, so that an effective gas-intake cross-sectional area corresponding to requirement from the high and low calorific value gas on the double gas nozzle is adjusted.

In the dual-gas source gas control system with anti-gas source misconnection, wherein the spool through hole assembly includes a first spool hole axially disposed near an end of the double gas nozzle on the spool, the first spool hole is communicated with the inner gas transfer chamber in a sealed manner, a second spool hole communicating with the first spool hole is disposed at an outer side of the spool, the second spool hole is communicated with the low gas transfer channel in a sealed manner; the spool is tapered, the spool matches a size and a shape of a space in the valve body accommodating the spool, a low calorific value gas limitation groove and a high calorific value gas limitation groove are disposed in the valve seat in a high and low manner and in a misaligned arrangement, a boss is disposed on the valve rod, the valve rod downwardly moves so that the valve rod passes the connection rotation shaft to drive the spool to rotate to switch the ignition device gas paths between the high and low calorific value gas, the boss is engaged in a corresponding limitation groove so that the valve rod is positioned; the connection groove has a sector structure with an angle of 180 degrees, the low calorific value gas lighter outlet and the gas lighter gas path inlet are located on a same center line, a center line of the high calorific value gas lighter outlet and a center line of the low calorific value gas lighter outlet are in a same plane; a damper regulation structure for regulating gas intake in a gas main tube is disposed between an outer end of the double gas nozzle and the gas main tube connected to an outer portion of the main burner, and one end of the damper regulation structure is connected to an outer end of the valve rod.

In the dual-gas source gas control system with anti-gas source misconnection, wherein a first connection short tube is disposed between the circle-shaped barrier and the valve body in a sealed manner for transferring the low calorific value gas; the double gas nozzle and the circle-shaped barrier are integrally connected in one piece; the damper regulation structure includes a second connection short tube disposed between the main burner and the external gas main tube in a sealed manner, a first damper for air to enter is disposed at one side of the second connection short tube, a rotation barrel having a size and a shape matched with that of the second connection short tube is disposed at an outer periphery of the second connection short tube, a second damper corresponding to the first damper is disposed on the rotation barrel, a damper linking rod capable of driving the rotation barrel and the valve rod to simultaneously rotate is disposed between the rotation barrel and the valve rod; at least a pair of axial limitation ribs for limiting the rotation barrel to move in an axial direction of the second connection short tube protrudes from an outer side of the second connection short tube; connection between the damper linking rod and the rotation barrel and connection between the damper linking rod and the valve rod are detachable; a knob is disposed at an outer end of the valve rod, and the knob is connected to the damper linking rod.

In the dual-gas source gas control system with anti-gas source misconnection, wherein the gas path conversion valve is an electronically controlled gas path conversion valve and includes a main gas channel switching solenoid valve respectively communicated with one input end communicating with the main gas path, one output end communicating with the first main gas nozzle mouth, and one output end communicating with the second main gas nozzle mouth, whether gas introduced from the input end is simultaneously introduced to the two output ends or is only introduced to one output end communicating with the first main gas nozzle mouth is determined according to a gas calorific value, an ignition gas channel switching solenoid valve is further provided and is communicated with one input end communicating with the ignition gas path, one output end communicating with the low calorific value ignition gas path, and one output end communicating with the high calorific value ignition gas path, whether gas introduced from the input end is introduced to one output end communicating with the low calorific value ignition gas path or is introduced to one output end communicating with the high calorific value ignition gas path is determined according to a gas calorific value; each of the low calorific value voltage regulator valve and the high calorific value voltage regulator valve is a switch voltage regulator valve for switching, the low calorific value voltage regulator valve includes a low calorific value voltage regulator switching switch, and the high calorific value voltage regulator valve includes a high calorific value voltage regulator switching switch.

Another dual-gas source gas control system with anti-gas source misconnection includes a low calorific value voltage regulator valve and a high calorific value voltage regulator valve. An input end and an output end of the low calorific value voltage regulator valve are respectively connected to a low calorific value gas path configured for transmitting a low calorific gas source, and an input end and an output end of the high calorific value voltage regulator valve are respectively connected to a high calorific value gas path configured for transmitting a high calorific gas source; a switch control valve, acting as a master switch configured for controlling a gas path to be cut off, provided with a first solenoid valve configured for controlling the switch control valve to be turned on or turned off, including two input ends, wherein one of the input ends is connected to the low calorific value voltage regulator valve through the low calorific value gas path, and the other one of the input ends is connected the high calorific value voltage regulator valve through the high calorific value gas path, and further includes two output ends, respectively connected to a main gas path and an ignition gas path one by one. A gas path conversion valve includes two input ends, wherein one of the input ends is connected to the output end of the switch control valve communicating with the main gas path, and the other one of the input ends is connected to the output end of the switch control valve communicating with the ignition gas path, and further includes four output ends, wherein the four output ends are respectively communicated with a low calorific value ignition gas path leading to a low calorific value gas ignition device, a high calorific value ignition gas path leading to a high calorific value gas ignition device, and a first main gas nozzle mouth and a second main gas nozzle mouth leading to a main burner one by one, and further includes a high calorific value gas internal path, a low calorific value gas internal path and a knob or a switch configured for switching between the high calorific value gas internal path and the low calorific value gas internal path, wherein the low calorific value gas internal path is respectively communicated with low calorific value ignition gas path, the first main gas nozzle mouth, and a second main gas nozzle mouth, and the high calorific value gas internal path is respectively communicated with the high calorific value ignition gas path and the first main gas nozzle mouth. The main burner, wherein an input end thereof are disposed corresponding to the first main gas nozzle mouth and the second main gas nozzle mouth on the gas path conversion valve, so that gas emitted from the first main gas nozzle mouth and the second main gas nozzle mouth directly enters the input end of the main burner, and a burner opening required by high calorific value gas and low calorific value gas to burn normally is disposed at an outer side of the main burner. The low calorific value gas ignition device, including a low calorific value gas lighter near the burner opening required for burning of the low calorific value gas on the main burner, a low calorific value gas ignition needle and a low calorific value gas thermocouple disposed adjacent to the low calorific value gas lighter, wherein the low calorific value gas lighter is connected to a corresponding output end on the gas path conversion valve through the low calorific value ignition gas path; the high calorific value gas ignition device includes a high calorific value gas lighter near the burner opening required for burning of the high calorific value gas on the main burner and a high calorific value gas ignition needle and a high calorific value gas thermocouple disposed adjacent to the high calorific value gas lighter, wherein the high calorific value gas lighter is connected to a corresponding output end on the gas path conversion valve through the high calorific value ignition gas path. An igniter is electrically connected to the low calorific value gas ignition needle and the high calorific value gas ignition needle respectively. The system further includes a flame sensor disposed at one side near the low calorific value gas thermocouple and away from the low calorific value gas lighter, and configured for detecting a flame signal; wherein the igniter further includes a power supply and an error-proof control circuit electrically connected thereto, the error-proof control circuit is the control circuit electrically connected to the flame sensor, after an igniter switch on the igniter is pressed, electricity provided by the power supply is transmitted to the connected control circuit, and the control circuit begins to function and receive the flame signal sent from the flame sensor; wherein an anode of the low calorific value gas thermocouple is connected to an anode of the high calorific value gas thermocouple, a cathode of the low calorific value gas thermocouple and a cathode of the high calorific value gas thermocouple are connected to form a thermocouple parallel circuit, an anode and a cathode of the thermocouple parallel circuit are electrically connected to an anode and a cathode of the first solenoid valve respectively one by one, the low calorific value gas thermocouple generates an electric potential after being burned by ignited gas, so as to continuously supply power to the first solenoid valve in the switch control valve, so that the first solenoid valve stays in a closed state and the gas path is in a turned on state; an on/off valve disposed on the low calorific value ignition gas path between output ends corresponding to the low calorific value gas lighter on the low calorific value gas lighter and the gas path conversion valve, including a second solenoid valve configured for controlling connection and cutting off of the low calorific value ignition gas path, wherein an anode and a cathode of the second solenoid valve are electrically connected to an anode output level and a cathode output level on the control circuit one by one, when the control circuit detects the flame signal from the flame sensor indicating that the high calorific value gas is misconnected to the low calorific value gas lighter, electrical levels outputted from the anode output level and the cathode output level are both zero, the second solenoid valve on the on/off valve is not closed to prevent gas in the low calorific value ignition gas path from entering the low calorific value gas lighter, a gas flame is reduced until being put out without burning the low calorific value gas thermocouple, such that the low calorific value gas thermocouple cannot continuously supply power to the first solenoid valve in the switch control valve, and the first solenoid valve in the switch control valve without receiving power supply on the switch control valve is not closed to prevent external gas from entering the gas path in the system through the switch control valve.

In the another dual-gas source gas control system with anti-gas source misconnection, wherein an over voltage protection device is disposed on the low calorific value ignition gas path between the output ends corresponding to the low calorific value gas lighter on the low calorific value gas lighter and the gas path conversion valve. When the high calorific value gas is mistakenly introduced to the low calorific value gas lighter after passing through the high calorific value voltage regulator valve, or when the low calorific value gas is mistakenly passes through the high calorific value gas voltage regulator valve and is introduced to the low calorific value gas lighter, since the pressure of the gas in the low calorific value ignition gas path exceeds a pressure preset by the over voltage protection device, the over voltage protection device automatically closes the gas path at this moment.

In the another dual-gas source gas control system with anti-gas source misconnection, wherein the gas path conversion valve is a manual gas path conversion valve and includes a valve body, an outer periphery of the valve body is provided with an internally-communicated low calorific value gas lighter outlet, a high calorific value gas lighter outlet, a gas lighter gas path inlet, and a main inlet; a spool is provided and is disposed in the valve body, a connection groove is disposed on an outer periphery thereof, the spool rotates so that the connection groove is communicated with the low calorific value gas lighter outlet and the gas lighter gas path inlet or is communicated with the high calorific value gas lighter outlet and the gas lighter gas path inlet; a valve seat is provided and is disposed on an upper end of the valve body, a valve rod is slidably inserted into the valve seat, an upper end of the valve rod exposes out of the valve seat, a lower end of the valve rod is loosely connected to the other end of a connection rotation shaft with one end disposed on the spool, the connection rotation shaft is sleeved with a reset spring for resetting the valve rod after operation. The gas path conversion valve further includes a double gas nozzle communicated with the main inlet and disposed at an lower end of the valve body, a circle-shaped barrier is protruded at an inner side of the double gas nozzle, at least one in-circle nozzle mouth for the low calorific value gas to be emitted is provided in the circle-shaped barrier on the double gas nozzle, at least one outer nozzle mouth for the low calorific value gas or the high calorific value gas to be emitted is disposed between an outer periphery of the double gas nozzle and the circle-shaped barrier, the first main gas nozzle mouth is the outer nozzle mouth), and the second main gas nozzle mouth is the in-circle nozzle mouth, an inner gas transfer chamber for merely the low calorific value gas to enter and an outer gas transfer chamber surrounding an outer periphery of the inner gas transfer chamber for the low calorific value gas or the high calorific value gas to enter are respectively formed when the double gas nozzle and the valve body are connected, the inner gas transfer chamber is communicated with the in-circle nozzle mouth, and the outer gas transfer chamber is communicated with the outer nozzle mouth; a spool through hole assembly is disposed on the spool, two ends of the spool through hole assembly are respectively communicated with the inner gas transfer chamber and a low gas transfer channel connected to the main inlet and disposed on the valve body in a sealed manner, and the low calorific value gas is introduced in or the high calorific value gas is prevented from entering the inner gas transfer chamber through rotation of the spool, so that an effective gas-intake cross-sectional area corresponding to requirement from the high and low calorific value gas on the double gas nozzle is adjusted.

In the another dual-gas source gas control system with anti-gas source misconnection, wherein the spool through hole assembly includes a first spool hole axially disposed near an end of the double gas nozzle on the spool, the first spool hole is communicated with the inner gas transfer chamber in a sealed manner, a second spool hole communicated with the first spool hole is disposed at an outer side of the spool, the second spool hole is communicated with the low gas transfer channel in a sealed manner; the spool is tapered, the spool matches a size and a shape of a space in the valve body accommodating the spool, a low calorific value gas limitation groove and a high calorific value gas limitation groove are disposed in the valve seat in a high and low manner and in a misaligned arrangement, a boss is disposed on the valve rod, the valve rod downwardly moves so that the valve rod passes the connection rotation shaft to drive the spool to rotate to switch the ignition device gas paths between the high and low calorific value gas, the boss is engaged in a corresponding limitation groove so that the valve rod is positioned; the connection groove has a sector structure with an angle of 180 degrees, the low calorific value gas lighter outlet and the gas lighter gas path inlet are located on a same center line, a center line of the high calorific value gas lighter outlet and a center line of the low calorific value gas lighter outlet are in a same plane; a damper regulation structure is disposed between an outer end of the double gas nozzle and a gas main tube connected to an outer portion of the main burner for regulating gas intake in the gas main tube, and one end of the damper regulation structure is connected to an outer end of the valve rod.

In the another dual-gas source gas control system with anti-gas source misconnection, wherein a first connection short tube is disposed between the circle-shaped barrier and the valve body in a sealed manner for transferring the low calorific value gas; the double gas nozzle and the circle-shaped barrier are integrally connected in one piece; the damper regulation structure includes a second connection short tube disposed between the main burner and the external gas main tube in a sealed manner, a first damper for air to enter is disposed at one side of the second connection short tube, a rotation barrel having a size and a shape matched with that of the second connection short tube is disposed at an outer periphery of the second connection short tube, a second damper corresponding to the first damper is disposed on the rotation barrel, a damper linking rod capable of driving the rotation barrel and the valve rod to simultaneously rotate is disposed between the rotation barrel and the valve rod; at least a pair of axial limitation ribs for limiting the rotation barrel to move in an axial direction of the second connection short tube protrudes from an outer side of the second connection short tube; connection between the damper linking rod and the rotation barrel and connection between the damper linking rod and the valve rod are detachable; a knob is disposed at an outer end of the valve rod, and the knob is connected to the damper linking rods.

In the another dual-gas source gas control system with anti-gas source misconnection, wherein the gas path conversion valve is an electronically controlled gas path conversion valve and includes a main gas channel switching solenoid valve respectively communicated with one input end communicating with the main gas path, one output end communicating with the first main gas nozzle mouth, and one output end communicating with the second main gas nozzle mouth, whether gas introduced from the input end is simultaneously introduced to the two output ends or is only introduced to one output end communicating with the first main gas nozzle mouth is determined according to a gas calorific value, an ignition gas channel switching solenoid valve is further provided and is communicated with one input end communicating with the ignition gas path, one output end communicating with the low calorific value ignition gas path, and one output end communicating with the high calorific value ignition gas path, whether gas introduced from the input end is introduced to one output end communicating with the low calorific value ignition gas path or is introduced to one output end communicating with the high calorific value ignition gas path is determined according to a gas calorific value; each of the low calorific value voltage regulator valve and the high calorific value voltage regulator valve is a switch voltage regulator valve for switching, the low calorific value voltage regulator valve includes a low calorific value voltage regulator switching switch, and the high calorific value voltage regulator valve includes a high calorific value voltage regulator switching switch.

Compared to the related art, advantages of the dual-gas source gas control system with anti-gas source misconnection and the control circuit thereof lie in that: when the high calorific value gas is misconnected to the low calorific value voltage regulator valve, a voltage of opposite polarity to an output voltage of the thermocouple parallel circuit is outputted through the control circuit, so that current balancing is instantly and forcibly performed to a thermoelectric potential generated by the fired low calorific value gas thermocouple or the voltage is set to zero, alternatively, the second solenoid valve which is being closed on the on/off valve is controlled to be detached through the control circuit, so that the total gas paths are closed. An over voltage protection device is provided, so when the high calorific value gas is mistakenly introduced to the low calorific value gas lighter after passing through the high calorific value voltage regulator valve, or when the low calorific value gas is mistakenly passes through the high calorific value gas voltage regulator valve and is introduced to the low calorific value gas lighter, since the pressure of the gas in the low calorific value ignition gas path exceeds a pressure preset by the over voltage protection device, the over voltage protection device automatically closes the gas path at this moment, and safety, protection, and control are achieved.

BRIEF DESCRIPTION OF THE DRAWINGS

To make the technical solutions provided in the embodiments of the disclosure or in the related art more clearly illustrated, several accompanying drawings required by the embodiments or the related art for description are briefly introduced as follows. Obviously, the drawings in the following description are only some embodiments of the disclosure. For a person of ordinary skill in the art, other drawings can be obtained according to these drawings without paying any creative labor.

Figure 1:
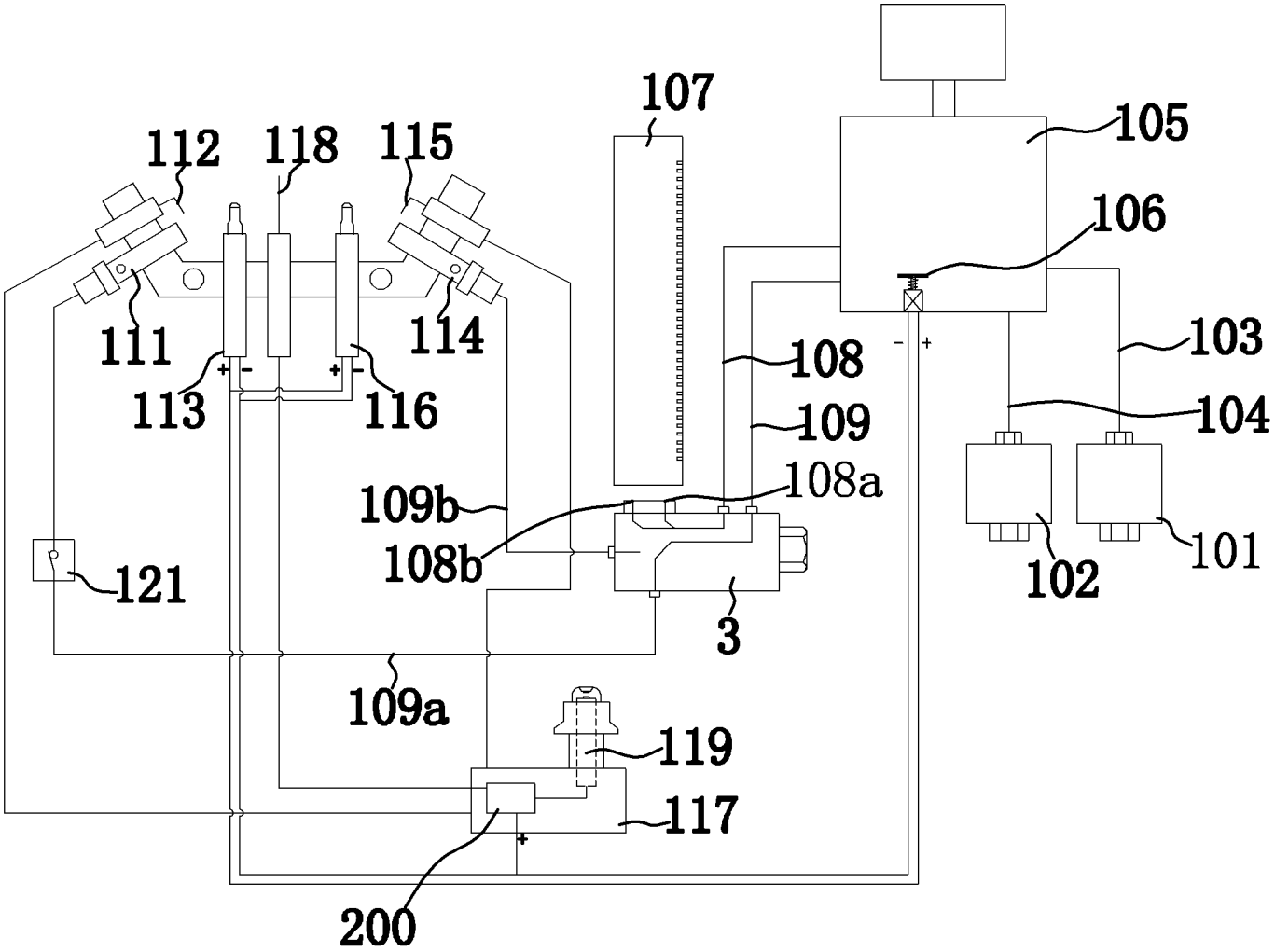
FIG. 1 provides a schematic diagram of a structure and connection in a gas control system when a gas path conversion valve is manually operated according to an embodiment of the disclosure.
Figure 2:
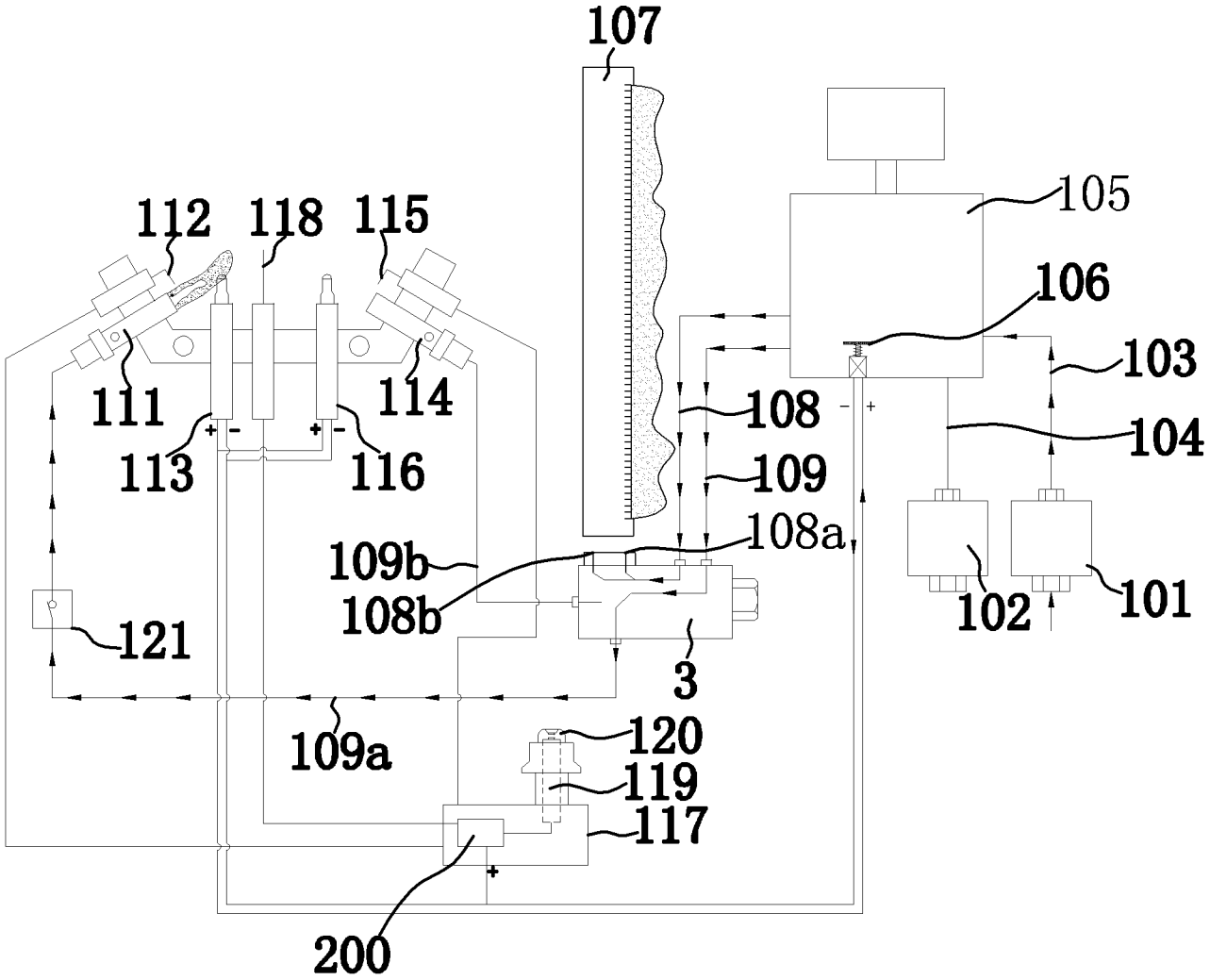
FIG. 2 provides a diagram of an operating principle of low calorific value gas in the gas control system when the gas path conversion valve is manually operated according to an embodiment of the disclosure.
Figure 3:
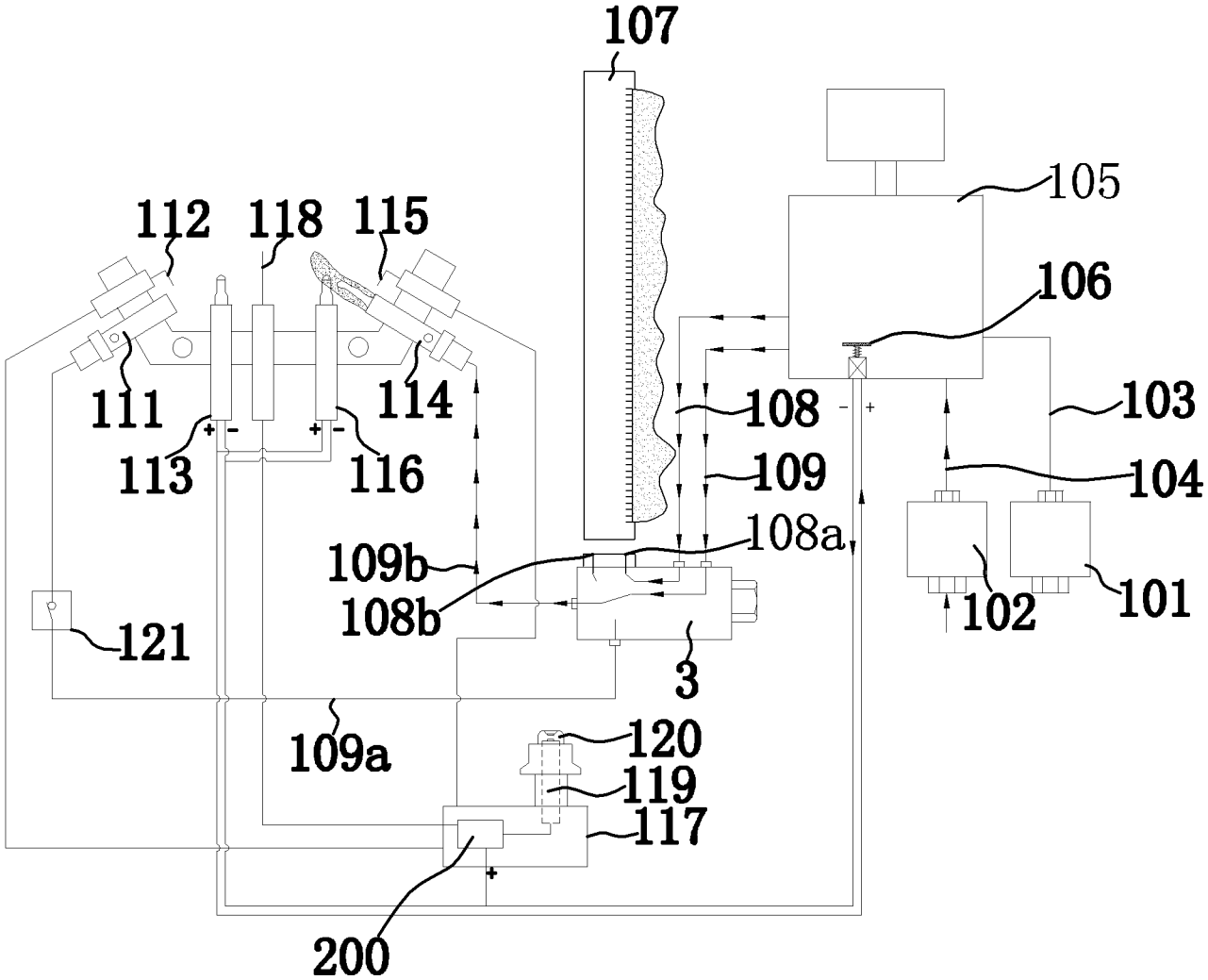
FIG. 3 provides a diagram of an operating principle of high calorific value gas in the gas control system when the gas path conversion valve is manually operated according to an embodiment of the disclosure.
Figure 4:
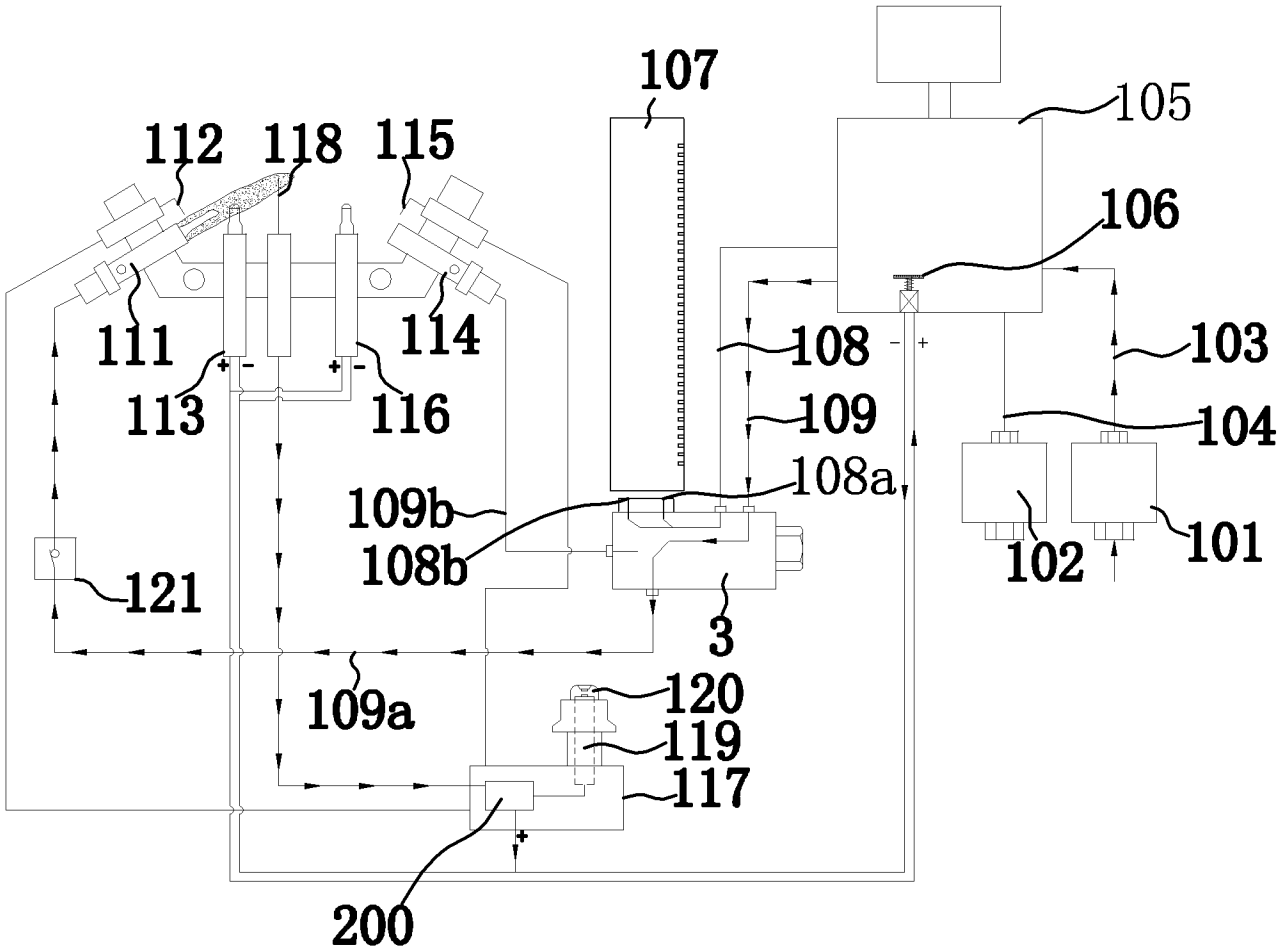
FIG. 4 provides a diagram of an operating principle of a first misconnection type in the gas control system when the gas path conversion valve is manually operated according to an embodiment of the disclosure.
Figure 5:
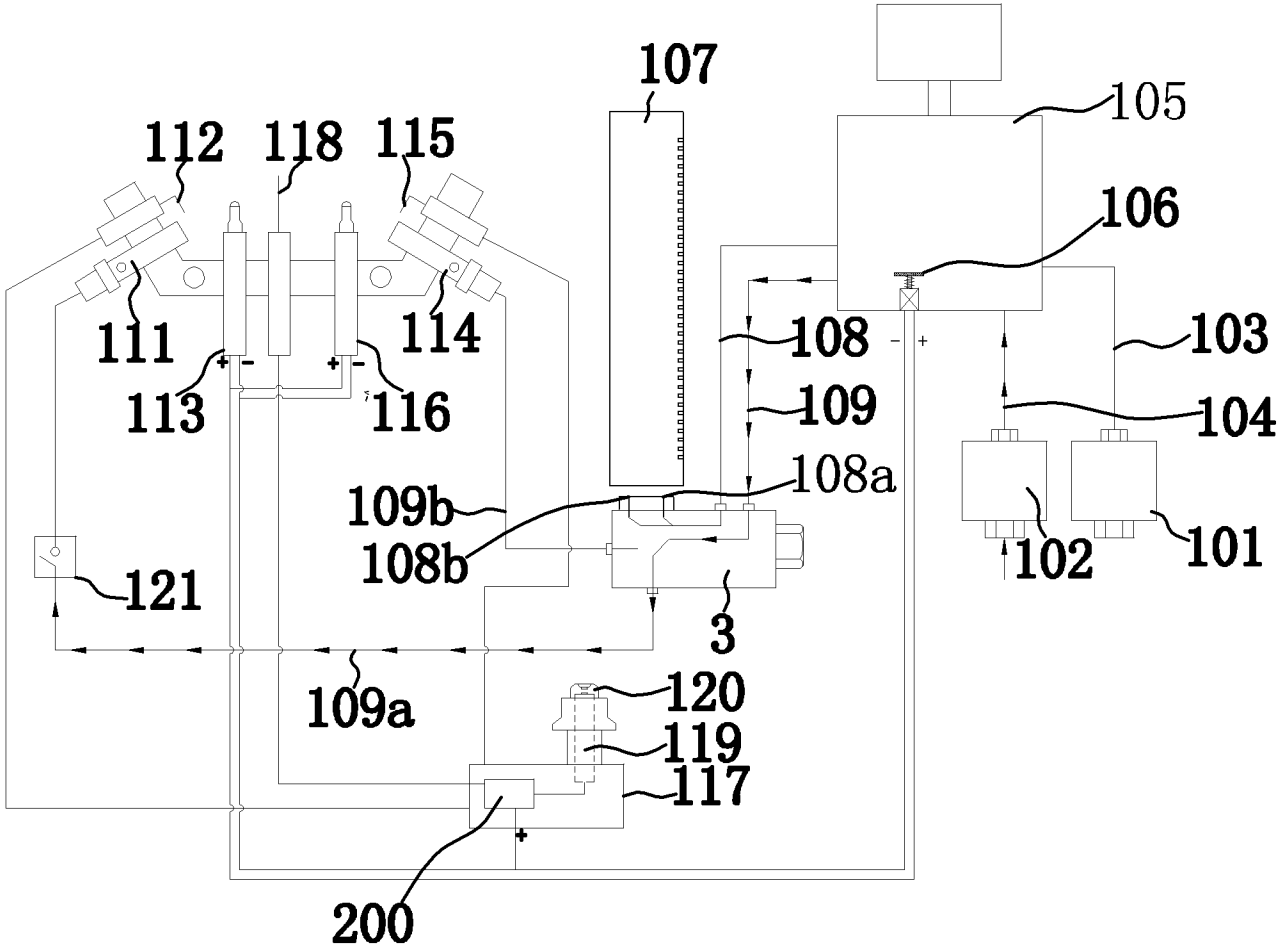
FIG. 5 provides a diagram of an operating principle of a second and a third misconnection types in the gas control system when the gas path conversion valve is manually operated according to an embodiment of the disclosure.
Figure 6:
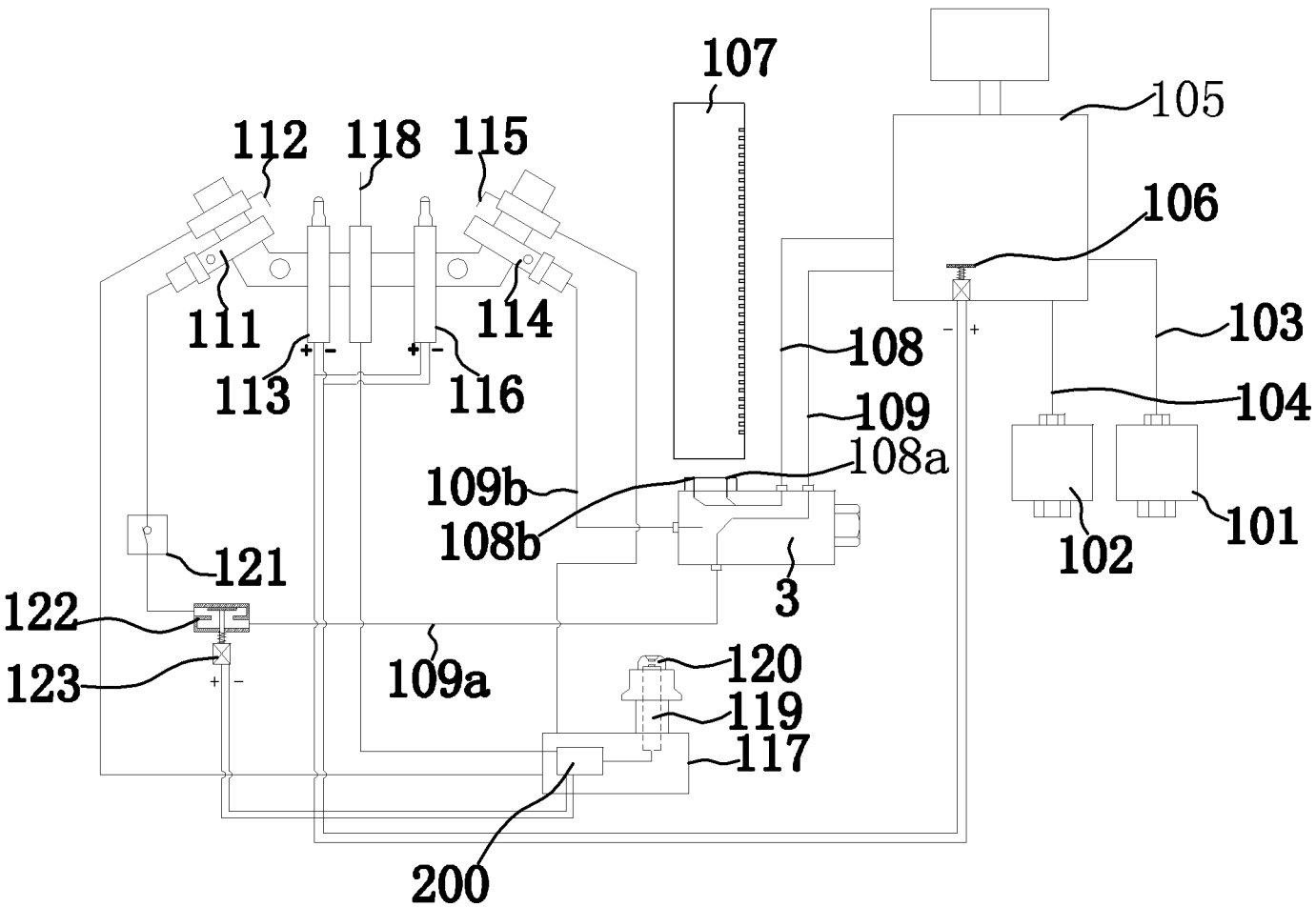
FIG. 6 provides a schematic diagram of a structure and connection in another gas control system when a gas path conversion valve is manually operated according to an embodiment of the disclosure.
Figure 7:
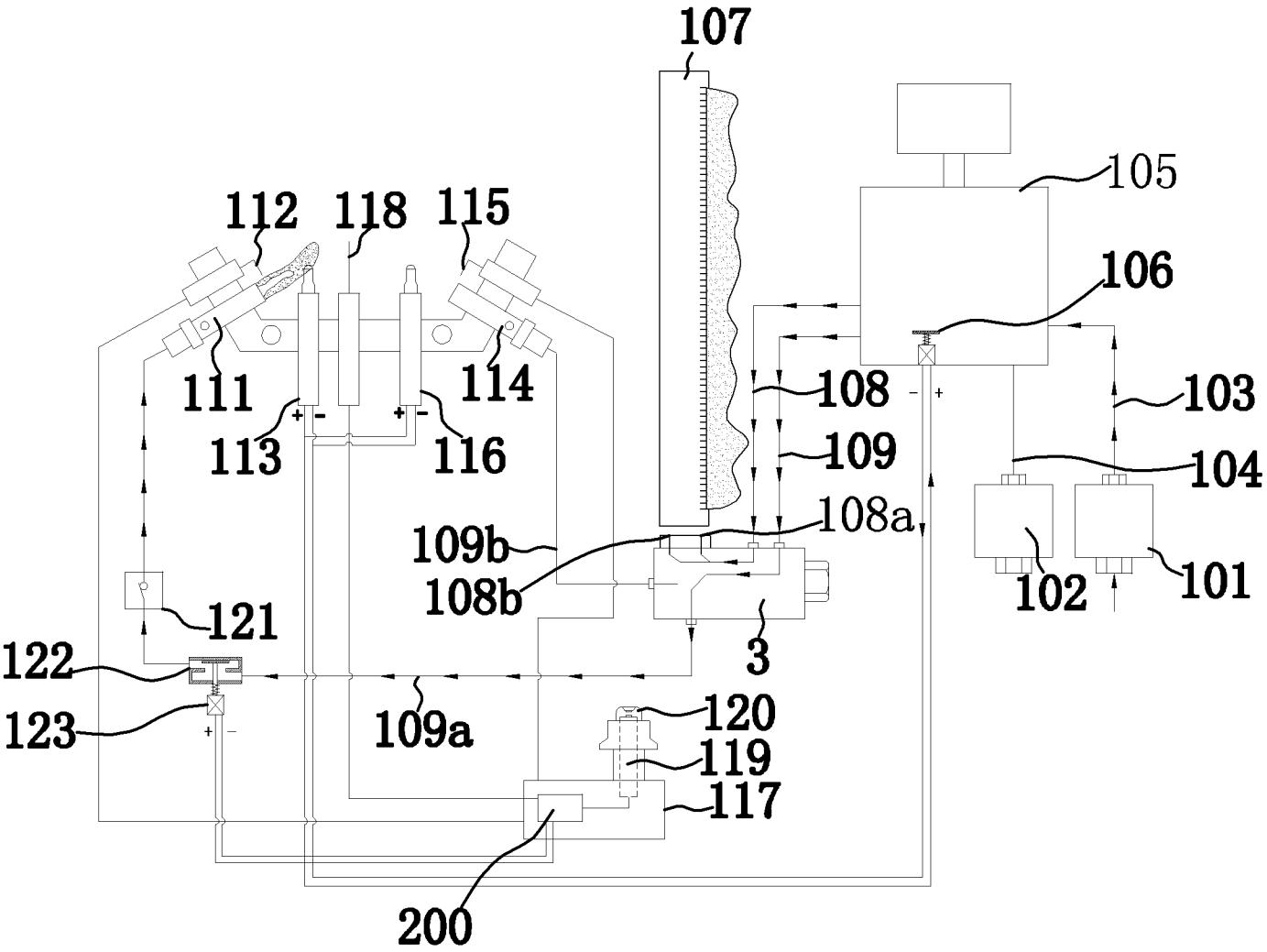
FIG. 7 provides a diagram of an operating principle of low calorific value gas in the another gas control system when the gas path conversion valve is manually operated according to an embodiment of the disclosure.
Figure 8:
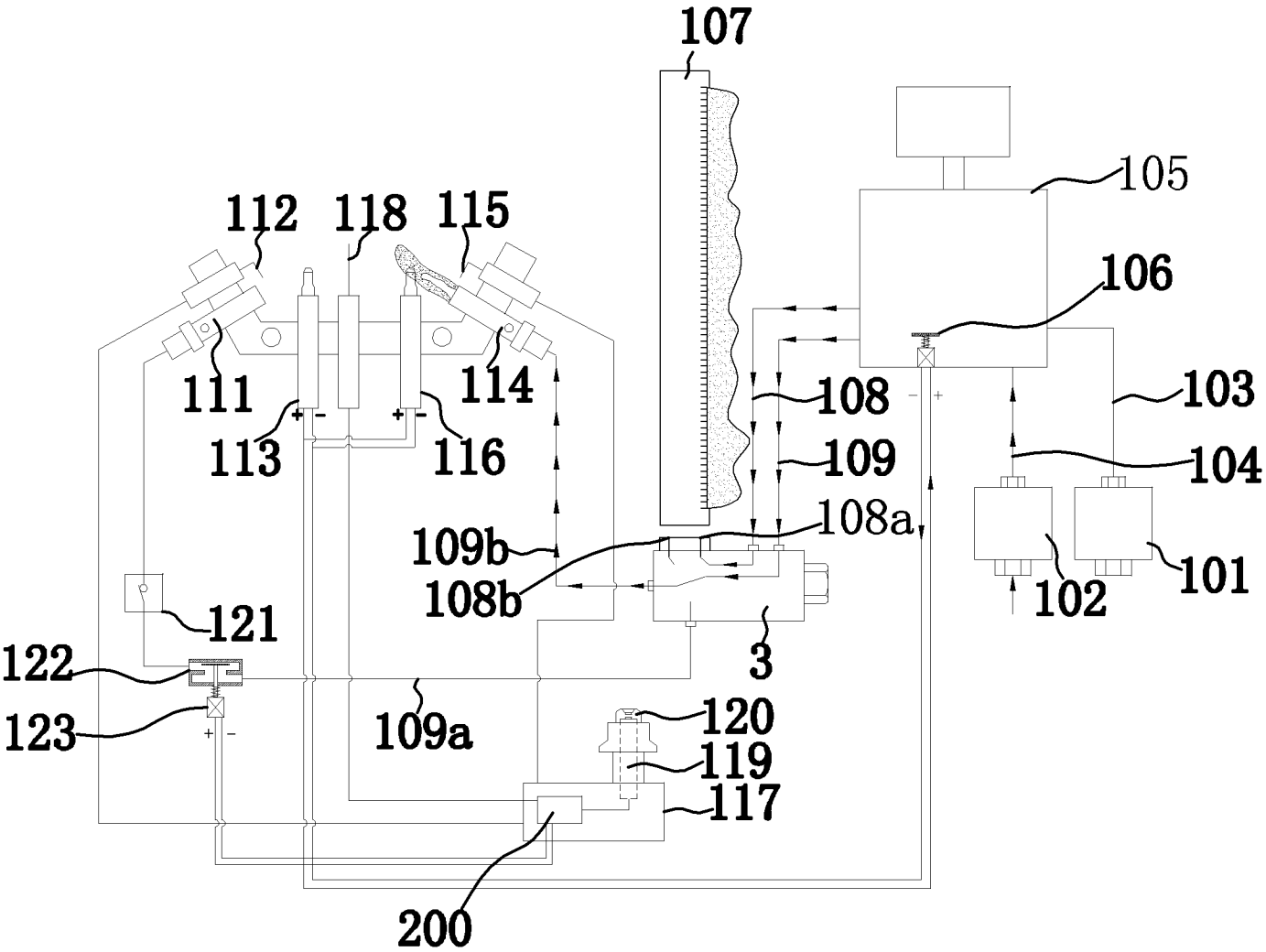
FIG. 8 provides a diagram of an operating principle of high calorific value gas in the another gas control system when the gas path conversion valve is manually operated according to an embodiment of the disclosure.
Figure 9:
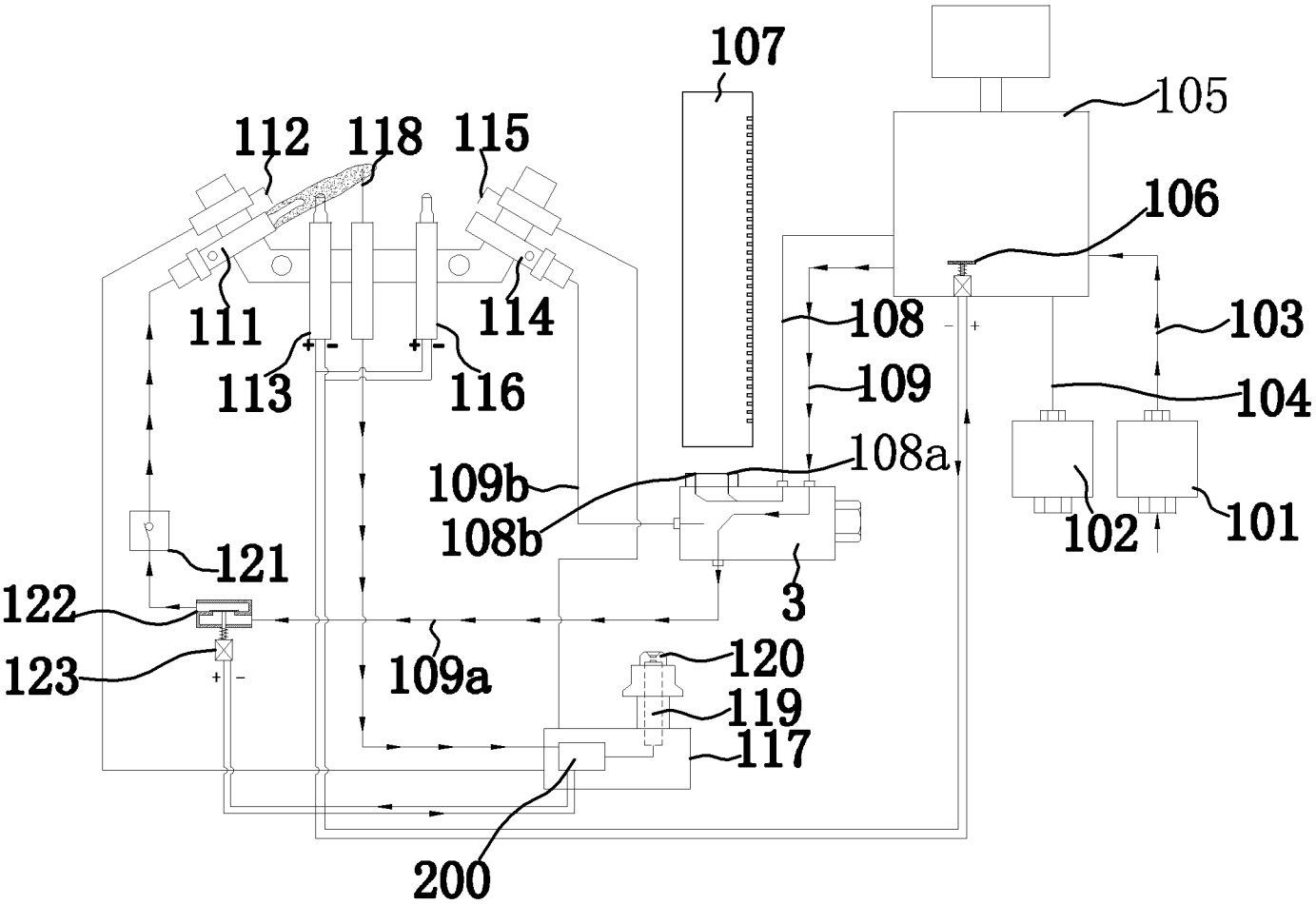
FIG. 9 provides a diagram of an operating principle of a first misconnection type in the another gas control system when the gas path conversion valve is manually operated according to an embodiment of the disclosure.
Figure 10:
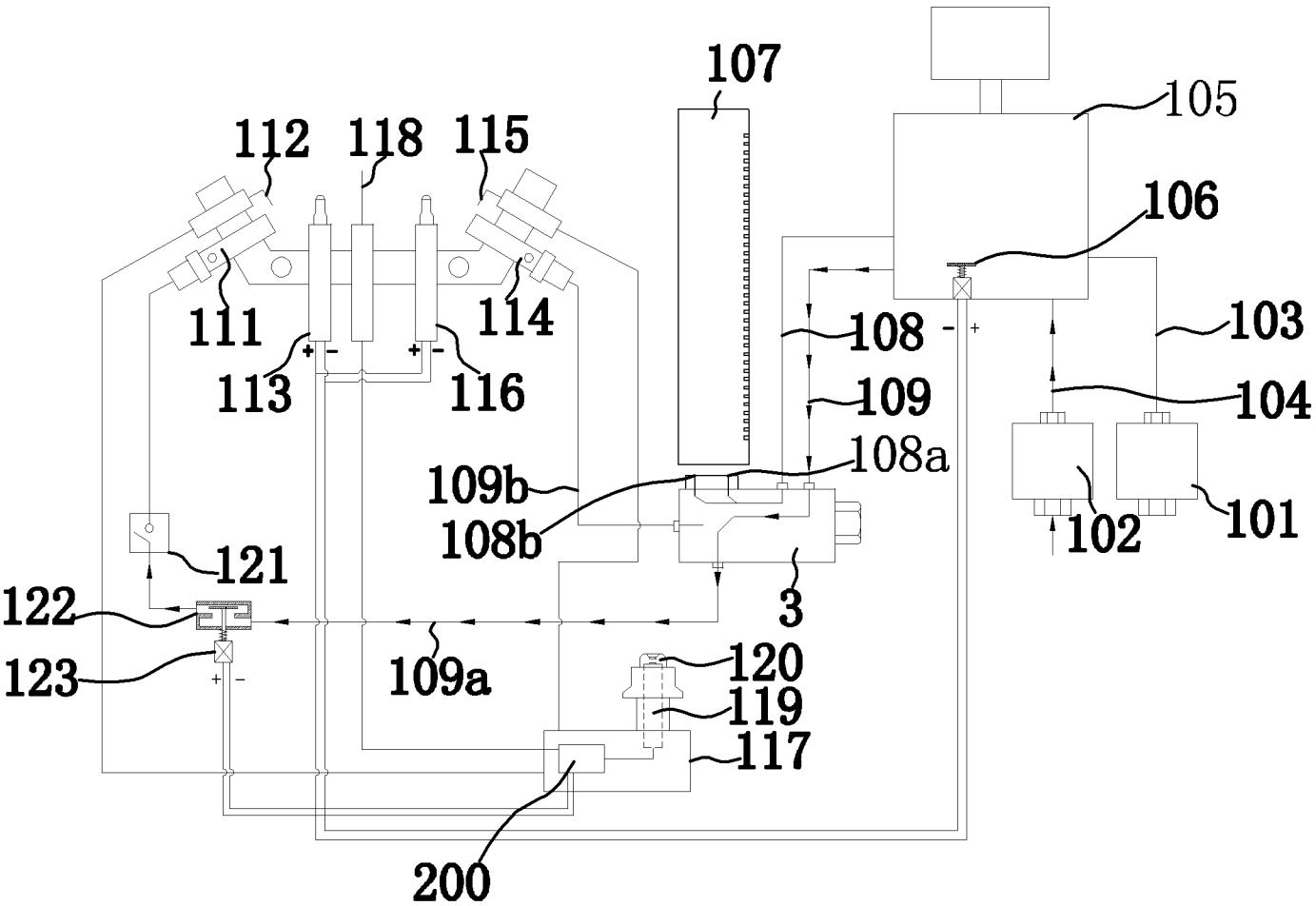
FIG. 10 provides a diagram of an operating principle of a second and a third misconnection types in the another gas control system when the gas path conversion valve is manually operated according to an embodiment of the disclosure.

In the drawings, low calorific value voltage regulator valve 101, high calorific value voltage regulator valve 102, low calorific value gas path 103, high calorific value gas path 104, switch control valve 105, first solenoid valve 106, main burner 107, main gas path 108, first main gas nozzle mouth 108*a*, second main gas nozzle mouth 108*b*, ignition gas path 109, low calorific value ignition gas path 109*a*, high calorific value ignition gas path 109*b*, low calorific value gas lighter 111, low calorific value gas ignition needle 112, low calorific value gas thermocouple 113, high calorific value gas lighter 114, high calorific value gas ignition needle 115, high calorific value gas thermocouple 116, igniter 117, flame sensor 118, a power supply 119, igniter switch 120, an over voltage protection device 121, on/off valve 122, second solenoid valve 123, error-proof control circuit 200, power-on circuit 201, boost circuit 202, alarm circuit 203, first valve driving chip 204, second valve driving chip 205, gas path conversion valve 3, valve body 31, low calorific value gas lighter outlet 3101, high calorific value gas lighter outlet 3102, gas lighter gas path inlet 3103, main inlet 3104, low gas transfer channel 3105, a spool 32, connection groove 3201, first spool hole 3202, second spool hole 3203, valve seat 33, valve rod 34, reset spring 36, double gas nozzle 37, circle-shaped barrier 3701, in-circle nozzle mouth 3702, outer nozzle mouth 3703, inner gas transfer chamber 38, outer gas transfer chamber 39, first connection short tube 310, second connection short tube 31101, first damper 31102, rotation barrel 31103, second damper 31104, damper linking rod 31105, axial limitation rib 31106, knob 312, main gas channel switching solenoid valve 401, ignition gas channel switching solenoid valve 402.

DESCRIPTION OF THE EMBODIMENTS

The disclosure is described in detail in combination with the drawings and through the embodiments as follows. The following embodiments are explanations of the disclosure, and the disclosure is not limited to the following embodiments.

Manual operation is required by gas connection and selection of a gas path conversion valve 3. The following types of misconnection leading to security risks may thereby exist. In the first misconnection type, high calorific value gas is misconnected to a low calorific value voltage regulator valve 101, mistakenly enters a low calorific value lighter 111, and then enters a first main gas nozzle mouth 108*a* and a second main gas nozzle mouth 108*b* in a main gas path 108. In the second misconnection type, the high calorific value gas is connected to a high calorific value voltage regulator valve 102, mistakenly enters the low calorific value lighter 111, and then enters the first main gas nozzle mouth 108*a* and the second main gas nozzle mouth 108*b* in the main gas path 108. In the third misconnection type, low calorific value gas is misconnected to the high calorific value voltage regulator valve 102, enters the low calorific value lighter 111, and then enters the first main gas nozzle mouth 108*a* and the second main gas nozzle mouth 108*b* in the main gas path 108.

Figure 11:
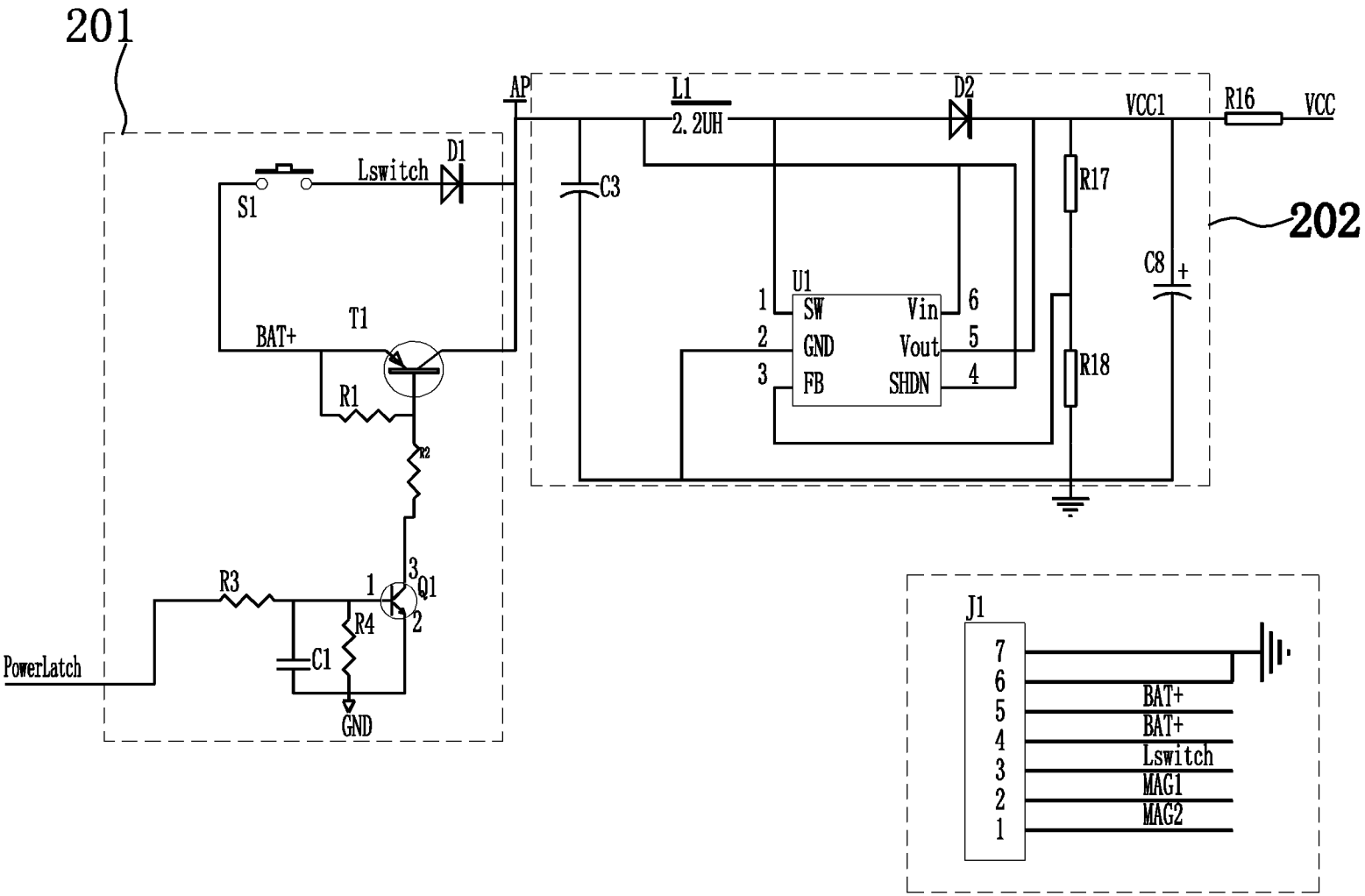
FIG. 11 provides a circuit diagram of a power-on self-locking circuit and a boost circuit in a control circuit according to an embodiment of the disclosure.

As shown in FIG. 11, a control circuit provided by the disclosure includes a power-on circuit 201, connected in series with an external power supply 119 and an igniter switch 120 to form a loop. A self-locking switch triode T1 connected in series with the external power supply 119 and a self-locking amplifying triode Q1 connected to a base electrode of the self-locking switch triode T1 are included. On an MCU control circuit, one pin on an MCU control chip U2 is configured to detect whether the power-on circuit 201 is connected, and another pin on the MCU control chip is connected to a base electrode of the self-locking amplifying triode Q1 in the power-on circuit 201. Preferably, the control circuit further includes a boost circuit 202 connected to the power-on circuit 201 and including a boost chip U1 and an inductor L1. A power output pin of the boost chip U1 transmit a boosted voltage to any one or a plurality of the MCU control circuit, a pulse ignition circuit, and a gas misconnection flame detection circuit. The operating principle is that when an igniter switch 120 is pressed, a switch S1 is switched off, and power is turned on. The power supply 119 herein is battery powered. An anode BAT+ of the battery reaches a front end of a boost circuit b of the AP point through the switch S1 and D1. C3, L1, D2, U1, R17, R18, and C18 form a boost voltage VCC1, and a boosted voltage powers the MCU control chip U2 through R16, that is, passing through a VCC end. MCU control chip U2 is powered on, after a signal Lswicth of pin 1 becomes a high electrical level, a $13^{th}$ pin sends a high electrical level signal powerlatch to a b electrode of pin 1 of Q1 through R3 to drive Q1 to be turned on. After Q1 is turned on, pin 3 becomes a low potential from a high potential, and T1 gate G passes through R2 and becomes a low potential. T1 is turned on, a battery voltage BAT+ reaches the boost circuit b through T1, the circuit is activated to form activation and perform self-locking. R3, C1, R4, Q1, R2, R1, and T1 form a self-locking circuit. Arrangement of the booster circuit 202 improves the voltage supply capability to other circuits in the control circuit. Besides, J1 in FIG. 11 is the connection terminal of the power-on circuit 201 and the MCU control circuit.

Figure 14:
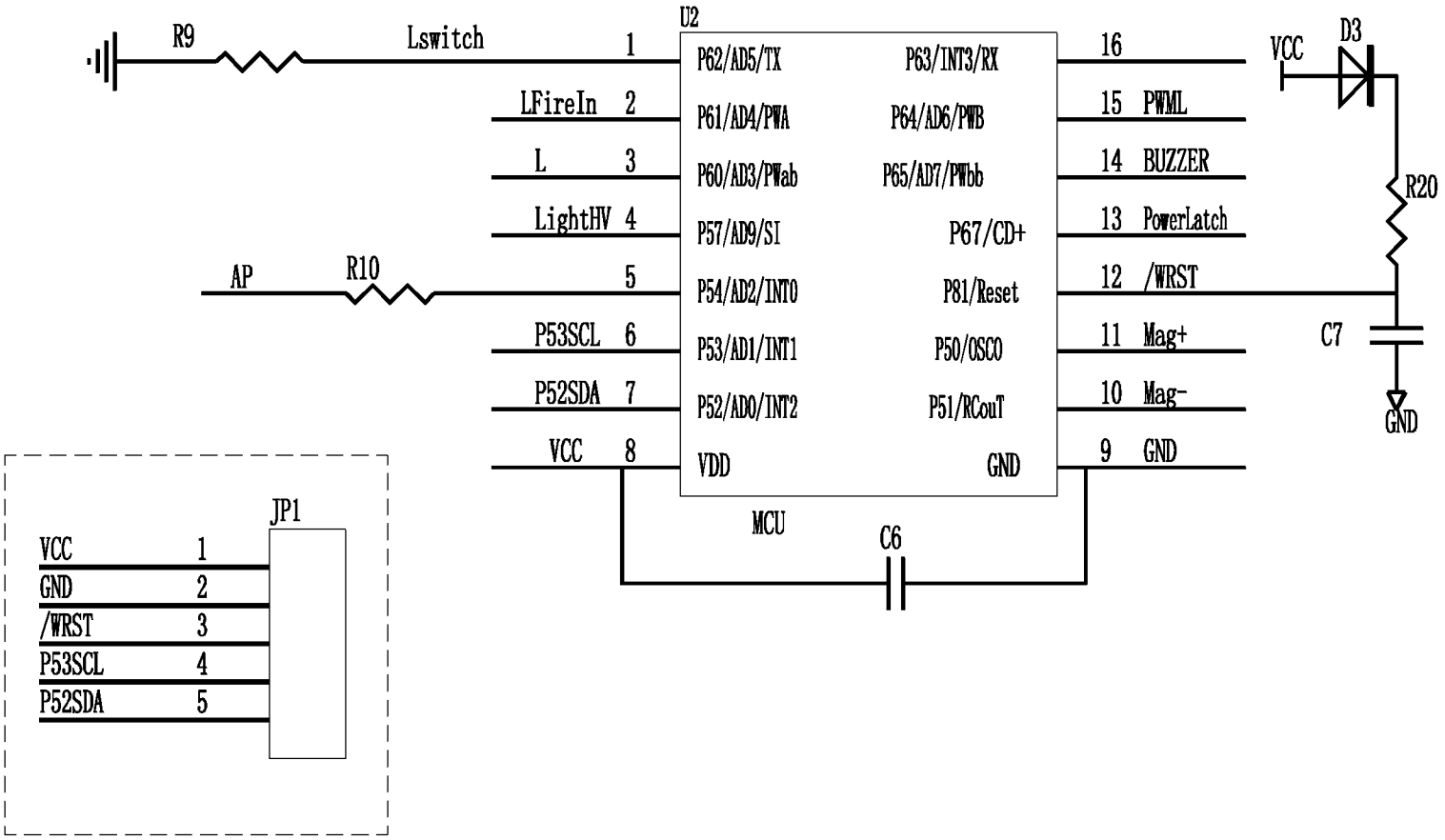
FIG. 14 provides a circuit diagram of an MCU control circuit in the control circuit when the gas path conversion valve is manually operated according to an embodiment of the disclosure.

As shown in FIG. 14, when a gas path conversion valve 3 is manually operated, the MCU control circuit includes the MCU control chip U2. Pins of the MCU control chip U2 are introduced as follows. Pin 1 is a Lswitch IO input pin and may be used to detect whether a system is powered on. Pin 2 is configured for LfireIN floating and does not provide any other functions. Pin 3 is an L IO input pin and may be used to determine whether gas is misconnected. Pin 4 is a LightHV IO output pin and is configured to control activation and termination of electronic pulse ignition. Pin 5 is an AD input pin and is configured to detect battery power when a system is powered on. Pin 6 P53SCL and pin 7 P52SDA are MCU burning signal pins. Pin 8 VCC and pin 9 GND are MCU anode and cathode power supply pins. Pin 10 Mag− and pin 11 Mag+ are IO output pins and are configured to control close/open of a second solenoid valve 123 on the on/off valve 122. Pin 12 is an MCU power-on reset pin Reset. Pin 13 PowerLatch is an IO output pin and controls power-on self-locking and powering off of a system. Pin 14 BUZZER is an IO output pin and controls activation/termination of a buzzer. Pin 15 PWML is an IO output pin and controls turning off of a first solenoid valve 106 on a switch control valve 105. Pin 16 is floating and does not provide any other functions. In addition, JP1 in FIG. 14 is a program burning port and thus may be used to read a control code in the MCU control chip U2 and may also be used to write a new control code into the MCU control chip U2.

Figure 17:
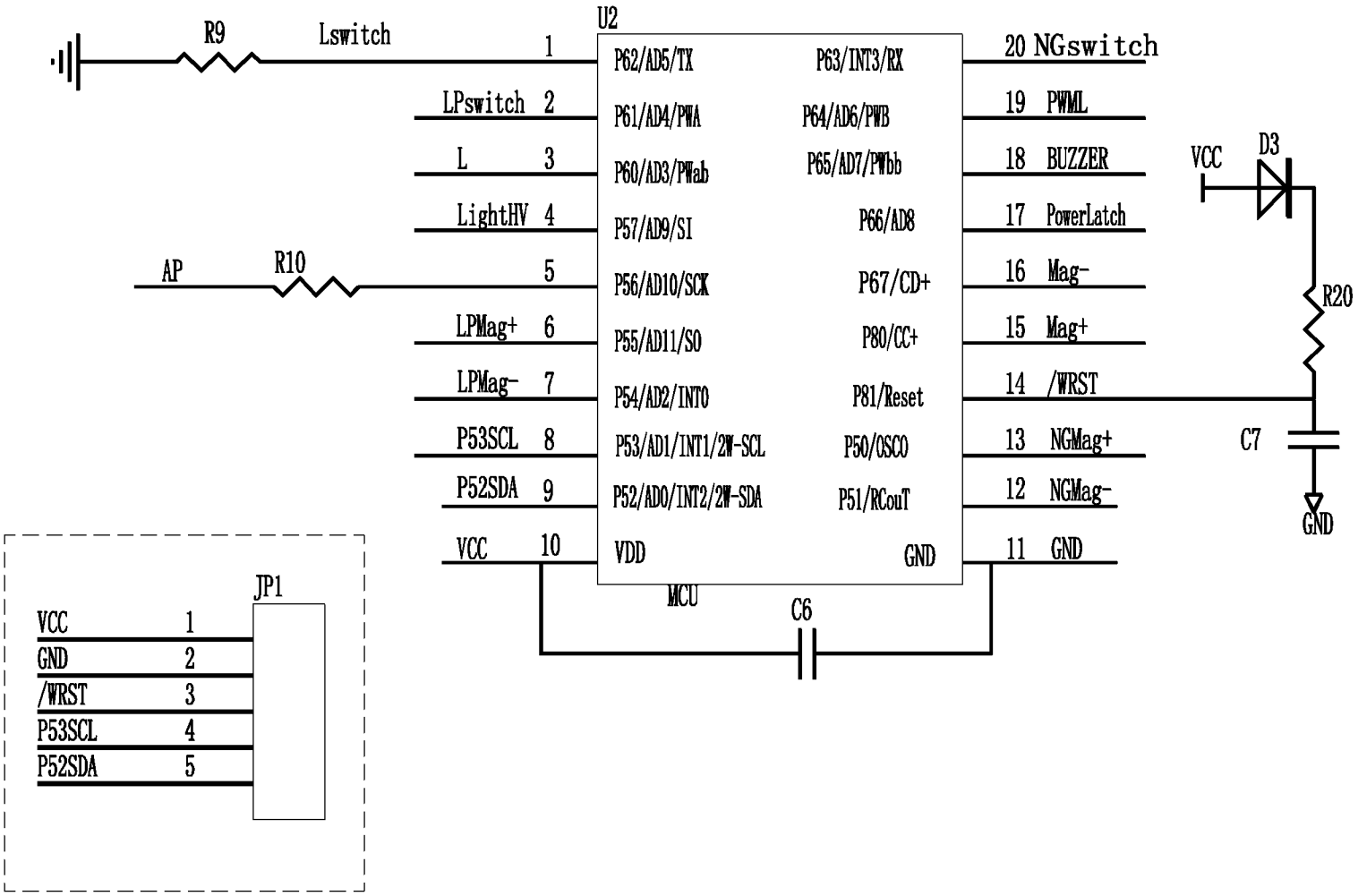
FIG. 17 provides a circuit diagram of the MCU control circuit in the control circuit when the gas path conversion valve is electronically operated according to an embodiment of the disclosure.

As shown in FIG. 17, when the gas path conversion valve 3 is electrically controlled, the MCU control circuit includes the MCU control chip U2. Pins of the MCU control chip U2 are introduced as follows. Pin 1 is a Lswitch IO input pin and may be used to detect whether a system is powered on. Pin 2 detects whether a switch S2 is connected. Pin 3 is an L IO input pin and may be used to determine whether gas is misconnected. Pin 4 is a LightHV IO output pin and is configured to control activation and termination of electronic pulse ignition. Pin 5 is an AD input pin and is configured to detect battery power when a system is powered on. Pin 6 LPMag+ and pin 7 LPMag− control close/open of a lighter solenoid valve. Pin 8 P53SCL and pin 9 P52SDA are MCU burning signal pins. Pin 10 VCC and pin 11 GND are MCU anode and cathode power supply pins. Pin 12 NGMag− and pin 13 NGMag+ are IO output pins and are configured to control close/open of a master lighter solenoid valve. Pin 14 is an MCU power-on reset pin Reset. Pin 15 Mag+ and pin 16 Mag− are IO output pins and are configured to control close/open of the on/off valve. Pin 17 PowerLatch is an IO output pin and controls power-on self-locking and powering off of a system. Pin 18 BUZZER is an IO output pin and controls activation/termination of a buzzer. Pin 19 PWML is an IO output pin and controls turning off of a solenoid valve in a switch control valve. Pin 20 detects whether a switch S3 is connected. In addition, JP1 in FIG. 17 is a program burning port and thus may be used to read a control code in the MCU control chip U2 and may also be used to write a new control code into the MCU control chip U2.

Figure 12:
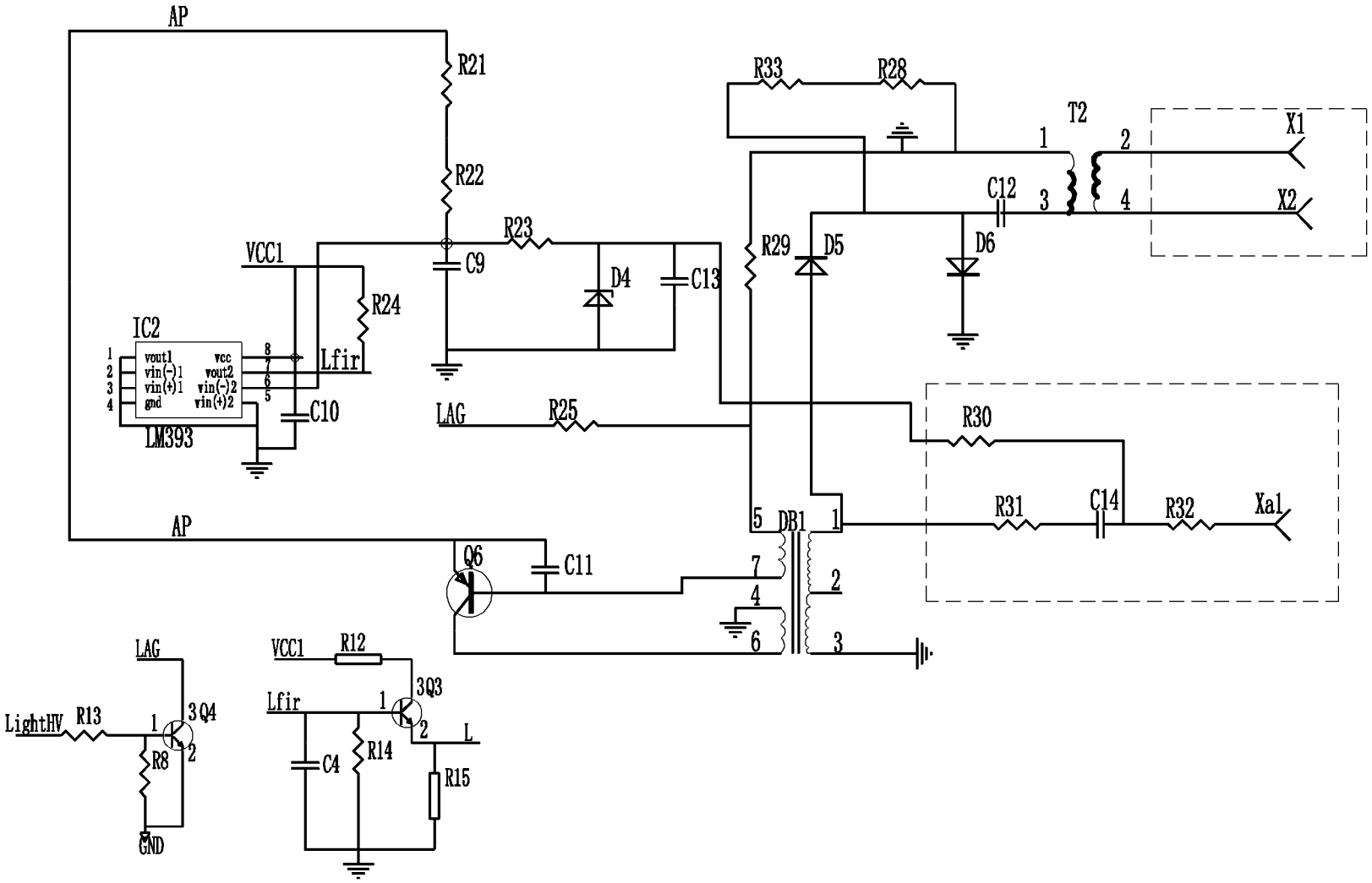
FIG. 12 provides a circuit diagram of a pulse ignition circuit and a gas misconnection flame detection circuit in the control circuit according to an embodiment of the disclosure.

As shown in FIG. 12, a pulse ignition circuit includes an oscillating loop powered by the power-on circuit 201, and preferably powered by the boost circuit 202. The oscillating loop generates an inducted ignition high pressure and discharges to an outside through an external low calorific value gas ignition needle 112 and a high calorific value gas ignition needle 115 connected thereto. One pin on the MCU control chip U2 sends a control signal to control magnitude of an oscillating voltage of the oscillating loop. A gas misconnection flame detection circuit includes a comparator IC2 powered by the power-on circuit 201, and preferably powered by the boost circuit 202, and is configured for receiving a flame signal sent from an external flame sensor 118. The comparator IC2 is a chip having a model number of LM393. A voltage signal generated by the flame sensor 118 is transmitted to one input pin of the comparator IC2. The flame signal is outputted from an output pin of the comparator IC2 to a base electrode of a detection amplifying triode Q3 connected to the comparator IC2. The flame signal passing through the detection amplifying triode Q3 is transmitted onto the MCU control chip U2 through an input pin on the MCU control chip U2 that is connected to the detection amplification triode Q3 and that is configured for receiving the flame signal. When a high calorific value gas is misconnected to a low calorific value gas lighter 111, the flame sensor 118 generates a negative voltage signal to the input pin configured for receiving the flame signal on the comparator IC2. The output pin configured for outputting the flame signal on the comparator IC2 outputs a high electrical level to the base electrode of the detection amplifying triode Q3. The detection amplifying triode Q3 transmits the amplified flame signal to the input pin configured for receiving the flame signal on the MCU control chip U2. After an output pin on the MCU control chipU2 that is configured for sending a driving signal for driving a gas path to be cut off receives the flame signal indicating misconnection, the output pin sends the driving signal configured for driving the gas path to be cut off to an external corresponding gas path on/off control device. A cutting off operation of a first solenoid valve 106 in a switch control valve 105 is controlled by the gas path on/off control device. The operating principle is that the switch S1 in the power-on circuit 201 is switched off, and the battery voltage BAT+ in the power-on circuit 201 passes through the switch S1 and the diode D1 and reaches the AP point. A voltage AP passes through Q6, C11, R29, DB1, D5, D6, C12, T2, R33, and R28 and forms an oscillating loop. After the MCU control chip U2 detects that a $1^{st}$ pin has a high potential, a $4^{th}$ pin transmits a high potential signal LightHV to detect that Q4 is turned on to GND. A resistor R25 and GND form a loop, the oscillating voltage rises, and a voltage of the oscillating voltage also increases after the oscillating voltage passes through the $1^{st}$ pin of a transformer DB1 and D5 to charge a capacitor C12. When a charging voltage rises to a set voltage value, D6 discharges GND instantly. After voltages across two ends of C12 are discharged, charging and discharging begin again, and such cycle is performed sequentially. Pins 1 and 3 of a transformer T2 form an alternating voltage, and pins 2 and 4 of the transformer T2 generate the inducted ignition high pressure. Discharging to the outside is performed through X1 and X2 discharging needles, and the X1 and X2 herein are a low calorific value gas ignition needle 112 and a high calorific value gas ignition needle 115. Gas is ignited. After gas is ignited, the flame burns a thermocouple. After the thermocouple generates a thermoelectric potential to maintain the solenoid valve of the switch control valve to be closed, the S1 switch is released. When the first pin on the MCU control chip U2 detects that the Lswitch becomes a low-level signal, the $4^{th}$ pin on the MCU control chip U2 outputs a LightHV low level signal. When Q4 ends, an oscillating voltage of the oscillating circuit reduces, and X1 and X2 stop discharging and igniting. After flame combustion on a lighter device is stabilized, if a flame sensor Xa1, the Xa1 provided herein is the flame sensor 118, is burned by the flame, a $6^{th}$ pin of IC2 passes the induction pin Xa1 and the ion flame and is connected to GND through R23, R30, and R32 and generates a negative pressure. A $7^{th}$ pin of IC2 outputs a high-level signal Lfir to drive Q3 to be turned on, and then the signal L becomes a high potential. When detecting that the signal L is of high potential, a 3rd pin on the MCU control chip U2 determines that gas is misconnected. IC2, C10, R21, R22, R23, D4, C13, R30, R31, C14, R32, and Xa1 form a flame detection circuit. Note that when the flame sensor Xa1 senses fire, it means that misconnection is present, and if no fire is sensed, it means that there is no misconnection.

The control circuit detects the flame signal transmitted by the external flame sensor Xa1 connected thereto through the gas misconnection flame detection circuit and sends the signal to the MCU control circuit. A driving signal configured for driving the gas path to be cut off to an external corresponding gas path on/off control device is sent from the MCU control circuit. In this way, when the high calorific value gas is misconnected to the low calorific value voltage regulator valve 101, enters the low calorific value gas lighter, the low calorific value gas ignition needle 112, the low calorific value gas thermocouple 113, the high calorific value gas lighter 114, the high calorific value gas ignition needle 115, and high calorific value gas, and simultaneously enters the first main gas nozzle mouth 108*a* and the second main gas nozzle mouth 108*b*, the gas path is closed in time and safety and security are thus provided.

Figure 15:
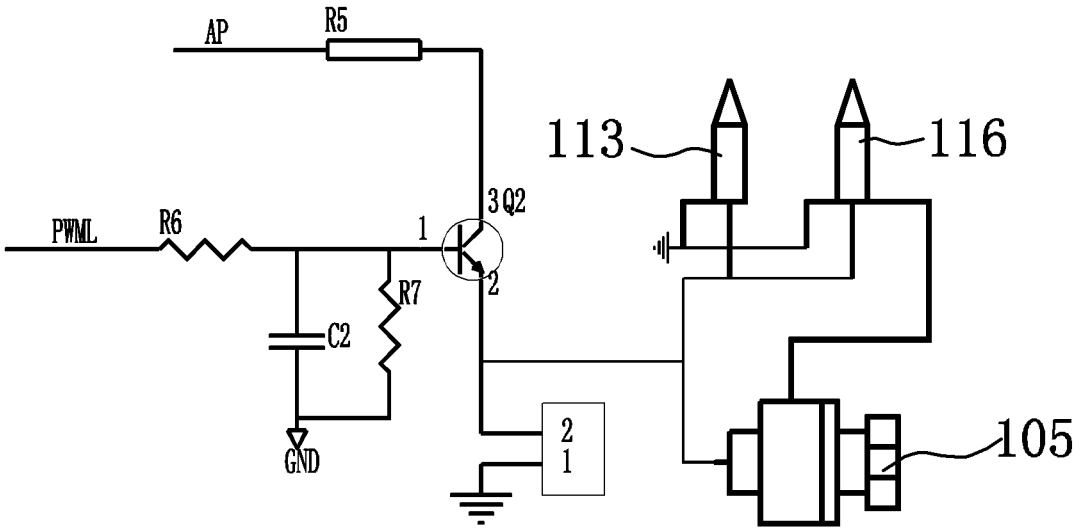
FIG. 15 provides a circuit diagram of control of a thermocouple voltage in the control circuit in the gas control system according to an embodiment of the disclosure.

Specifically, as shown in FIG. 15, one output pin on the MCU control chip U2 configured for transmitting the driving signal for driving the gas path to be cut off is disposed on a wire of opposite polarity to the output pin in two wires connected an external thermocouple parallel circuit and the external first solenoid valve 106. The thermocouple parallel circuit is formed by a connection between an anode of a low calorific value gas thermocouple 113 and an anode of a high calorific value gas thermocouple 116 and a connection between a cathode of the low calorific value gas thermocouple 113 and a cathode of the high calorific value gas thermocouple 116. When the input pin of the MCU control chipU2 connected to the gas misconnection flame detection circuit detects that the high calorific value gas is misconnected to the low calorific value gas lighter 111, the output pin on the MCU control chip U2 outputs a voltage of polarity opposite to an output voltage of the thermocouple parallel circuit. In this way, current balancing is instantly and forcibly performed to a thermoelectric potential generated by the fired low calorific value gas thermocouple 113 or the voltage is set to zero. As such, the thermoelectric potential which keeps the first solenoid valve 106 on the switch control valve 105 to be closed is lost, and the first solenoid valve 106 is not closed to prevent external gas from entering. The operating principle is that when the MCU control chip U2 detects that gas is misconnected, a $15^{th}$ pin of the MCU control chip U2 outputs a high-level signal PWML to turn on Q2 through R6. A direct voltage AP flows to the thermocouple and a negative voltage end through R5 and Q2, the a negative voltage generated by the thermocouple is offset to zero by the direct voltage AP, the first solenoid valve 106 in the switch control valve 105 has no voltage and thus is not closed, such that the gas path is not connected. When the high calorific value gas is misconnected to the low calorific value voltage regulator valve 101, a voltage signal of opposite polarity to the thermocouple connected to the MCU control circuit is outputted through the MCU control circuit. In this way, current balancing is instantly and forcibly performed to a thermoelectric potential generated by the thermocouple or the voltage is set to zero. The thermoelectric potential which keeps the first solenoid valve 106 on the switch control valve 105 to be closed is lost to prevent external gas from entering the gas path of the system through the switch control valve 105 to achieve safety, prevention, and control.

Figure 16:
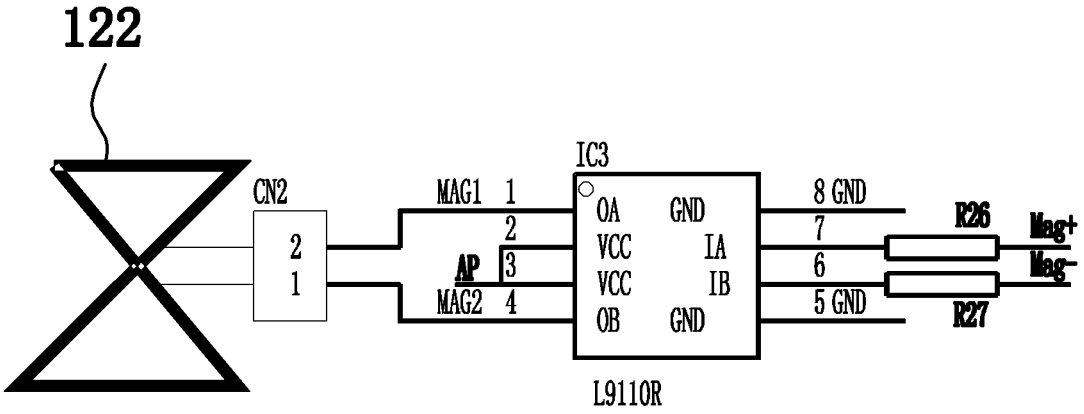
FIG. 16 provides a circuit diagram of control of on/off of an on/off valve in another gas control system according to an embodiment of the disclosure.

Further, as shown in FIG. 16, a pair of anode and cathode power output pins configured for transmitting the driving signal for driving the gas path to be cut off on the MCU control chip U2 is electrically connected to the external low calorific value gas lighter 111 and a second solenoid valve 123 in an on/off valve 122 on a low calorific value ignition gas path 109*a* between output ends corresponding to the low calorific value gas lighter 111 on a gas path conversion valve 3 through a motor control driver chip. When the input pin connected to the gas misconnection flame detection circuit on the MCU control chip U2 detects that the high calorific value gas is misconnected to the low calorific value gas lighter 111, the pair of anode and cathode power output pins transmits the driving signal for driving the gas path to be cut off, so that the second solenoid valve 123 on the on/off valve 122 is not closed to close the low calorific value ignition gas path 109*a*. A gas flame is reduced until being put out without burning the low calorific value gas thermocouple 113, such that the low calorific value gas thermocouple 113 cannot continuously supply power to the first solenoid valve 106 in the switch control valve 105. The first solenoid valve 106 in the switch control valve 105 does not receive power supply is not closed to prevent external gas from entering the gas path in the system through the switch control valve 105. The operating principle is that when the MCU control chip U2 detects that gas is misconnected, a $10^{th}$ pin Mag− and a $11^{th}$ pin Mag+ of the MCU control chip U2 send a valve off signal through R26 and R27 to control IC3 to drive the on/off valve to be switched off, a gas channel is cut off, and the flame is put out. When the high calorific value gas is misconnected to the low calorific value voltage regulator valve 101, a switching off signal is outputted to the second solenoid valve 123 on the on/off valve 122 connected to the MCU control circuit through the MCU control circuit, so that the second solenoid valve 123 in a closed state is instantly opened. The flame of the low calorific value gas lighter 111 may thus be extinguished since no low calorific value gas is continuously supplied. The thermocouple no longer generates a thermoelectric potential since no flame is sensed and thus may not provide electricity energy to the first solenoid valve 106 connected thereto on the switch control valve 105. In this way, the first solenoid valve 106 is not closed to prevent external gas from entering the gas path in the system through the switch control valve 105. When the high calorific value gas is misconnected to the low calorific value voltage regulator valve 101, a switching off signal is outputted to the second solenoid valve 123 on the on/off valve 122 connected to the MCU control circuit through the MCU control circuit, so that the second solenoid valve 123 in the closed state is instantly opened. The flame of the low calorific value gas lighter 111 may thus be extinguished since no low calorific value gas is continuously supplied. The thermocouple no longer generates a thermoelectric potential since no flame is sensed and thus may not provide electricity energy to the first solenoid valve 106 connected thereto on the switch control valve 105. In this way, the first solenoid valve 106 is not closed to prevent external gas from entering.

Figure 13:
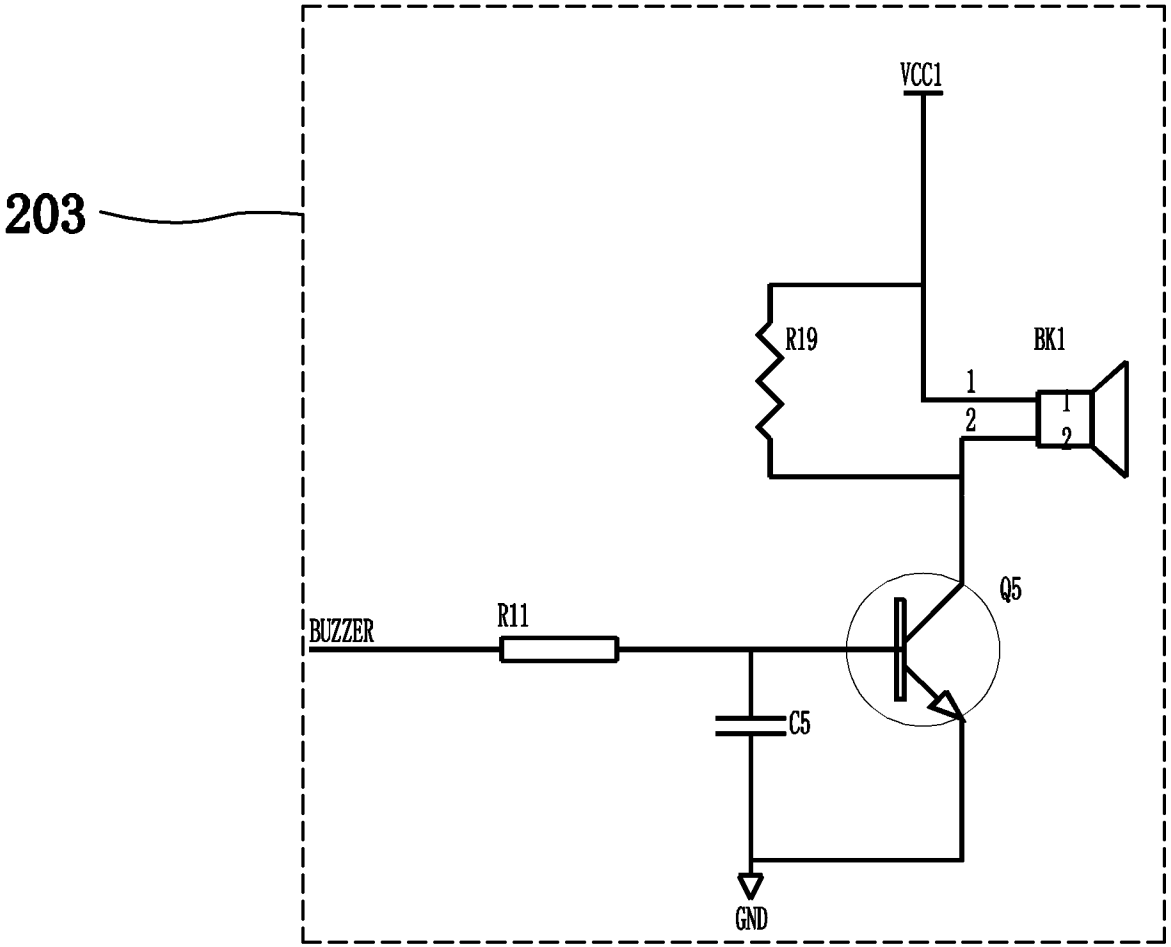
FIG. 13 provides a control circuit diagram of a buzzer in the control circuit according to an embodiment of the disclosure.

As shown in FIG. 13, an alarm circuit 203 including a buzzer and an alarm amplifying triode is also included. A base electrode of the alarm amplifying triode receives an alarm signal sent from an output pin on the MCU control chip U2. During operation, when an output signal BUZZER of the MCU control chip U2 is of high potential, the signal passes R11 and drives Q5 to be turned on, a buzzer BK1 passes Q5 to the ground to form a loop, and a sound sounds. When the signal is of low electrical level, Q5 is turned off, the loop of the buzzer BK1 is switched off, and the sound stops. R11, C5, Q5, R19, and BK1 form a buzzer driving control circuit. Arrangement of the alarm circuit 203 enables a user to obtain alarm information immediately, and total gas paths may be closed through a knob on the switch control valve 105 through manual operation.

Figure 18:
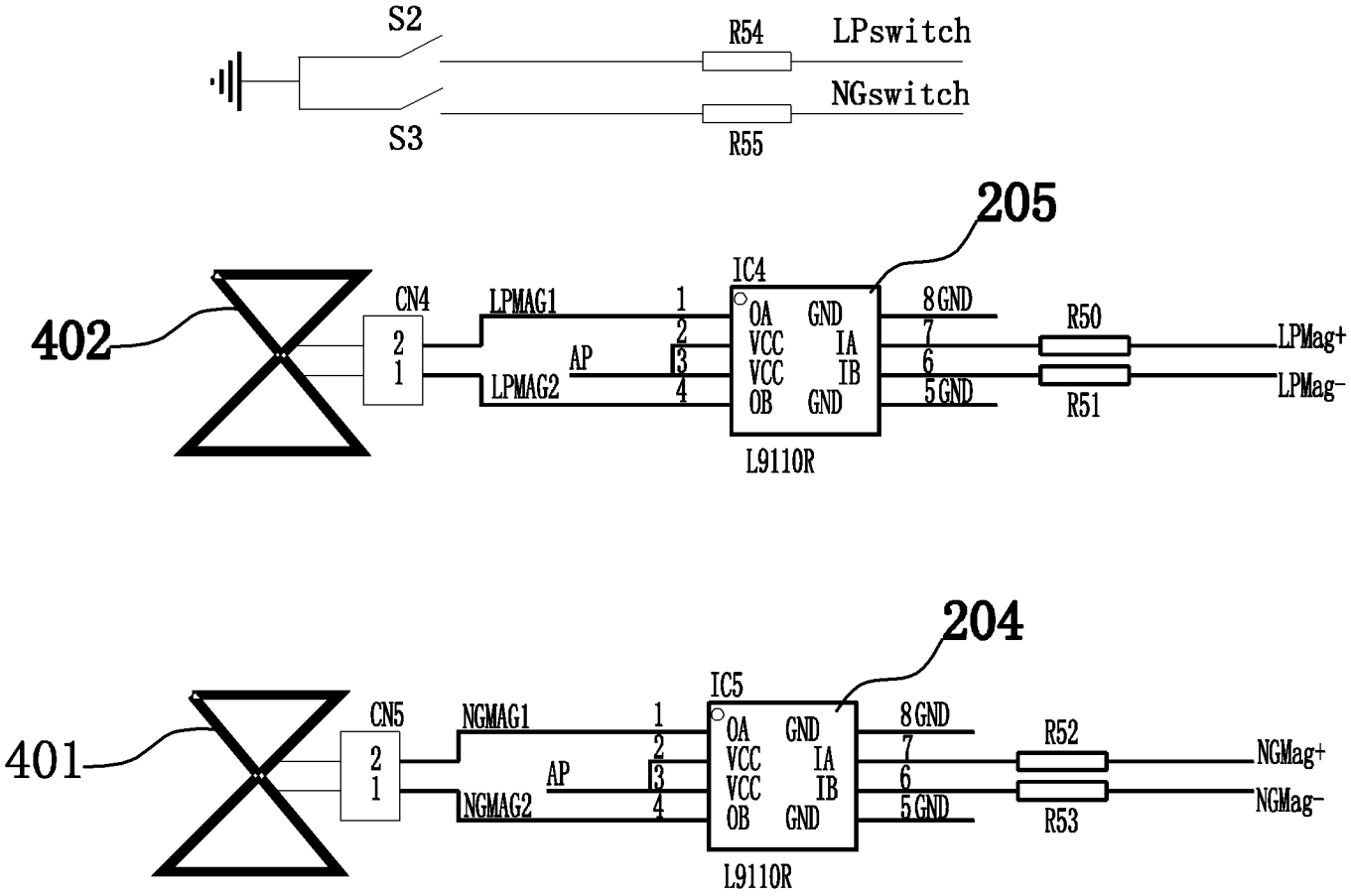
FIG. 18 provides a circuit diagram of an electronically controlled conversion valve control circuit in the control circuit according to an embodiment of the disclosure.

As shown in FIG. 18, an electronically controlled conversion valve control circuit is also provided and includes a first valve driving chip 204 configured for driving a main gas channel switching solenoid valve 401 in an external electronically controlled gas path conversion valve and a second valve driving chip 205 configured for controlling and driving an ignition gas channel switching solenoid valve 402 in the external electronically controlled gas path conversion valve. The first valve driving chip 204 and the second valve driving chip 205 respectively receive valve control information sent from the MCU control chip. Two pins in the MCU control chip are respectively connected in series with a low calorific value voltage regulator switching switch S2 in an external low calorific value voltage regulator valve 101 and a high calorific value voltage regulator switching switch S3 in a high calorific value voltage regulator valve 102. When receiving information on the low calorific value voltage regulator switching switch S2 or the high calorific value voltage regulator switching switch S3 being in a closed state, the MCU control chip sends the corresponding valve control information to the first valve driving chip 204 and the second valve driving chip 205. Specifically, when a gas tube is connected to a mouth of the high calorific value gas voltage regulator valve 102 or the low calorific value gas voltage regulator valve, the low calorific value voltage regulator switching switch S2 or the high calorific value voltage regulator switching switch S3 is switched off. When a $2^{nd}$ pin or a 20th pin of the MCU control chip detects that the signal LPswitch or NGswitch is changed to a low electrical level, the $6^{th}$, $7^{th}$, $12^{th}$, and $13^{th}$ pins of the MCU control chip output control signals LPMag+, LPMag−, NGMag+, and NGMag− to control closing of the main gas channel switching solenoid valve 401 and the ignition gas channel switching solenoid valve 402.

As shown in FIG. 1 to FIG. 5, a dual-gas source gas control system with anti-gas source misconnection provided by the disclosure includes a low calorific value voltage regulator valve 101 and a high calorific value voltage regulator valve 102. An input end and an output end of the low calorific value voltage regulator valve 101 are respectively communicated with a low calorific value gas path 103 configured for transmitting a low calorific gas source, and an input end and an output end of the high calorific value voltage regulator valve 102 are respectively communicated with a high calorific value gas path 104 configured for transmitting a high calorific gas source. A switch control valve 105 acting as a master switch configured for controlling a gas path to be cut off is provided and is provided with a first solenoid valve 106 configured for controlling the switch control valve 105 to be turned on or turned off. Two input ends are provided, wherein one input end is connected to the low calorific value voltage regulator valve 101 through the low calorific value gas path 103, and the other input end is connected the high calorific value voltage regulator valve 102 through the high calorific value gas path. Two output ends are further provided and are respectively communicated with a main gas path 108 and an ignition gas path 109 one by one. A gas path conversion valve 3 includes two input ends, wherein one input end is connected to an output end communicating with the main gas path 108 on the switch control valve 105, and the other input end is connected to an output end communicating with the ignition gas path 109 on the switch control valve 105. Four output ends are further provided, wherein the four output ends are respectively communicated with a low calorific value ignition gas path 109*a* leading to a low calorific value gas ignition device, a high calorific value ignition gas path 109*b* leading to a high calorific value gas ignition device, and a first main gas nozzle mouth 108*a* and a second main gas nozzle mouth 108*b* leading to a main burner 107 one by one. A high calorific value gas internal path, a low calorific value gas internal path, and a knob or a switch configured for switching between the high calorific value gas internal path and the low calorific value gas internal path are further provided. The low calorific value gas internal path is respectively communicated with low calorific value ignition gas path 109*a*, the first main gas nozzle mouth 108*a* and a second main gas nozzle mouth 108*b*, and the high calorific value gas internal path is respectively communicated with the high calorific value ignition gas path 109*b* and the first main gas nozzle mouth 108*a*. The main burner 107 is provided, wherein an input end thereof are disposed corresponding to the first main gas nozzle mouth 108*a* and the second main gas nozzle mouth 108*b* on the gas path conversion valve 3, so that gas emitted from the first main gas nozzle mouth 108*a* and the second main gas nozzle mouth 108*b* directly enters an input end of the main burner 107, and a burner opening required by high calorific value gas and low calorific value gas to burn normally is disposed at an outer side. The low calorific value gas ignition device is provided and includes a low calorific value gas lighter 111 near the burner opening required for burning of the low calorific value gas on the main burner 107 and a low calorific value gas ignition needle 112 and a low calorific value gas thermocouple 113 disposed nearby. The low calorific value gas lighter 111 is connected to a corresponding output end on the gas path conversion valve 3 through the low calorific value ignition gas path 109*a*. The high calorific value gas ignition device is provided and includes a high calorific value gas lighter 114 near the burner opening required for burning of the high calorific value gas on the main burner 107 and a high calorific value gas ignition needle 115 and a high calorific value gas thermocouple 116 disposed nearby. The high calorific value gas lighter 114 is connected to a corresponding output end on the gas path conversion valve 3 through the high calorific value ignition gas path 109*b*. An igniter 117 is provided and is electrically connected to the low calorific value gas ignition needle 112 and the high calorific value gas ignition needle 115 respectively. Further, the system also includes a flame sensor 118 disposed at one side near the low calorific value gas thermocouple 113 and away from the low calorific value gas lighter 111 and is configured for detecting a flame signal. The igniter 117 is provided with a power supply 119 and an error-proof control circuit 200 electrically connected thereto. The error-proof control circuit 200 is the control circuit electrically connected to the flame sensor 118. After an igniter switch 120 on the igniter 117 is pressed, electricity is transmitted to the connected control circuit, and the control circuit begins to function and receive the flame signal sent from the flame sensor 118. An anode of the low calorific value gas thermocouple 113 is connected to an anode of the high calorific value gas thermocouple 116, a cathode of the low calorific value gas thermocouple 113 and a cathode of the high calorific value gas thermocouple 116 are connected to form a thermocouple parallel circuit, and an anode and a cathode of the thermocouple parallel circuit are electrically connected to an anode and a cathode of the first solenoid valve 106 respectively one by one. One output end of the control circuit is disposed on one wire of opposite polarity to the output end in two wires connecting the thermocouple parallel circuit and the first solenoid valve 106. When the control circuit detects the flame signal from the flame sensor 118 indicating that the high calorific value gas is misconnected to the low calorific value gas lighter 111, the output end outputs a voltage of opposite polarity to an output voltage outputted by the thermocouple parallel circuit, so that current balancing is instantly and forcibly performed to a thermoelectric potential generated by the fired low calorific value gas thermocouple 113 or the voltage is set to zero. The first solenoid valve 106 which does not receive power supply on the switch control valve 105 is not closed to prevent external gas from entering the gas path in the system through the switch control valve 105. When the high calorific value gas is misconnected to the low calorific value voltage regulator valve 101, a voltage of opposite polarity to an output voltage of the thermocouple parallel circuit is outputted through the control circuit, so that current balancing is instantly and forcibly performed to a thermoelectric potential generated by the fired low calorific value gas thermocouple 113 or the voltage is set to zero to prevent external gas from entering.

Specifically, an over voltage protection device 121 is disposed on the low calorific value ignition gas path 109*a* between the output ends corresponding to the low calorific value gas lighter 111 on the low calorific value gas lighter 111 and the gas path conversion valve 3. When the high calorific value gas is mistakenly introduced to the low calorific value gas lighter 111 after passing through the high calorific value voltage regulator valve 102, or when the low calorific value gas is mistakenly passes through the high calorific value gas voltage regulator valve 102 and is introduced to the low calorific value gas lighter 111, since the pressure of the gas in the low calorific value ignition gas path 109*a* exceeds a pressure preset by the over voltage protection device 121, the over voltage protection device 121 automatically closes the gas path at this moment, so no gas enters the low calorific value gas lighter 111, and the system does not function.

As shown in FIG. 20 to FIG. 30, when the gas path conversion valve 3 is a manual gas path conversion valve, a structure thereof includes a valve body 31, a spool 32 and a valve seat 33. An outer periphery of the valve body 31 is provided with an internally-communicated low calorific value gas lighter outlet 3101, a high calorific value gas lighter outlet 3102, a gas lighter gas path inlet 3103, and a main inlet 3104. The spool 32 is provided and is disposed in the valve body 31, and a connection groove 3201 is disposed on an outer periphery thereof. The spool 32 rotates so that the connection groove 3201 is communicated with the low calorific value gas lighter outlet 3101 and the gas lighter gas path inlet 3103 or is communicated with the high calorific value gas lighter outlet 3102 and the gas lighter gas path inlet 3103. The valve seat 33 is provided and is disposed on an upper end of the valve body 31. A valve rod 34 is slidably inserted into the valve seat 33, and an upper end of the valve rod 34 exposes out of the valve seat 33. A lower end of the valve rod 34 is loosely connected to the other end of a connection rotation shaft having an end disposed on the spool 32. The connection rotation shaft is sleeved with a reset spring for resetting the valve rod 34 after operation. The gas path conversion valve 3 further includes a double gas nozzle 37 communicated with the main inlet 3104 and disposed at a lower end of the valve body 31. A circle-shaped barrier 3701 is protruded at an inner side of the double gas nozzle 37, and at least one in-circle nozzle mouth 3702 for the low calorific value gas to be emitted is provided in the circle-shaped barrier 3701 on the double gas nozzle 37. At least one outer nozzle mouth 3703 for the low calorific value gas or the high calorific value gas to be emitted is disposed between an outer periphery of the double gas nozzle 37 and the circle-shaped barrier 3701. An inner gas transfer chamber 38 for merely the low calorific value gas to enter and an outer gas transfer chamber 39 surrounding an outer periphery thereof for the low calorific value gas and the high calorific value gas to enter are respectively formed when the double gas nozzle 37 and the valve body 31 are connected. The inner gas transfer chamber 38 is communicated with the in-circle nozzle mouth 3702, and the outer gas transfer chamber 39 is communicated with the outer nozzle mouth 3703. A spool through hole assembly is disposed on the spool 32, and two ends of the spool through hole assembly are respectively communicated with the inner gas transfer chamber 38 and a low gas transfer channel 3105 communicated with the main inlet 3104 and disposed on the valve body 31 in a sealed manner. The low calorific value gas is introduced in or the high calorific value gas is prevented from entering the inner gas transfer chamber 38 through rotation of the spool 32, so that an effective gas-intake cross-sectional area corresponding to requirement from the high and low calorific value gas on the double gas nozzle 37 is adjusted. Through the spool through hole assembly on the spool 32, the low calorific value gas from the main inlet 3104 is introduced into the inner gas transfer chamber 38, or the high calorific value gas from the main inlet 3104 is blocked outside the inner gas transfer chamber 38. In this way, the function achieved by a lower valve rod provided in the BACKGROUND section is accomplished, requirement for processing accuracy is lowered, the number of components is decreased, installation is performed easily, and a simple structure is provided so that mass production may be easily achieved.

Specifically, the spool through hole assembly herein includes a first spool hole 3202 axially disposed near the end of the double gas nozzle 37 on the spool 32. The first spool hole 3202 is communicated with the inner gas transfer chamber 38 in a sealed manner. A second spool hole 3203 communicated with the first spool hole 3202 is disposed at an outer side of the spool 32, and the second spool hole 3203 is communicated with the low gas transfer channel 3105 in a sealed manner. A simple structure is thereby provided, and manufacturing may be conveniently performed. A first connection short tube 310 is disposed between the circle-shaped barrier 3701 and the valve body 31 herein in a sealed manner for transferring the low calorific value gas, so that transfer spaces of the inner gas transfer chamber 38 and the outer gas transfer chamber 39 are further increased. The double gas nozzle 37 and the circle-shaped barrier 3701 are integrally connected in one piece, so that operation may be performed more intensively. Further, a damper regulation structure is disposed between an outer end of the double gas nozzle 37 and a gas main tube b connected to an outer portion of the main burner 107 for regulating gas intake in the gas main tube b, and one end of the damper regulation structure is connected to an outer end of the valve rod 34. In this way, in the damper regulation structure, when the valve rod 34 rotates for regulation, gas intake in the gas main tube b is controlled at the same time, and the demand for diverse flame colors from some products and users is satisfied as well. The damper regulation structure includes a second connection short tube 31101 disposed between the main burner 107 and the external gas main tube b in a sealed manner. A first damper 31102 for air to enter is disposed at one side of the second connection short tube 31101, and a rotation barrel having a size and a shape matched with that of the second connection short tube 31101 is disposed at an outer periphery of the second connection short tube 31101. A second damper 31104 corresponding to the first damper 31102 is disposed on the rotation barrel 31103, and a damper linking rod 31105 capable of driving the rotation barrel 31103 and the valve rod 34 to simultaneously rotate is disposed between the rotation barrel 31103 and the valve rod 34. At least a pair of axial limitation ribs 31106 for limiting the rotation barrel 31103 to move in an axial direction of the second connection short tube 31101 protrudes from an outer side of the second connection short tube 31101, accuracy of control of air intake is further improved. Connection between the damper linking rod 31105 and the rotation barrel 31103 and connection between the damper linking rod 31105 and the valve rod 34 are detachable, so that installation and maintenance may be conveniently performed. A knob 312 is disposed at an outer end of the valve rod 34, the knob 312 is connected to the damper linking rod 31105, and arrangement of the knob 312 facilitate rotation and regulation performed by the valve rod 34.

Further, the spool 32 is tapered, and the spool 32 matches a size and a shape of a space in the valve body 31 accommodating the spool 32 A low calorific value gas limitation groove and a high calorific value gas limitation groove are disposed in the valve seat 33 in a high and low manner and in a misaligned arrangement. A boss is disposed on the valve rod 34, the valve rod 34 downwardly moves so that the valve rod 34 passes the connection rotation shaft to drive the spool 32 to rotate to switch the ignition device gas paths between the high and low calorific value gas. The boss is engaged in a corresponding limitation groove so that the valve rod 34 is positioned. A pressure limiting throttle 13 is disposed between the low calorific value gas lighter outlet 3101 and the external low calorific value gas ignition device c. The main function of the pressure limiting throttle 13 is to share part of the work of a dual-gas source gas lighting protection device. According to the principle of existence of a voltage difference between the high calorific value gas and the low calorific value gas, when operation is performed incorrectly, part of protection performed by the dual-gas source gas lighting protection device formed by the low calorific value gas ignition device c and the high calorific value gas ignition device d is transferred to the pressure limiting throttle 13. In this way, design accuracy and manufacturing accuracy of the dual-gas source gas lighting protection device may be considerably reduced, and mass production may thereby be easily and conveniently performed. Theory and practice are thereby combined, and a perfect product is delivered to a customer. The connection groove 3201 herein has a sector structure with an angle of 180 degrees. The low calorific value gas lighter outlet 3101 and the gas lighter gas path inlet 3103 are located on a same center line, and a center line of the high calorific value gas lighter outlet 3102 and a center line of the low calorific value gas lighter outlet 3101 are in a same plane.

The operating principle of the manual gas path converter is that: The valve rod 34 is pressed and abuts against the connection rotation shaft, and the valve rod 34 then drives the connection rotation shaft connected to the spool 32 to rotate simultaneously. When the connection groove 3201 on the spool 32 is communicated with the low calorific value gas lighter outlet 3101 and the gas lighter gas path inlet 3103, the second spool hole 3203 on the spool 32 is communicated with the low gas transfer channel 3105. At this moment, one part of the low calorific value gas in the main inlet 3104 enters the inner gas transfer chamber 38 along the low gas transfer channel 3105 the second spool hole 3203, and the first spool hole 3202 sequentially, passes through inner gas transfer chamber 38, and is finally transmitted to the external gas main tube b from the in-circle nozzle mouth 3702 on the double gas nozzle 37. At the same time, the other part of the low calorific value gas in the main inlet 3104 passes through the main inlet 3104 and directly enters the outer gas transfer chamber 39, passes through the outer gas transfer chamber 39, and is finally transmitted to the external gas main tube b from the outer nozzle mouth 3703 on the double gas nozzle 37. In addition, the damper regulation structure which simultaneously rotates with the valve rod 34 is adjusted to be in an air intake inlet state required by the low calorific value gas. When the connection groove 3201 on the spool 32 is communicated with the high calorific value gas lighter outlet 3102 and the gas lighter gas path inlet 3103, the second spool hole 3203 on the spool 32 is not communicated with the low gas transfer channel 3105. The high calorific value gas in the main inlet 3104 passes through the main inlet 3104 and directly enters the outer gas transfer chamber 39, passes through the outer gas transfer chamber 39, and is finally transmitted to the external gas main tube b from the outer nozzle mouth 3703 on the double gas nozzle 37. In addition, the damper regulation structure which simultaneously rotates with the valve rod 34 is adjusted to be in the air intake inlet state required by the high calorific value gas.

Figure 19:
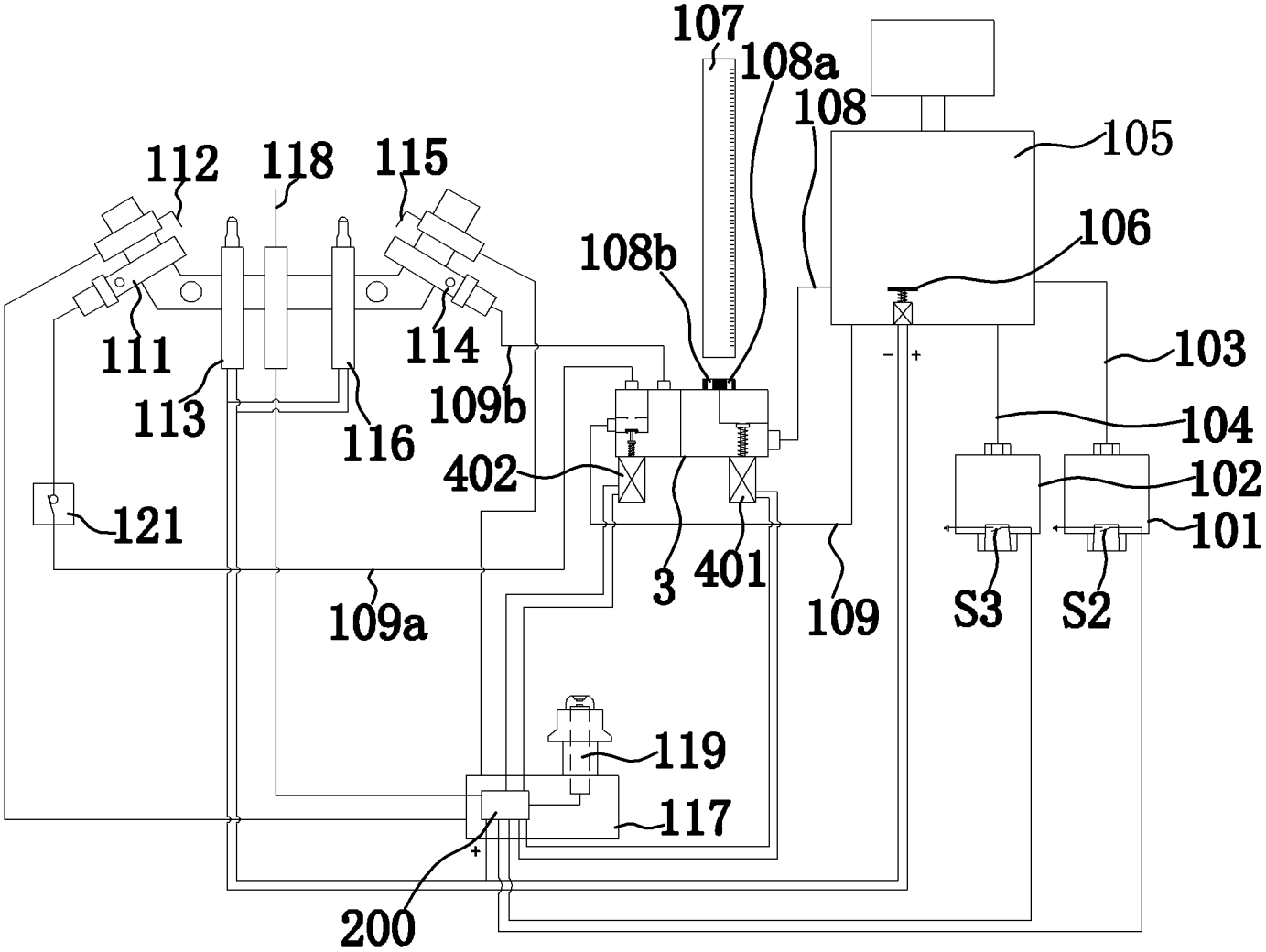
FIG. 19 provides a schematic diagram of a structure and connection in a gas control system when a gas path conversion valve is electronically operated according to an embodiment of the disclosure.
Figure 20:
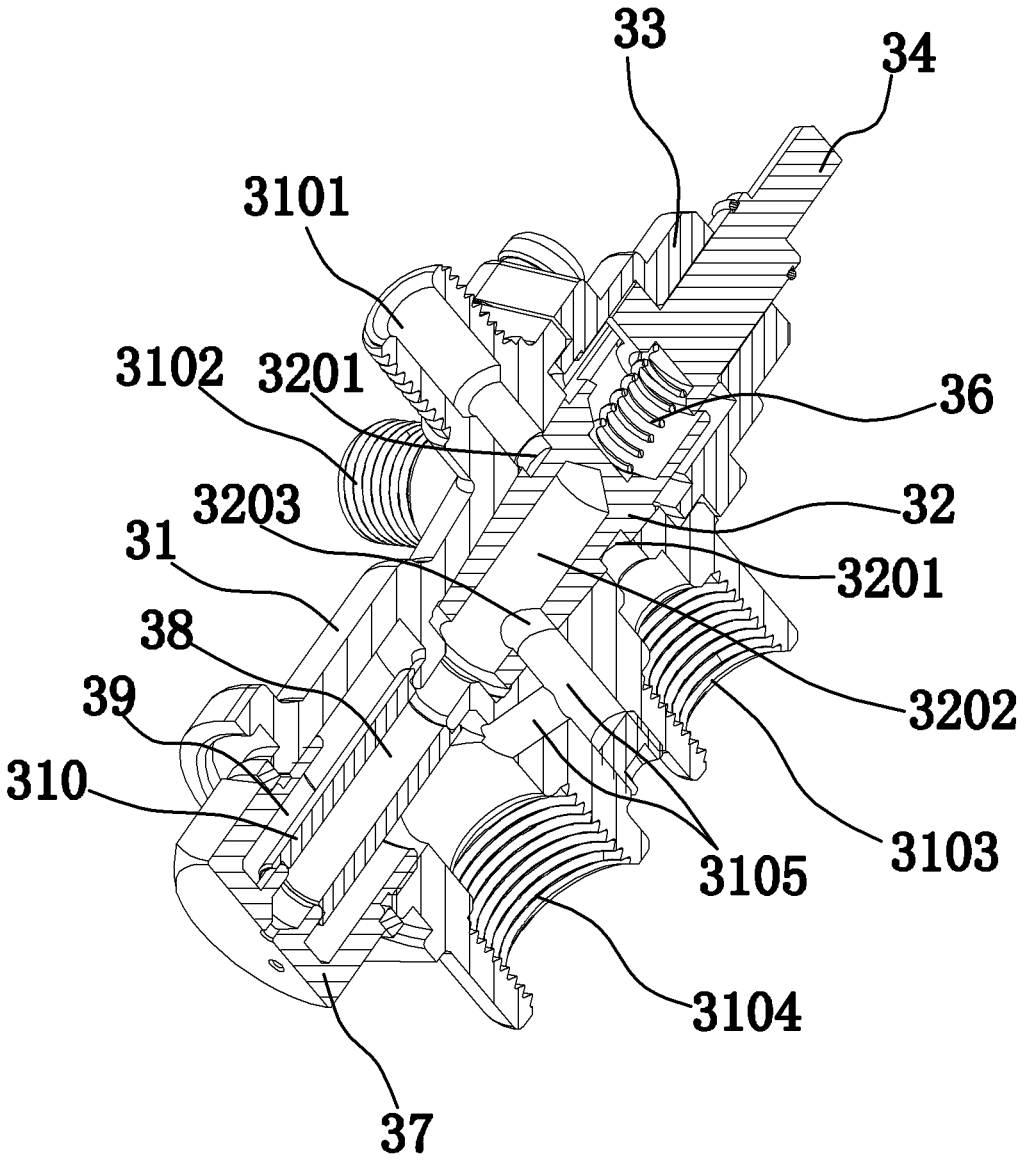
FIG. 20 provides a schematic cross-sectional view of a manual-type gas path conversion valve from an angle according to an embodiment of the disclosure.
Figure 21:
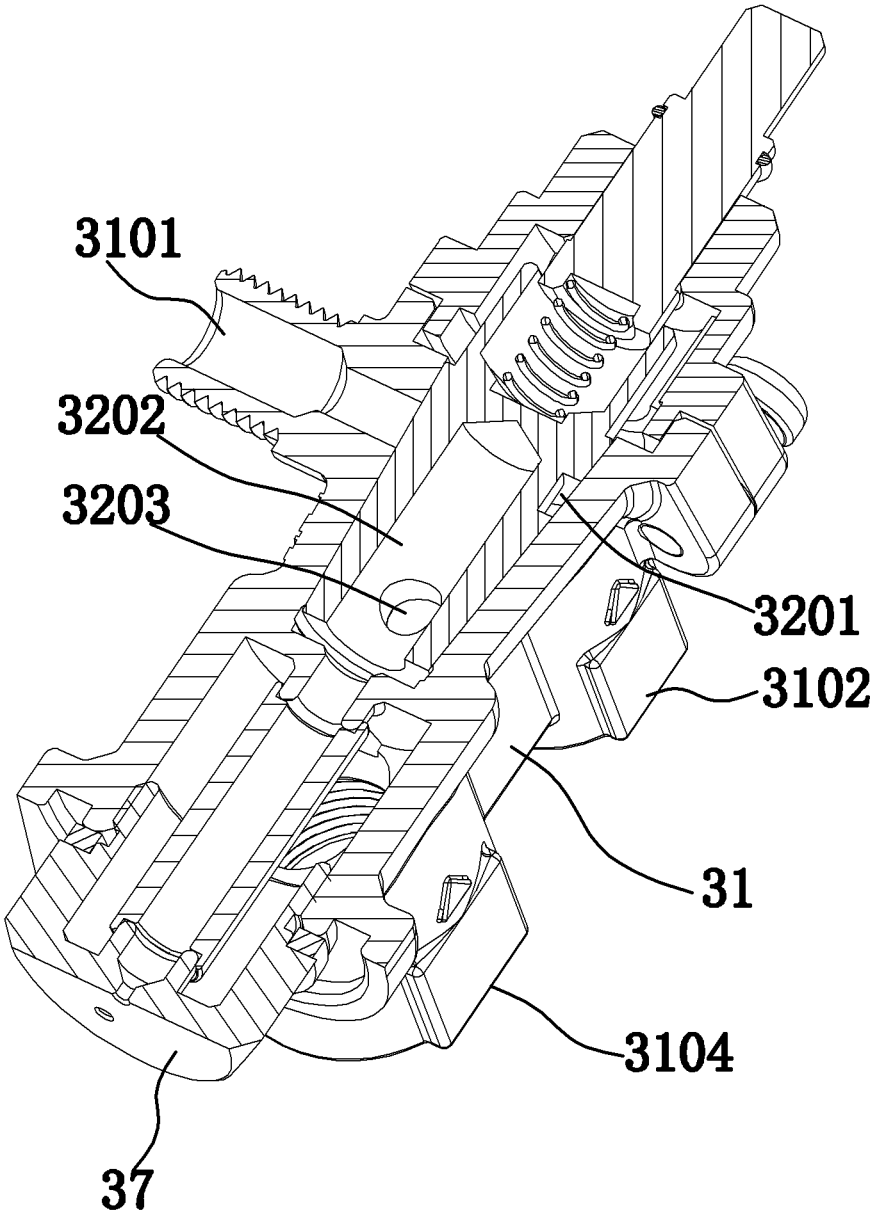
FIG. 21 provides a schematic cross-sectional view of the manual-type gas path conversion valve from another angle according to an embodiment of the disclosure.
Figure 22:
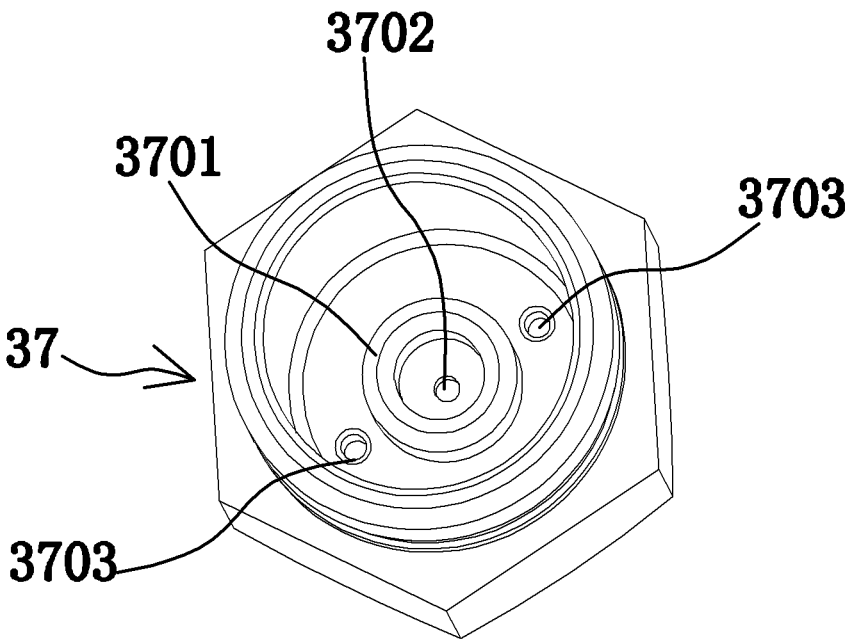
FIG. 22 provides a schematic structural view of a double gas nozzle on the manual-type gas path conversion valve from an angle according to an embodiment of the disclosure.
Figure 23:
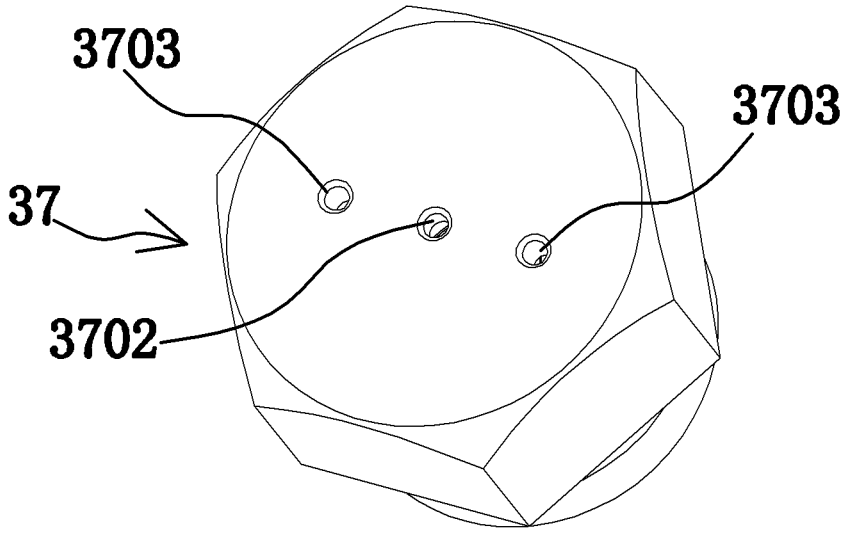
FIG. 23 provides a schematic structural view of the double gas nozzle on the manual-type gas path conversion valve from another angle according to an embodiment of the disclosure.
Figure 24:
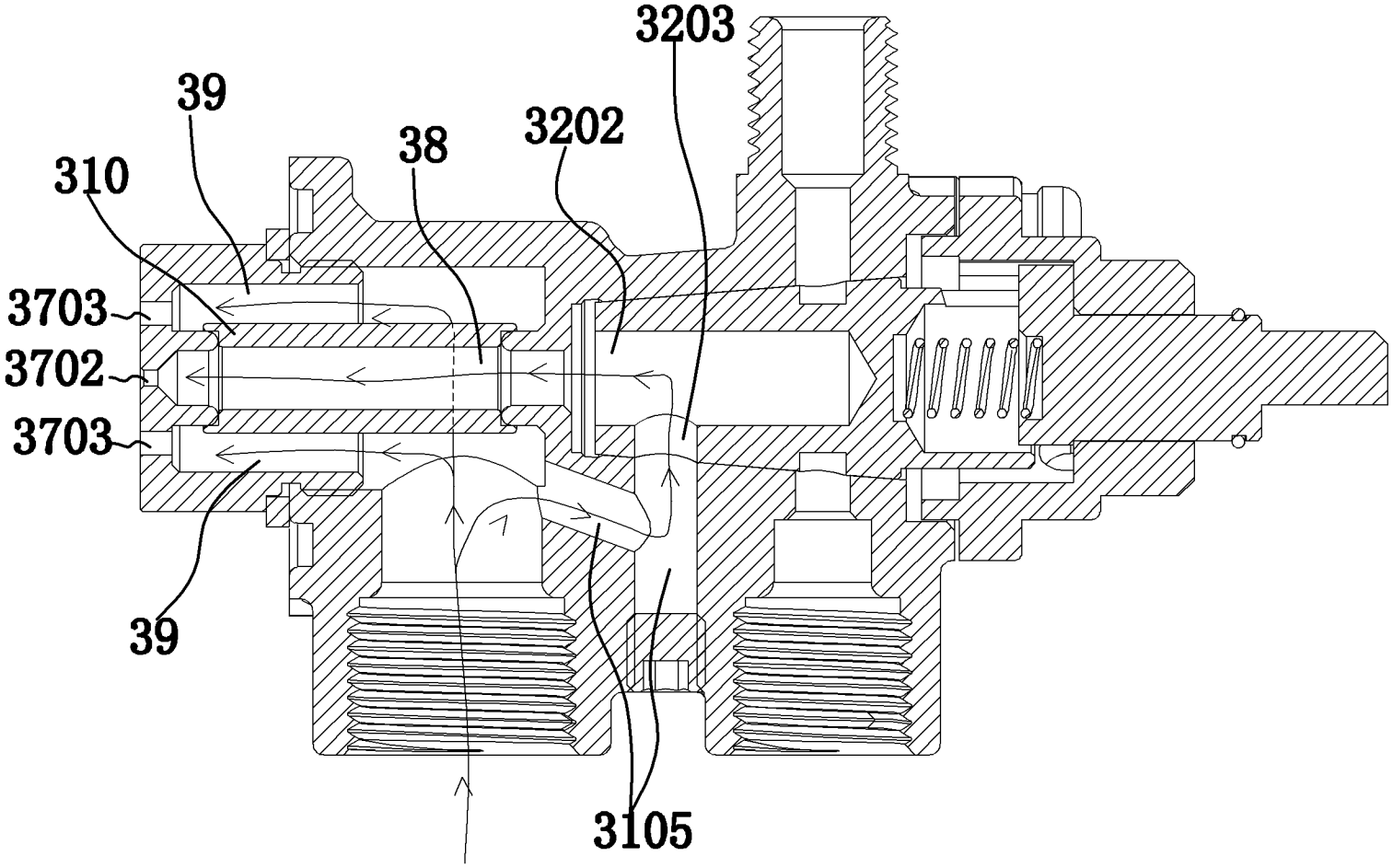
FIG. 24 provides a schematic structural view of transmission of low calorific value gas on the manual-type gas path conversion valve according to an embodiment of the disclosure.
Figure 25:
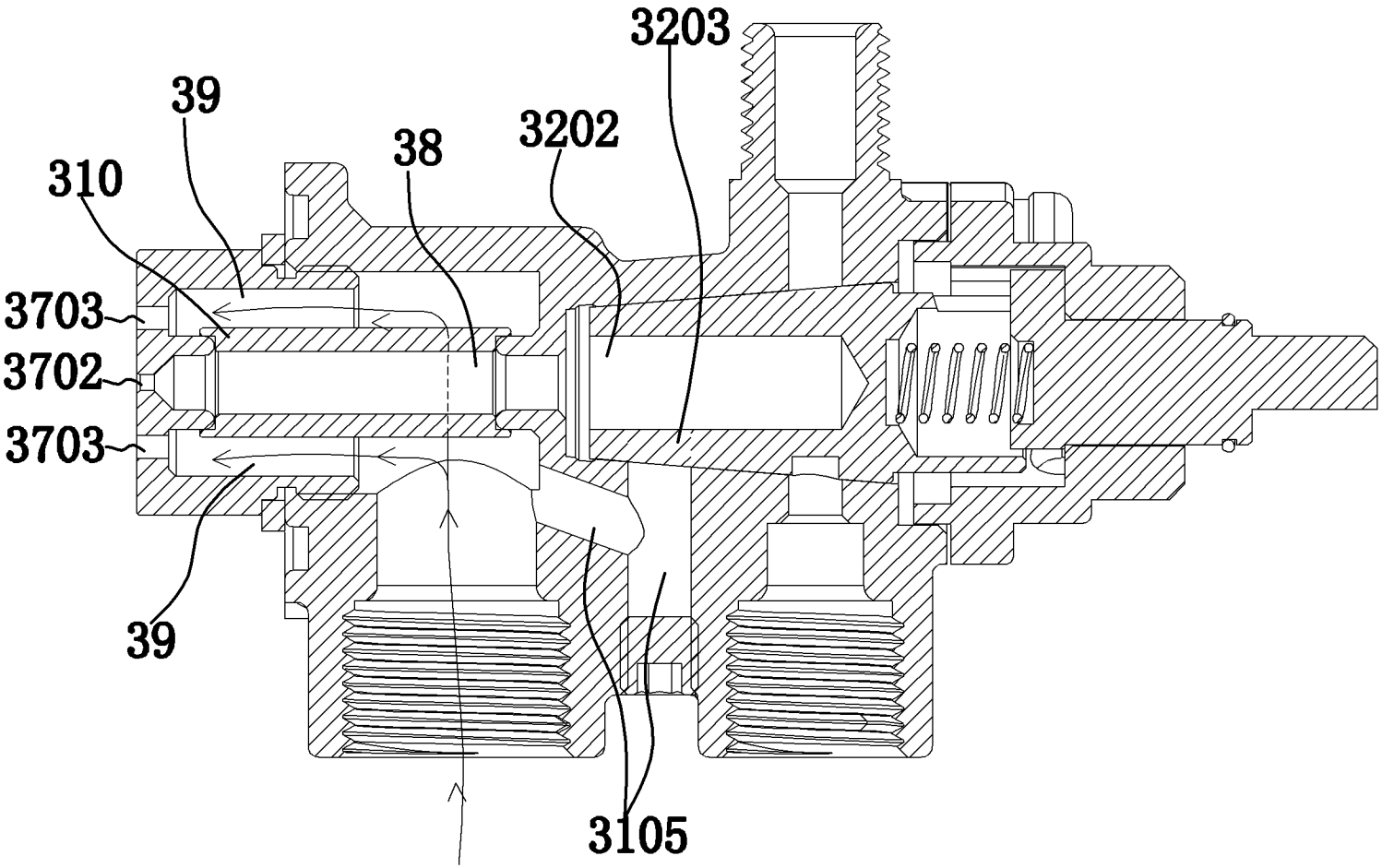
FIG. 25 provides a schematic structural view of transmission of high calorific value gas on the manual-type gas path conversion valve according to an embodiment of the disclosure.
Figure 26:
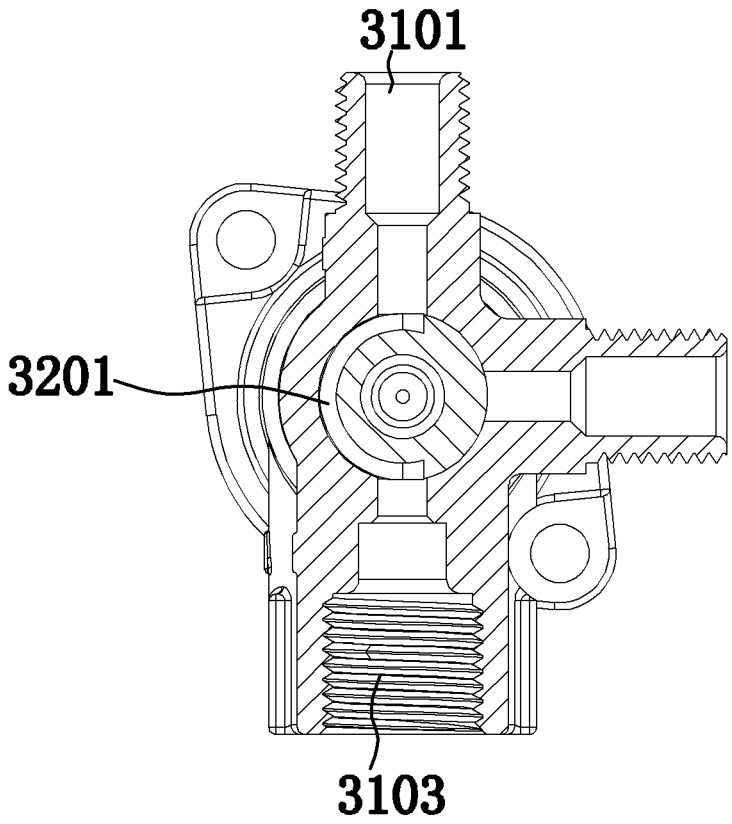
FIG. 26 provides a schematic cross-sectional view when a low calorific value lighter device outlet and a gas lighter gas path inlet on the manual-type gas path conversion valve are communicated according to an embodiment of the disclosure.
Figure 27:
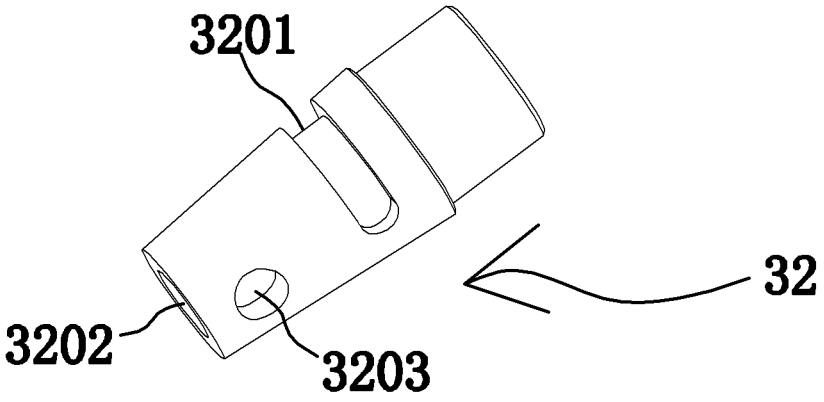
FIG. 27 provides a schematic structural view of a spool on the manual-type gas path conversion valve according to an embodiment of the disclosure.
Figure 28:
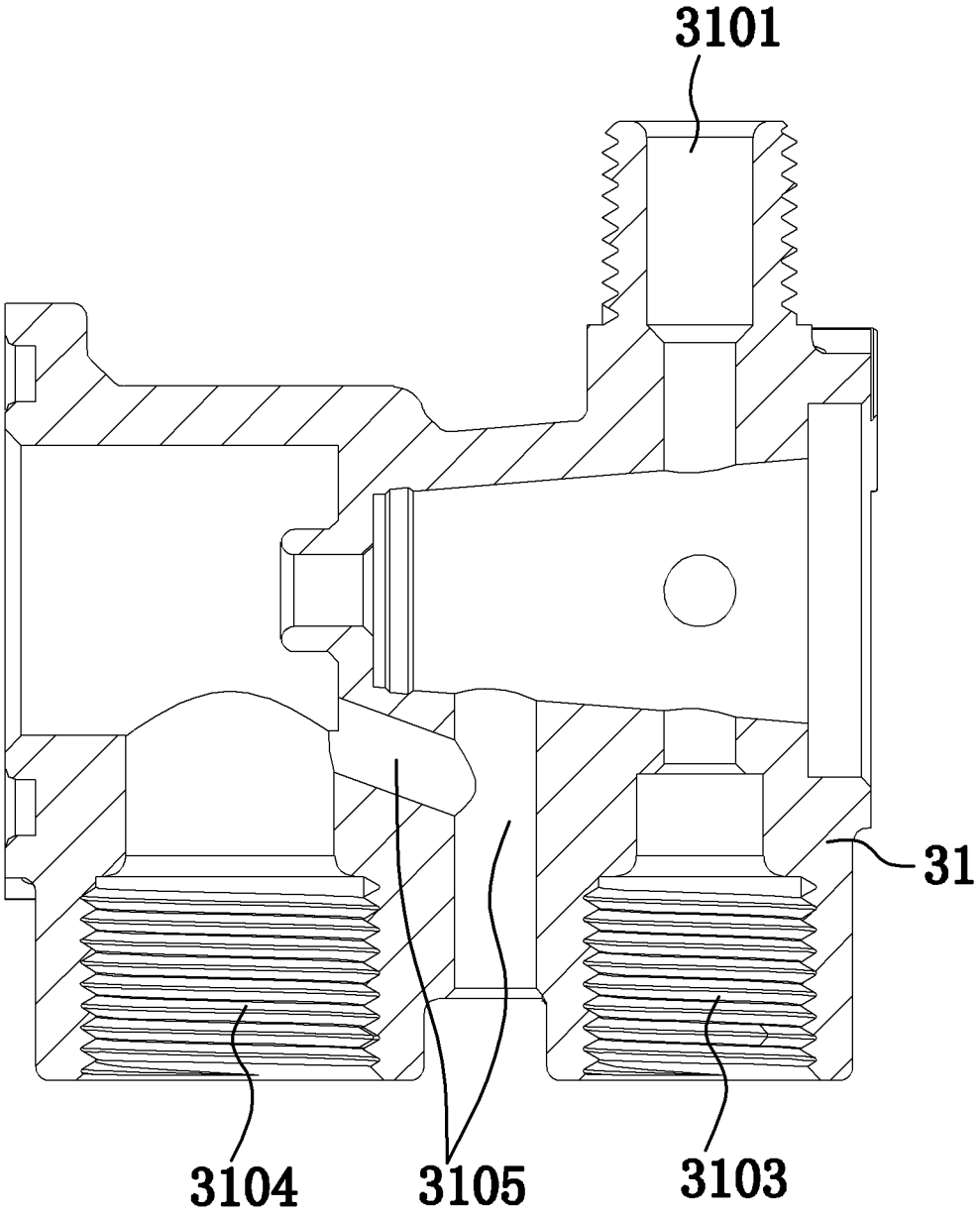
FIG. 28 provides a schematic cross-sectional view of a main inlet, the low calorific value lighter device outlet, and the gas lighter gas path inlet on a valve body on the manual-type gas path conversion valve according to an embodiment of the disclosure.
Figure 29:
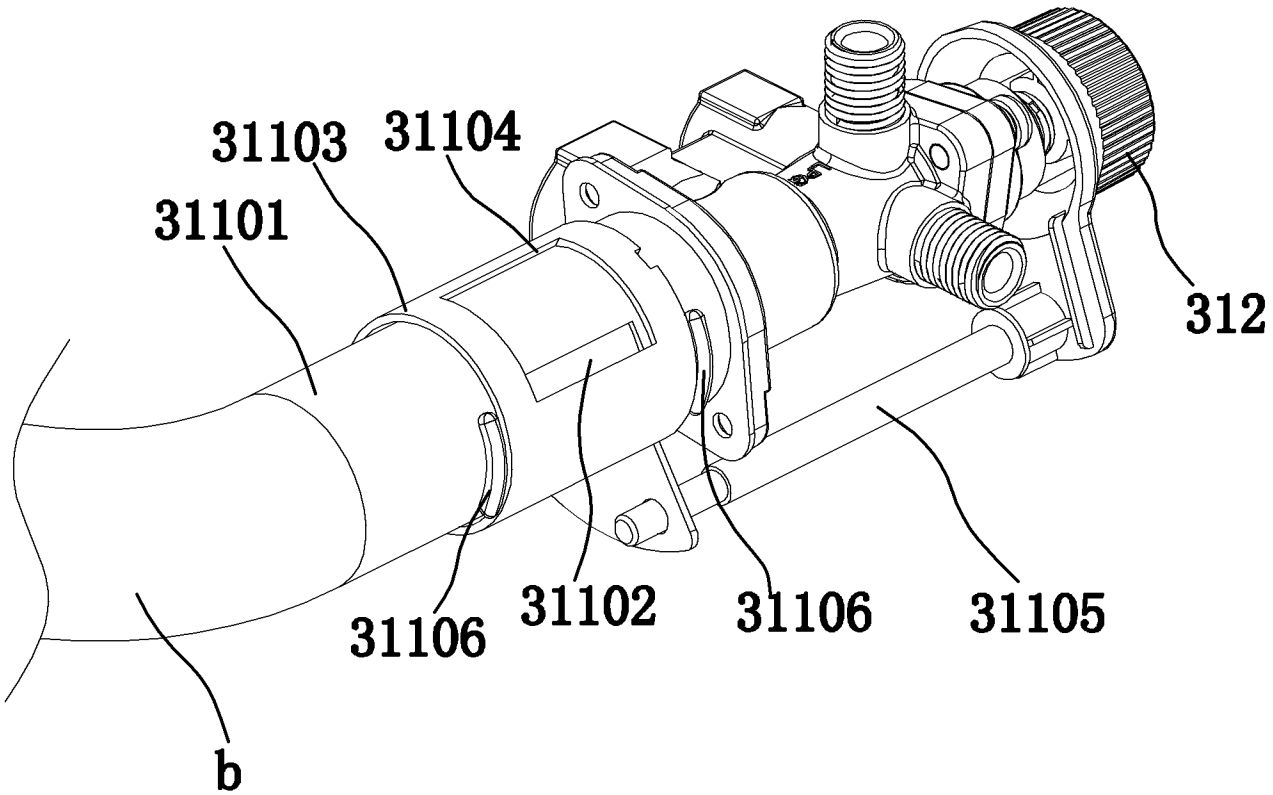
FIG. 29 provides a schematic cross-sectional view of a state of a damper regulation structure when the low calorific value gas is introduced in the main inlet on the manual-type gas path conversion valve according to an embodiment of the disclosure.
Figure 30:
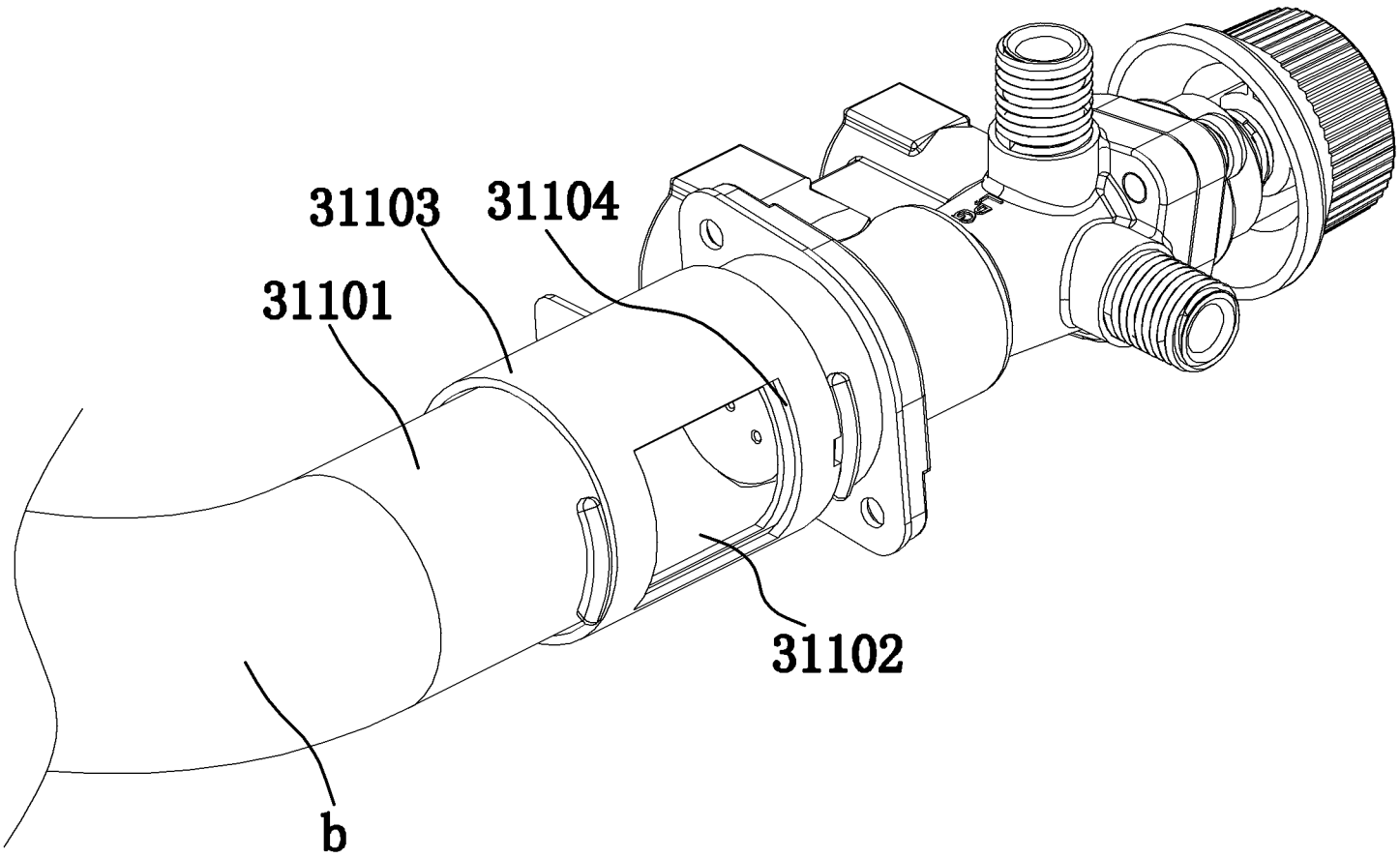
FIG. 30 provides a schematic cross-sectional view of a state of a damper regulation structure when the high calorific value gas is introduced in the main inlet on the manual-type gas path conversion valve according to an embodiment of the disclosure.

As shown in FIG. 19, when the gas path conversion valve 3 is an electronically controlled gas path conversion valve, a structure thereof includes a main gas channel switching solenoid valve 401 respectively communicated with one input end communicating with the main gas path 108, one output end communicating with the first main gas nozzle mouth 108*a*, and one output end communicating with the second main gas nozzle mouth 108*b*. Whether gas introduced from the input end is simultaneously introduced to the two output ends or is only introduced to one output end communicating with the first main gas nozzle mouth 108*a* is determined according to a gas calorific value. An ignition gas channel switching solenoid valve 402 is further provided and is communicated with one input end communicating with the ignition gas path 109, one output end communicating with the low calorific value ignition gas path 109*a*, and one output end communicating with the high calorific value ignition gas path 109*b*. Whether gas introduced from the input end is introduced to one output end communicating with the low calorific value ignition gas path 109*a* or is introduced to one output end communicating with the high calorific value ignition gas path 109*b* is determined according to a gas calorific value. Each of the low calorific value voltage regulator valve 101 and the high calorific value voltage regulator valve 102 is a switch voltage regulator valve for switching. The low calorific value voltage regulator valve 101 includes a low calorific value voltage regulator switching switch S2, and the high calorific value voltage regulator valve 102 includes a high calorific value voltage regulator switching switch S3. In this way, the gas path conversion valve 3 may automatically achieve gas path conversion according to whether the low calorific value voltage regulator switching switch S2 or the high calorific value voltage regulator switching switch S3 is switched off. Gas path conversion is not required to be manually performed through manually rotating the knob 312 on the gas path conversion valve 312 when the system is installed, so that automation is improved, user may enjoy a convenient using experience, and errors caused by manual operation are also greatly reduced.

As shown in FIG. 6 to FIG. 10, another dual-gas source gas control system with anti-gas source misconnection provided by the disclosure includes a low calorific value voltage regulator valve 101 and a high calorific value voltage regulator valve 102. An input end and an output end of the low calorific value voltage regulator valve 101 are respectively communicated with a low calorific value gas path 103 configured for transmitting a low calorific gas source, and an input end and an output end of the high calorific value voltage regulator valve 102 are respectively communicated with a high calorific value gas path 104 configured for transmitting a high calorific gas source. A switch control valve 105 acting as a master switch configured for controlling a gas path to be cut off is provided and is provided with a first solenoid valve 106 configured for controlling the switch control valve 105 to be turned on or turned off. Two input ends are provided, wherein one input end is connected to the low calorific value voltage regulator valve 101 through the low calorific value gas path 103, and the other input end is connected the high calorific value voltage regulator valve 102 through the high calorific value gas path. Two output ends are further provided and are respectively communicated with a main gas path 108 and an ignition gas path 109 one by one. A gas path conversion valve 3 includes two input ends are provided, wherein one input end is connected to an output end communicating with the main gas path 108 on the switch control valve 105, and the other input end is connected to an output end communicating with the ignition gas path 109 on the switch control valve 105. Four output ends are further provided, wherein the four output ends are respectively communicated with a low calorific value ignition gas path 109*a* leading to a low calorific value gas ignition device, a high calorific value ignition gas path 109*b* leading to a high calorific value gas ignition device, and a first main gas nozzle mouth 108*a* and a second main gas nozzle mouth 108*b* leading to a main burner 107 one by one. A high calorific value gas internal path, a low calorific value gas internal path, and a knob or a switch configured for switching between the high calorific value gas internal path and the low calorific value gas internal path are further provided. The low calorific value gas internal path is respectively communicated with low calorific value ignition gas path 109*a*, the first main gas nozzle mouth 108*a*, and a second main gas nozzle mouth 108*b*, and the high calorific value gas internal path is respectively communicated with the high calorific value ignition gas path 109*b* and the first main gas nozzle mouth 108*a*. The main burner 107 is provided, wherein an input end thereof are disposed corresponding to the first main gas nozzle mouth 108*a* and the second main gas nozzle mouth 108*b* on the gas path conversion valve 3, so that gas emitted from the first main gas nozzle mouth 108*a* and the second main gas nozzle mouth 108*b* directly enters an input end of the main burner 107, and a burner required by high calorific value gas and low calorific value gas to burn normally is disposed at an outer side. The low calorific value gas ignition device is provided and includes a low calorific value gas lighter 111 near the burner required for burning of the low calorific value gas on the main burner 107 and a low calorific value gas ignition needle 112 and a low calorific value gas thermocouple 113 disposed nearby. The low calorific value gas lighter 111 is connected to a corresponding output end on the gas path conversion valve 3 through the low calorific value ignition gas path 109*a*. The high calorific value gas ignition device is provided and includes a high calorific value gas lighter 114 near the burner required for burning of the high calorific value gas on the main burner 107 and a high calorific value gas ignition needle 115 and a high calorific value gas thermocouple 116 disposed nearby. The high calorific value gas lighter 114 is connected to a corresponding output end on the gas path conversion valve 3 through the high calorific value ignition gas path 109*b*. An igniter 117 is provided and is electrically connected to the low calorific value gas ignition needle 112 and the high calorific value gas ignition needle 115 respectively. Further, the system also includes a flame sensor 118 disposed at one side near the low calorific value gas thermocouple 113 and away from the low calorific value gas lighter 111 and is configured for detecting a flame signal. The igniter 117 further includes a power supply 119 and an error-proof control circuit 200 electrically connected thereto. The error-proof control circuit 200 is the control circuit according to any one of claims 1 to 6. The control circuit is electrically connected to the flame sensor 118. After an igniter switch 120 on the igniter 117 is pressed, electricity provided by the power supply 119 is transmitted to the connected control circuit, and the control circuit begins to function and receive the flame signal sent from the flame sensor 118. An anode of the low calorific value gas thermocouple 113 is connected to an anode of the high calorific value gas thermocouple 116, a cathode of the low calorific value gas thermocouple 113 and a cathode of the high calorific value gas thermocouple 116 are connected to form a thermocouple parallel circuit, and an anode and a cathode of the thermocouple parallel circuit are electrically connected to an anode and a cathode of the first solenoid valve 106 respectively one by one. The low calorific value gas thermocouple 113 generates an electric potential after being burned by ignited gas, so as to continuously supply power to the first solenoid valve 106 in the switch control valve 105, so that the first solenoid valve 106 stays in a closed state and the gas path continues to be turned on. An on/off valve 122 is disposed on the low calorific value ignition gas path 109*a* between output ends corresponding to the low calorific value gas lighter 111 on the low calorific value gas lighter 111 and the gas path conversion valve 3 and includes a second solenoid valve 123 configured for controlling connection and cutting off of the low calorific value ignition gas path 109*a*. An anode and a cathode of the second solenoid valve 123 are electrically connected to an anode output level and a cathode output level on the control circuit one by one. When the control circuit detects the flame signal from the flame sensor 118 indicating that the high calorific value gas is misconnected to the low calorific value gas lighter 111, electrical levels outputted from the anode output level and the cathode output level are both zero. The second solenoid valve 123 on the on/off valve 122 is not closed to prevent gas in the low calorific value ignition gas path 109*a* from entering the low calorific value gas lighter 111. A gas flame is reduced until being put out without burning the low calorific value gas thermocouple 113, such that the low calorific value gas thermocouple 113 cannot continuously supply power to the first solenoid valve 106 in the switch control valve 105. The first solenoid valve 106 which does not receive power supply on the switch control valve 105 is not closed to prevent external gas from entering the gas path in the system through the switch control valve 105.

Specifically, an over voltage protection device 121 is disposed on the low calorific value ignition gas path 109*a* between the output ends corresponding to the low calorific value gas lighter 111 on the low calorific value gas lighter 111 and the gas path conversion valve 3. When the high calorific value gas is mistakenly introduced to the low calorific value gas lighter 111 after passing through the high calorific value voltage regulator valve 102, or when the low calorific value gas is mistakenly passes through the high calorific value gas voltage regulator valve 102 and is introduced to the low calorific value gas lighter 111, since the pressure of the gas in the low calorific value ignition gas path 109*a* exceeds a pressure preset by the over voltage protection device 121, the over voltage protection device 121 automatically closes the gas path at this moment, so no gas enters the low calorific value gas lighter 111, and the system does not function.

Further, the gas path conversion valve 3 herein may be a manual gas path conversion valve and may also be an electronically controlled gas path conversion valve. The specific structure is identical to the gas path conversion valve 3 in a dual-gas source gas control system with anti-gas source misconnection provided by the disclosure. When the gas path conversion valve 3 is an electronically controlled gas path conversion valve, each of the low calorific value voltage regulator valve 101 and the high calorific value voltage regulator valve 102 is required to be a switch voltage regulator valve for switching. That is, the low calorific value voltage regulator valve 101 is required to include a low calorific value voltage regulator switching switch S2, and the high calorific value voltage regulator valve 102 is required to include a high calorific value voltage regulator switching switch S3.

The specific embodiments described herein are merely illustrative of the spirit of the disclosure. A person of ordinary skill in the art may make various modifications or additions to the described specific embodiments or make replacement in a similar manner, but such modification should not depart from the spirit of the disclosure or go beyond the scope defined by the appended claims.

The following technical terms are used in the specification most of the time, including: the low calorific value voltage regulator valve 101, the high calorific value voltage regulator valve 102, the low calorific value gas path 103, the high calorific value gas path 104, the switch control valve 105, the first solenoid valve 106, the main burner 107, the main gas path 108, the first main gas nozzle mouth 108*a*, the second main gas nozzle mouth 108*b*, the ignition gas path 109, the low calorific value ignition gas path 109*a*, the high calorific value ignition gas path 109*b*, the low calorific value gas lighter 111, the low calorific value gas ignition needle 112, the low calorific value gas thermocouple 113, the high calorific value gas lighter 114, the high calorific value gas ignition needle 115, the high calorific value gas thermocouple 116, the igniter 117, the flame sensor 118, the power supply 119, the igniter switch 120, the over voltage protection device 121, the on/off valve 122, the second solenoid valve 123, the error-proof control circuit 200, the power-on circuit 201, the boost circuit 202, the alarm circuit 203, and the gas path conversion valve 3. Other technical terms may also be used. These technical terms are used only to conveniently describe and explain the nature of the disclosure, and interpretation of the terms as any additional limitation is contrary to the spirit of the disclosure.

What is claimed is:

1. A control circuit, comprising:

a power-on circuit, connected in series with an external power supply and an igniter switch to form a loop, comprising a self-locking switch triode connected in series with the external power supply and a self-locking amplifying triode connected to a base electrode of the self-locking switch triode;

an MCU control circuit, comprising an MCU control chip, wherein the power-on circuit is connected to a power input pin of the MCU control chip, one pin on the MCU control chip is configured to detect whether the power-on circuit is connected, another pin on the MCU control chip is connected to a base electrode of the self-locking amplifying triode in the power-on circuit to be configured to send a driving signal to drive the self-locking amplification triode in the power-on circuit to be turned on when the power-on circuit is detected to be connected, so that the self-locking switch triode and the self-locking amplifying triode are turned on to form self-locking and maintain a power-on state;

a pulse ignition circuit, comprising an oscillating loop powered by the power-on circuit, wherein the oscillating loop generates an inducted ignition high voltage and discharges to an outside through an external low calorific value gas ignition needle and a high calorific value gas ignition needle connected thereto, and one pin on the MCU control chip sends a control signal to control magnitude of an oscillating voltage of the oscillating loop;

a gas misconnection flame detection circuit, comprising a comparator powered by the power-on circuit and configured for receiving a flame signal sent from an external flame sensor, wherein a voltage signal generated by the flame sensor is transmitted to one input pin of the comparator, the flame signal is outputted from an output pin of the comparator to a base electrode of a detection amplifying triode connected to the comparator, the flame signal passing through the detection amplifying triode is transmitted onto the MCU control chip through an input pin on the MCU control chip that is connected to the detection amplification triode and that is configured for receiving the flame signal, the flame sensor generates a negative voltage signal to the input pin configured for receiving the flame signal on the comparator when a high calorific value gas is misconnected to a low calorific value gas lighter, the output pin configured for outputting the flame signal on the comparator outputs a high electrical level to the base electrode of the detection amplifying triode, the detection amplifying triode transmits the amplified flame signal to the input pin configured for receiving the flame signal on the MCU control chip, after an output pin on the MCU control chip that is configured for sending a driving signal for driving a gas path to be cut off receives the flame signal indicating misconnection, the output pin sends the driving signal configured for driving the gas path to be cut off to an external corresponding gas path on/off control device, and a cutting off operation of a first solenoid valve in a switch control valve is controlled by the gas path on/off control device.

2. The control circuit according to claim 1, wherein the output pin on the MCU control chip configured for transmitting the driving signal for driving the gas path to be cut off is disposed on a wire of opposite polarity to the output pin in two wires connected an external thermocouple parallel circuit and the external first solenoid valve wherein the thermocouple parallel circuit is formed by a connection between an anode of a low calorific value gas thermocouple and an anode of a high calorific value gas thermocouple and a connection between a cathode of the low calorific value gas thermocouple and a cathode of the high calorific value gas thermocouple, the output pin on the MCU control chip outputs a voltage of polarity opposite to an output voltage of the thermocouple parallel circuit when the input pin of the MCU control chip connected to the gas misconnection flame detection circuit detects that the high calorific value gas is misconnected to the low calorific value gas lighter, so that current balancing is instantly and forcibly performed to a thermoelectric potential generated by the fired low calorific value gas thermocouple or the voltage is set to zero, such that the thermoelectric potential which keeps the first solenoid valve on the switch control valve to be closed is lost, and the first solenoid valve is not closed to prevent external gas from entering the gas path of a dual-gas source gas control system through the switch control valve.

3. The control circuit according to claim 1, wherein a pair of anode and cathode power output pins configured for transmitting the driving signal for driving the gas path to be cut off on the MCU control chip is electrically connected to the external low calorific value gas lighter and a second solenoid valve in an on/off valve on a low calorific value ignition gas path between output ends corresponding to the low calorific value gas lighter on a gas path conversion valve through a motor control driver chip, when the input pin connected to the gas misconnection flame detection circuit on the MCU control chip detects that the high calorific value gas is misconnected to the low calorific value gas lighter, the pair of anode and cathode power output pins outputs the driving signal for driving the gas path to be cut off, such that the second solenoid valve which is being closed on the on/off valve is instantly opened, so that the low calorific value ignition gas path is turned off, a gas flame is reduced until being put out without burning the low calorific value gas thermocouple, such that the low calorific value gas thermocouple cannot continuously supply power to the first solenoid valve in the switch control valve, and the first solenoid valve in the switch control valve without receiving power supply is not closed to prevent external gas from entering the gas path in a dual-gas source gas control system through the switch control valve.

4. The control circuit according to claim 1, further comprising a boost circuit connected to the power-on circuit and comprising a boost chip and an inductor, wherein a power output pin of the boost chip transmit a boosted voltage to any one or a plurality of the MCU control circuit, the pulse ignition circuit and the gas misconnection flame detection circuit.

5. The control circuit according to claim 1, further comprising an alarm circuit comprising a buzzer and an alarm amplifying triode, wherein a base electrode of the alarm amplifying triode receives an alarm signal sent from an output pin on the MCU control chip.

6. The control circuit according to claim 1, further comprising an electronically controlled conversion valve control circuit, comprising a first valve driving chip configured for driving a main gas channel switching solenoid valve in an external electronically controlled gas path conversion valve, and a second valve driving chip configured for controlling and driving an ignition gas channel switching solenoid valve in the external electronically controlled gas path conversion valve, wherein the first valve driving chip and the second valve driving chip respectively receive valve control information sent from the MCU control chip, two pins in the MCU control chip are respectively connected in series with a low calorific value voltage regulator switching switch in an external low calorific value voltage regulator valve and a high calorific value voltage regulator switching switch in a high calorific value voltage regulator valve, and the MCU control chip sends the corresponding valve control information to the first valve driving chip and the second valve driving chip when receiving information on the low calorific value voltage regulator switching switch or the high calorific value voltage regulator switching switch being in a closed state.

7. A dual-gas source gas control system with anti-gas source misconnection, the dual-gas source gas control system comprising:

a low calorific value voltage regulator valve and a high calorific value voltage regulator valve, wherein an input end and an output end of the low calorific value voltage regulator valve are respectively connected to a low calorific value gas path) configured for transmitting a low calorific gas source, and an input end and an output end of the high calorific value voltage regulator valve are respectively connected to a high calorific value gas path configured for transmitting a high calorific gas source;

a switch control valve, acting as a master switch configured for controlling a gas path to be cut off, provided with a first solenoid valve configured for controlling the switch control valve to be turned on or turned off, comprising two input ends, wherein one of the input ends is connected to the low calorific value voltage regulator valve through the low calorific value gas path, and the other one of the input ends is connected the high calorific value voltage regulator valve through the high calorific value gas path, and further comprising two output ends respectively connected to a main gas path and an ignition gas path one by one;

a gas path conversion valve comprising two input ends, wherein one of the input ends is connected to the output end of the switch control valve communicating with the main gas path, and the other one of the input ends is connected to the output end of the switch control valve communicating with the ignition gas path, further comprising four output ends, wherein the four output ends are respectively communicated with a low calorific value ignition gas path leading to a low calorific value gas ignition device, a high calorific value ignition gas path leading to a high calorific value gas ignition device, and a first main gas nozzle mouth and a second main gas nozzle mouth leading to a main burner one by one, and further comprising a high calorific value gas internal path and a low calorific value gas internal path, wherein the low calorific value gas internal path is respectively communicated with low calorific value ignition gas path, the first main gas nozzle mouth and a second main gas nozzle mouth, and the high calorific value gas internal path is respectively communicated with the high calorific value ignition gas path and the first main gas nozzle mouth;

the main burner, wherein an input end thereof are disposed corresponding to the first main gas nozzle mouth and the second main gas nozzle mouth on the gas path conversion valve, so that gas emitted from the first main gas nozzle mouth and the second main gas nozzle mouth directly enters the input end of the main burner, and a burner opening required by high calorific value gas and low calorific value gas to burn normally is disposed at an outer side of the main burner;

the low calorific value gas ignition device, comprising a low calorific value gas lighter near the burner opening required for burning of the low calorific value gas on the main burner, a low calorific value gas ignition needle and a low calorific value gas thermocouple disposed adjacent to the low calorific value gas lighter, wherein the low calorific value gas lighter is connected to a corresponding output end on the gas path conversion valve through the low calorific value ignition gas path;

the high calorific value gas ignition device, comprising a high calorific value gas lighter near the burner opening required for burning of the high calorific value gas on the main burner and a high calorific value gas ignition needle and a high calorific value gas thermocouple disposed adjacent to the high calorific value gas lighter, wherein the high calorific value gas lighter is connected to a corresponding output end on the gas path conversion valve through the high calorific value ignition gas path;

an igniter, electrically connected to the low calorific value gas ignition needle and the high calorific value gas ignition needle respectively;

the dual-gas source gas control system further comprises:

a flame sensor disposed at one side near the low calorific value gas thermocouple and away from the low calorific value gas lighter, and configured for detecting a flame signal;

wherein the igniter is provided with a power supply and an error-proof control circuit electrically connected thereto, the error-proof control circuit is the control circuit according to claim 1, the control circuit is electrically connected to the flame sensor, after an igniter switch on the igniter is pressed, electricity is transmitted to the connected control circuit, and the control circuit begins to function and receive the flame signal sent from the flame sensor;

wherein an anode of the low calorific value gas thermocouple is connected to an anode of the high calorific value gas thermocouple, a cathode of the low calorific value gas thermocouple and a cathode of the high calorific value gas thermocouple are connected to form a thermocouple parallel circuit, an anode and a cathode of the thermocouple parallel circuit are electrically connected to an anode and a cathode of the first solenoid valve respectively one by one, one output end of the control circuit is disposed on one wire of opposite polarity to the output end in two wires connecting the thermocouple parallel circuit and the first solenoid valve when the control circuit detects the flame signal from the flame sensor indicating that the high calorific value gas is misconnected to the low calorific value gas lighter, the output end outputs a voltage of opposite polarity to an output voltage outputted by the thermocouple parallel circuit, so that current balancing is instantly and forcibly performed to a thermoelectric potential generated by the fired low calorific value gas thermocouple or the voltage is set to zero, the first solenoid valve in the switch control valve without receiving power supply is not closed to prevent external gas from entering the gas path in the system through the switch control valve.

8. The dual-gas source gas control system with anti-gas source misconnection according to claim 7, wherein an over voltage protection device is disposed on the low calorific value ignition gas path between the output ends corresponding to the low calorific value gas lighter on the low calorific value gas lighter and the gas path conversion valve.

9. The dual-gas source gas control system with anti-gas source misconnection according to claim 7, wherein the gas path conversion valve is a manual gas path conversion valve and comprises:

a valve body, wherein an outer periphery of the valve body is provided with an internally-communicated low calorific value gas lighter outlet, a high calorific value gas lighter outlet, a gas lighter gas path inlet and a main inlet;

a spool, provided and disposed in the valve body, wherein a connection groove is disposed on an outer periphery of the spool, the spool rotates so that the connection groove is communicated with the low calorific value gas lighter outlet and the gas lighter gas path inlet or is communicated with the high calorific value gas lighter outlet and the gas lighter gas path inlet;

a valve seat, provided and disposed on an upper end of the valve body, wherein a valve rod is slidably inserted into the valve seat, an upper end of the valve rod exposes out of the valve seat, a lower end of the valve rod is loosely connected to the other end of a connection rotation shaft with one end disposed on the spool, the connection rotation shaft is sleeved with a reset spring for resetting the valve rod after operation; and a double gas nozzle, communicated with the main inlet and disposed at an lower end of the valve body, a circle-shaped barrier is protruded at an inner side of the double gas nozzle, at least one in-circle nozzle mouth merely for the low calorific value gas to be emitted is provided in the circle-shaped barrier on the double gas nozzle, at least one outer nozzle mouth for the low calorific value gas or the high calorific value gas to be emitted is disposed between an outer periphery of the double gas nozzle and the circle-shaped barrier, the first main gas nozzle mouth is the outer nozzle mouth, and the second main gas nozzle mouth is the in-circle nozzle mouth, an inner gas transfer chamber for merely the low calorific value gas to enter and an outer gas transfer chamber surrounding an outer periphery of the inner gas transfer chamber for the low calorific value gas or the high calorific value gas to enter are respectively formed when the double gas nozzle and the valve body are connected, the inner gas transfer chamber is communicated with the in-circle nozzle mouth, and the outer gas transfer chamber is communicated with the outer nozzle mouth; a spool through hole assembly is disposed on the spool, two ends of the spool through hole assembly are respectively communicated with the inner gas transfer chamber and a low gas transfer channel communicated with the main inlet and disposed on the valve body in a sealed manner, and the low calorific value gas is introduced in or the high calorific value gas is prevented from entering the inner gas transfer chamber through rotation of the spool, so that an effective gas-intake cross-sectional area corresponding to requirement from the high and low calorific value gas on the double gas nozzle is adjusted.

10. The dual-gas source gas control system with anti-gas source misconnection according to claim 9, wherein the spool through hole assembly comprises a first spool hole axially disposed near an end of the double gas nozzle on the spool, the first spool hole is communicated with the inner gas transfer chamber in a sealed manner, a second spool hole communicating with the first spool hole is disposed at an outer side of the spool, the second spool hole is communicated with the low gas transfer channel in a sealed manner; the spool is tapered, the spool matches a size and a shape of a space in the valve body accommodating the spool, a low calorific value gas limitation groove and a high calorific value gas limitation groove are disposed in the valve seat in a high and low manner and in a misaligned arrangement, a boss is disposed on the valve rod, the valve rod downwardly moves so that the valve rod passes the connection rotation shaft to drive the spool to rotate to switch the ignition device gas paths between the high and low calorific value gas, the boss is engaged in a corresponding limitation groove so that the valve rod is positioned; the connection groove has a sector structure with an angle of 180 degrees, the low calorific value gas lighter outlet and the gas lighter gas path inlet are located on a same center line, a center line of the high calorific value gas lighter outlet and a center line of the low calorific value gas lighter outlet are in a same plane; a damper regulation structure for regulating gas intake in a gas main tube is disposed between an outer end of the double gas nozzle and the gas main tube connected to an outer portion of the main burner, and one end of the damper regulation structure is connected to an outer end of the valve rod.

11. The dual-gas source gas control system with anti-gas source misconnection according to claim 10, wherein a first connection short tube is disposed between the circle-shaped barrier and the valve body in a sealed manner for transferring the low calorific value gas; the double gas nozzle and the circle-shaped barrier are integrally connected in one piece; the damper regulation structure comprises a second connection short tube disposed between the main burner and the external gas main tube in a sealed manner, a first damper for air to enter is disposed at one side of the second connection short tube, a rotation barrel having a size and a shape matched with that of the second connection short tube is disposed at an outer periphery of the second connection short tube, a second damper corresponding to the first damper is disposed on the rotation barrel, a damper linking rod capable of driving the rotation barrel and the valve rod to simultaneously rotate is disposed between the rotation barrel and the valve rod; at least a pair of axial limitation ribs for limiting the rotation barrel to move in an axial direction of the second connection short tube protrudes from an outer side of the second connection short tube; connection between the damper linking rod and the rotation barrel and connection between the damper linking rod and the valve rod are detachable; a knob is disposed at an outer end of the valve rod, and the knob is connected to the damper linking rod.

12. The dual-gas source gas control system with anti-gas source misconnection according to claim 7, wherein the gas path conversion valve is an electronically controlled gas path conversion valve and comprises a main gas channel switching solenoid valve respectively communicated with one input end communicating with the main gas path, one output end communicating with the first main gas nozzle mouth, and one output end communicating with the second main gas nozzle mouth, whether gas introduced from the input end is simultaneously introduced to the two output ends or is only introduced to one output end communicating with the first main gas nozzle mouth is determined according to a gas calorific value, an ignition gas channel switching solenoid valve is further provided and is communicated with one input end communicating with the ignition gas path, one output end communicating with the low calorific value ignition gas path and one output end communicating with the high calorific value ignition gas path, whether gas introduced from the input end is introduced to one output end communicating with the low calorific value ignition gas path or is introduced to one output end communicating with the high calorific value ignition gas path is determined according to a gas calorific value; each of the low calorific value voltage regulator valve and the high calorific value voltage regulator valve is a switch voltage regulator valve for switching, the low calorific value voltage regulator valve comprises a low calorific value voltage regulator switching switch, and the high calorific value voltage regulator valve comprises a high calorific value voltage regulator switching switch.

13. A dual-gas source gas control system with anti-gas source misconnection, the dual-gas source gas control system comprising:

a low calorific value voltage regulator valve and a high calorific value voltage regulator valve, wherein an input end and an output end of the low calorific value voltage regulator valve are respectively connected to a low calorific value gas path configured for transmitting a low calorific gas source, and an input end and an output end of the high calorific value voltage regulator valve are respectively connected to a high calorific value gas path configured for transmitting a high calorific gas source;

a switch control valve, acting as a master switch configured for controlling a gas path to be cut off, provided with a first solenoid valve configured for controlling the switch control valve to be turned on or turned off, comprising two input ends, wherein one of the input ends is connected to the low calorific value voltage regulator valve through the low calorific value gas path, and the other one of the input ends is connected the high calorific value voltage regulator valve through the high calorific value gas path, and further comprising two output ends, respectively connected to a main gas path and an ignition gas path one by one;

a gas path conversion valve comprising two input ends, wherein one of the input ends is connected to the output end of the switch control valve communicating with the main gas path, and the other one of the input ends is connected to the output end of the switch control valve communicating with the ignition gas path, further comprising four output ends, wherein the four output ends are respectively communicated with a low calorific value ignition gas path leading to a low calorific value gas ignition device, a high calorific value ignition gas path leading to a high calorific value gas ignition device, and a first main gas nozzle mouth and a second main gas nozzle mouth leading to a main burner one by one, and further comprising a high calorific value gas internal path, a low calorific value gas internal path and a knob or a switch configured for switching between the high calorific value gas internal path and the low calorific value gas internal path, wherein the low calorific value gas internal path is respectively communicated with low calorific value ignition gas path, the first main gas nozzle mouth and a second main gas nozzle mouth, and the high calorific value gas internal path is respectively communicated with the high calorific value ignition gas path and the first main gas nozzle mouth;

the main burner, wherein an input end thereof are disposed corresponding to the first main gas nozzle mouth and the second main gas nozzle mouth on the gas path conversion valve, so that gas emitted from the first main gas nozzle mouth and the second main gas nozzle mouth directly enters the input end of the main burner, and a burner opening required by high calorific value gas and low calorific value gas to burn normally is disposed at an outer side of the main burner;

the low calorific value gas ignition device, comprising a low calorific value gas lighter near the burner opening required for burning of the low calorific value gas on the main burner, a low calorific value gas ignition needle and a low calorific value gas thermocouple disposed adjacent to the low calorific value gas lighter, wherein the low calorific value gas lighter is connected to a corresponding output end on the gas path conversion valve through the low calorific value ignition gas path;

the high calorific value gas ignition device, comprising a high calorific value gas lighter near the burner opening required for burning of the high calorific value gas on the main burner and a high calorific value gas ignition needle and a high calorific value gas thermocouple disposed adjacent to the high calorific value gas lighter, wherein the high calorific value gas lighter is connected to a corresponding output end on the gas path conversion valve through the high calorific value ignition gas path;

an igniter, electrically connected to the low calorific value gas ignition needle and the high calorific value gas ignition needle respectively;

the dual-gas source gas control system further comprises:

a flame sensor disposed at one side near the low calorific value gas thermocouple and away from the low calorific value gas lighter, and configured for detecting a flame signal;

wherein the igniter further comprises a power supply and an error-proof control circuit electrically connected thereto, the error-proof control circuit is the control circuit according to claim 1, the control circuit is electrically connected to the flame sensor, after an igniter switch on the igniter is pressed, electricity provided by the power supply is transmitted to the connected control circuit, and the control circuit begins to function and receive the flame signal sent from the flame sensor;

wherein an anode of the low calorific value gas thermocouple is connected to an anode of the high calorific value gas thermocouple, a cathode of the low calorific value gas thermocouple and a cathode of the high calorific value gas thermocouple are connected to form a thermocouple parallel circuit, an anode and a cathode of the thermocouple parallel circuit are electrically connected to an anode and a cathode of the first solenoid valve respectively one by one, the low calorific value gas thermocouple generates an electric potential after being burned by ignited gas, so as to continuously supply power to the first solenoid valve in the switch control valve, so that the first solenoid valve stays in a closed state and the gas path is in a turned on state;

an on/off valve disposed on the low calorific value ignition gas path between output ends corresponding to the low calorific value gas lighter on the low calorific value gas lighter and the gas path conversion valve, comprising a second solenoid valve configured for controlling connection and cutting off of the low calorific value ignition gas path, wherein an anode and a cathode of the second solenoid valve are electrically connected to an anode output level and a cathode output level on the control circuit one by one, when the control circuit detects the flame signal from the flame sensor indicating that the high calorific value gas is misconnected to the low calorific value gas lighter, electrical levels outputted from the anode output level and the cathode output level are both zero, the second solenoid valve on the on/off valve is not closed to prevent gas in the low calorific value ignition gas path from entering the low calorific value gas lighter, a gas flame is reduced until being put out without burning the low calorific value gas thermocouple, such that the low calorific value gas thermocouple cannot continuously supply power to the first solenoid valve in the switch control valve, and the first solenoid valve in the switch control valve without receiving power supply is not closed to prevent external gas from entering the gas path in the system through the switch control valve.

14. The dual-gas source gas control system with anti-gas source misconnection according to claim 13, wherein an over voltage protection device is disposed on the low calorific value ignition gas path between the output ends corresponding to the low calorific value gas lighter on the low calorific value gas lighter and the gas path conversion valve.

15. The dual-gas source gas control system with anti-gas source misconnection according to claim 13, wherein the gas path conversion valve is a manual gas path conversion valve and comprises:

a valve body, wherein an outer periphery of the valve body is provided with an internally-communicated low calorific value gas lighter outlet, a high calorific value gas lighter outlet, a gas lighter gas path inlet, and a main inlet;

a spool, provided and disposed in the valve body, wherein a connection groove is disposed on an outer periphery of the spool, the spool rotates so that the connection groove is communicated with the low calorific value gas lighter outlet and the gas lighter gas path inlet or is communicated with the high calorific value gas lighter outlet and the gas lighter gas path inlet;

a valve seat, provided and disposed on an upper end of the valve body, wherein a valve rod is slidably inserted into the valve seat, an upper end of the valve rod exposes out of the valve seat, a lower end of the valve rod is loosely connected to the other end of a connection rotation shaft with one end disposed on the spool, the connection rotation shaft is sleeved with a reset spring for resetting the valve rod after operation; and a double gas nozzle, communicated with the main inlet and disposed at an lower end of the valve body, a circle-shaped barrier is protruded at an inner side of the double gas nozzle, at least one in-circle nozzle mouth for the low calorific value gas to be emitted is provided in the circle-shaped barrier on the double gas nozzle, at least one outer nozzle mouth for the low calorific value gas or the high calorific value gas to be emitted is disposed between an outer periphery of the double gas nozzle and the circle-shaped barrier, the first main gas nozzle mouth is the outer nozzle mouth, and the second main gas nozzle mouth is the in-circle nozzle mouth, an inner gas transfer chamber for merely the low calorific value gas to enter and an outer gas transfer chamber surrounding an outer periphery of the inner gas transfer chamber for the low calorific value gas or the high calorific value gas to enter are respectively formed when the double gas nozzle and the valve body are connected, the inner gas transfer chamber is communicated with the in-circle nozzle mouth, and the outer gas transfer chamber is communicated with the outer nozzle mouth a spool through hole assembly is disposed on the spool, two ends of the spool through hole assembly are respectively communicated with the inner gas transfer chamber and a low gas transfer channel communicated with the main inlet and disposed on the valve body in a sealed manner, and the low calorific value gas is introduced in or the high calorific value gas is prevented from entering the inner gas transfer chamber through rotation of the spool, so that an effective gas-intake cross-sectional area corresponding to requirement from the high and low calorific value gas on the double gas nozzle is adjusted.

16. The dual-gas source gas control system with anti-gas source misconnection according to claim 15, wherein the spool through hole assembly comprises a first spool hole axially disposed near an end of the double gas nozzle on the spool, the first spool hole is communicated with the inner gas transfer chamber in a sealed manner, a second spool hole communicated with the first spool hole is disposed at an outer side of the spool, the second spool hole is communicated with the low gas transfer channel in a sealed manner; the spool is tapered, the spool matches a size and a shape of a space in the valve body accommodating the spool, a low calorific value gas limitation groove and a high calorific value gas limitation groove are disposed in the valve seat in a high and low manner and in a misaligned arrangement, a boss is disposed on the valve rod, the valve rod downwardly moves so that the valve rod passes the connection rotation shaft to drive the spool to rotate to switch the ignition device gas paths between the high and low calorific value gas, the boss is engaged in a corresponding limitation groove so that the valve rod is positioned; the connection groove has a sector structure with an angle of 180 degrees, the low calorific value gas lighter outlet and the gas lighter gas path inlet are located on a same center line, a center line of the high calorific value gas lighter outlet and a center line of the low calorific value gas lighter outlet are in a same plane; a damper regulation structure for regulating gas intake in a gas main tube is disposed between an outer end of the double gas nozzle and the gas main tube connected to an outer portion of the main burner, and one end of the damper regulation structure is connected to an outer end of the valve rod.

17. The dual-gas source gas control system with anti-gas source misconnection according to claim 16, wherein a first connection short tube is disposed between the circle-shaped barrier and the valve body in a sealed manner for transferring the low calorific value gas; the double gas nozzle and the circle-shaped barrier are integrally connected in one piece; the damper regulation structure comprises a second connection short tube disposed between the main burner and the external gas main tube in a sealed manner, a first damper for air to enter is disposed at one side of the second connection short tube, a rotation barrel having a size and a shape matched with that of the second connection short tube is disposed at an outer periphery of the second connection short tube, a second damper corresponding to the first damper is disposed on the rotation barrel, a damper linking rod capable of driving the rotation barrel and the valve rod to simultaneously rotate is disposed between the rotation barrel and the valve rod; at least a pair of axial limitation ribs for limiting the rotation barrel to move in an axial direction of the second connection short tube protrudes from an outer side of the second connection short tube; connection between the damper linking rod and the rotation barrel and connection between the damper linking rod and the valve rod are detachable; a knob is disposed at an outer end of the valve rod, and the knob is connected to the damper linking rod.

18. The dual-gas source gas control system with anti-gas source misconnection according to claim 13, wherein the gas path conversion valve is an electronically controlled gas path conversion valve and comprises a main gas channel switching solenoid valve respectively communicated with one input end communicating with the main gas path, one output end communicating with the first main gas nozzle mouth, and one output end communicating with the second main gas nozzle mouth whether gas introduced from the input end is simultaneously introduced to the two output ends or is only introduced to one output end communicating with the first main gas nozzle mouth is determined according to a gas calorific value, an ignition gas channel switching solenoid valve is further provided and is communicated with one input end communicating with the ignition gas path, one output end communicating with the low calorific value ignition gas path, and one output end communicating with the high calorific value ignition gas path, whether gas introduced from the input end is introduced to one output end communicating with the low calorific value ignition gas path or is introduced to one output end communicating with the high calorific value ignition gas path is determined according to a gas calorific value; each of the low calorific value voltage regulator valve and the high calorific value voltage regulator valve is a switch voltage regulator valve for switching, the low calorific value voltage regulator valve comprises a low calorific value voltage regulator switching switch, and the high calorific value voltage regulator valve comprises a high calorific value voltage regulator switching switch.

* * * * *